US005815120A

United States Patent [19]

Lawrence et al.

[11] Patent Number: 5,815,120

[45] Date of Patent: Sep. 29, 1998

[54] RADIO FREQUENCY LOCAL AREA NETWORK ADAPTER CARD STRUCTURE AND METHOD OF MANUFACTURE

[75] Inventors: Mark John Lawrence; William B. Nunnery, both of Cary, N.C.

[73] Assignee: International Business Machines Corporation, Armonk, N.Y.

[21] Appl. No.: 608,229

[22] Filed: Feb. 28, 1996

[51] Int. Cl.[6] ..... H01Q 1/24

[52] U.S. Cl. ..... 343/702; 343/752; 343/833; 343/846; 343/872; 439/60

[58] Field of Search ..... 343/752, 702, 343/872, 846, 895, 833, 873; 439/60, 62, 65; H01Q 1/24, 1/38

[56] References Cited

U.S. PATENT DOCUMENTS

| | | | |
|---|---|---|---|
| 4,804,972 | 2/1989 | Schudel | 343/872 |
| 4,819,004 | 4/1989 | Argintaru et al. | 343/778 |
| 4,935,745 | 6/1990 | Mori et al. . | |
| 5,020,137 | 5/1991 | Barsumian | 343/702 |
| 5,113,196 | 5/1992 | Ponce de Leon et al. . | |
| 5,196,994 | 3/1993 | Tanuma et al. . | |
| 5,244,397 | 9/1993 | Anhalt . | |
| 5,281,970 | 1/1994 | Blaese | 343/702 |
| 5,557,288 | 9/1996 | Kato et al. | 343/702 |

FOREIGN PATENT DOCUMENTS

| | | |
|---|---|---|
| 602778 | 6/1994 | European Pat. Off. . |

*Primary Examiner*—Donald T. Hajec
*Assistant Examiner*—Tho Phan
*Attorney, Agent, or Firm*—John D. Flynn; Morgan & Finnegan

[57] ABSTRACT

A radio frequency (RF) local area network (LAN) adapter card for a personal computer conforms to the Personal Computer Memory Card International Association (PCMCIA) standard 2.0 (extended), providing a credit-card sized RF LAN communications terminal that plugs into the side of a personal computer, a laptop computer, a palmtop computer, and the like. The RF LAN adapter card includes a minimum height, broadband integrated antenna that provides a vertically polarized RF signal with good horizontal range. The combination of the antenna and its surrounding radome provide a high gain, omnidirectional radiation pattern that overcomes the parasitic distortions imposed by the close proximity of the personal computer housing. The adapter card housing includes internal RF shielding structures that shield the antenna from noise radiated by radio frequency signal circuits within the housing. A conductive adhesive coating is provided on the conductive layer of the ground plane of the antenna, for mechanically and electrically connecting the ground plane to the adapter card housing. This enables the antenna to be assembled to the housing at a later time after testing of the internal circuits in the adapter card.

13 Claims, 40 Drawing Sheets

RADIO FREQUENCY LOCAL AREA NETWORK ADAPTER CARD STRUCTURE AND METHOD OF MANUFACTURE

FIELD OF THE INVENTION

The invention disclosed herein broadly relates to data processing and data communications systems and more particularly related to radio frequency communications of data in local area networks.

BACKGROUND OF THE INVENTION

Related Copending Patent Applications

The invention disclosed herein is related to the following copending U.S. patent applications, assigned to the IBM Corporation and incorporated herein by reference.

U.S. patent application Ser. No. 08/329,362, filed Oct. 26, 1994 by Camp, Jr., et al, entitled "Method and Apparatus for Digital Frequency Compensation of Carrier Drift in a PSK Demodulator";

U.S. patent application Ser. No. 08/329,363, filed Oct. 26 1994, by Camp, Jr., et al, entitled "A Phase Demodulation Method and Apparatus for a Wireless LAN, by Counting the IF Period"; and U.S. patent application Ser. No. 08/329,364, filed Oct. 27, 1994, by Camp, Jr., et al, entitled "Method and Apparatus for Digital Carrier Detection in a Wireless LAN".

Discussion of the Background of the Invention

Local area networks (LANs) can interconnect a wide variety of devices such as personal computers, mainframe computers, printers, network servers, and communications gateways. LANs enable the sharing of expensive resources among many users, such as laser printers and large databases. In distributed processing applications, LANs enable people to work together in workgroups and departments, permitting them to pass information between them electronically, in the same manner as they did when the tasks were completed on paper. The advent of laptop and palmtop personal computers with LAN interface adapters has enabled users to work with their personal computers while on business trips, and to communicate with their home office or with clients by plugging in to an available LAN cable connector. The small, credit-card sized LAN interface adapters conform to the Personal Computer Memory Card Industry Association (PCMCIA) standard 2.0. They contain communications circuits, processor circuits, and memory circuits to store the operating systems and protocols needed to perform the functions of a LAN interface adapter. Conventional LANs have been restricted to electric wire media where signals are received only by stations connected to the medium. Although such bounded media have a security advantage, the necessity of maintaining a wire connection limits the mobility of stations on the network. A user cannot arbitrarily choose any location to log on to a network, but must locate near an available LAN cable connector.

Recently, the Federal Communications Commission (FCC) has provided the ISM radiofrequency band for short range communications in the 2.4 GHz to 2.5 GHz portion of the radio spectrum, which is suitable for LAN operations. This band falls within the UHF portion of the spectrum, where the path taken by the electromagnetic radiation is influenced by the presence of parasitic capacitances in the nearby structures. In designing a radiofrequency (RF) LAN for a portable laptop computer, it would be desirable to mount the radio antenna on a PCMCIA interface adapter card that plugs into the computer's housing. However, this creates a problem in providing an omnidirectional radiation pattern for LAN communications, since the close proximity of the laptop's housing to the antenna will distort the desired omnidirectional pattern. Furthermore, the FCC's implementing regulation (FCC Part 15, Subpart C, Intentional Radiator) allocates the ISM band to a 100 MHz portion of the spectrum, but strictly prohibits any stray radiation outside of the band. A radiofrequency transmitter circuit in this band generates a rich spectrum of unwanted harmonics outside of the band. This poses a problem of how to effectively isolate the transmitter circuit when it must be located inside a PCMCIA interface adapter card in close proximity to the radio antenna.

OBJECTS OF THE INVENTION

It is therefor an object of the invention to provide an improved radio frequency local area network capability for personal computers and the like.

It is another object of the invention to provide an improved radio frequency local area network adapter card for personal computers and the like, that has an omnidirectional, high gain radiation pattern in the horizontal direction with a good distance range.

It is a further object of the invention to provide an improved radio frequency local area network adapter card for personal computers and the like, that makes full use of an allocated radiofrequency communications band without transmitting significant out-of-band radiation.

It is yet a further object of the invention to provide an improved radio frequency local area network adapter card for personal computers and the like, that has a minimum height.

It is moreover a further object of the invention to provide an improved radio frequency local area network adapter card for personal computers and the like, that facilitates testing during all phases of manufacturing.

SUMMARY OF THE INVENTION

These and other objects, features and advantages are accomplished by the radio frequency (RF) local area network (LAN) adapter card for a personal computer disclosed herein. The RF LAN adapter card conforms to the Personal Computer Memory Card International Association (PCMCIA) standard 2.0 (extended), providing a credit-card sized RF LAN communications terminal that plugs into the side of a personal computer, a laptop computer, a palmtop computer, and the like.

In accordance with the invention, the RF LAN adapter card includes a minimum height, broadband integrated antenna that provides a vertically polarized RF signal with good horizontal range. A top hat antenna has a mast portion oriented perpendicularly to a geometric plane with one end thereof mounted on an insulating substrate at a base point and electrically connected to a radio frequency signal source and the opposite end of the mast terminated at the center of a circular conductive plate oriented parallel to the geometric plane. The circular conductive plate has a radius of a first magnitude and the mast has a length of a second magnitude, the sum of the first and second magnitudes being substantially equal to a quarter wave length of electromagnetic radiation having a central resonant frequency value, radiated by the antenna in response to the radio frequency signal source. A first transmission line is mounted on the substrate at the base of the antenna and functions as a quarter wavelength matching transformer that couples the base point to the radio frequency signal source. A second transmission line is mounted on the substrate and connected to the base point, forming an impedance match at frequencies lower than the central frequency. A third transmission line is mounted on the substrate and connected to the base point, forming an impedance match at frequencies higher than the central frequency. In this manner, a broadband radiation characteristic is achieved for the RF LAN adapter card.

Further in accordance with the invention, the combination of the antenna and its surrounding radome provide a high gain, omnidirectional radiation pattern that overcomes the parasitic distortions imposed by the close proximity of the personal computer housing. The radome is mounted on the adapter card housing and surrounds the antenna. The radome has an enhanced directivity oriented toward the personal computer housing, to compensate for the disturbance to the radiated field. The radome is a substantially hemispherical shell having an open side mounted on the adapter card housing surrounding the antenna, with an edge forming a plane substantially parallel to the geometric plane. In accordance with the invention, one face of the shell proximate to the personal computer housing has a substantially planar surface substantially perpendicular to the geometric plane. The asymmetric shape of the radome is believed to increase the capacitance on the side of the antenna toward the personal computer housing, increasing the intensity of the radiation from the antenna in that direction, thereby compensating for the distorting effects of the nearby computer. In the preferred embodiment, the radome includes a cylindrical surface projecting from the face of the shell proximate to the personal computer housing. The projecting surface has a cylindrical axis substantially perpendicular to the geometric plane.

Further in accordance with the invention, the directivity of the antenna is further enhanced by forming an asymmetric, reflecting ground plane for the antenna in a direction toward the personal computer. This is accomplished by bonding the substrate ground plane layer to the conductive cover of the card housing with a layer of conductive adhesive. The conductive cover of the housing forms the supporting surface for the antenna's substrate ground plane and extends from a position proximate to the antenna to a position proximate to the personal computer. This forms the asymmetric, reflecting ground plane for the antenna in the direction toward the personal computer. The conductive adhesive coating on the conductive layer of the substrate ground plane of the antenna, mechanically and electrically connects the substrate ground plane to the supporting surface of the conductive cover. The resulting asymmetric, reflecting ground plane helps to compensate for the disturbance to the radiated field imposed by the close proximity of the personal computer.

In an alternate embodiment of the invention, the antenna, itself, has an enhanced directivity oriented toward the personal computer housing, to compensate for the disturbance to the radiated field. The alternate antenna includes a driven dipole element having a mast portion oriented perpendicularly to the geometric plane with one end thereof mounted on the substrate at a base point and electrically connected to a radio frequency signal source. A parasitic director element of the antenna has a mast portion oriented perpendicularly to the geometric plane with one end thereof mounted on the substrate. The director element is positioned between the personal computer housing and the driven element and is spaced from the driven element to form a plane therewith that passes through the personal computer housing. In this manner, the gain of the antenna is greater in a direction toward the personal computer housing than it is in a direction away from the personal computer housing. Other types of directed antennas can also be used in accordance with the invention, to provide an antenna gain which is greater in the direction toward the personal computer housing than it is in a direction away from the personal computer housing, so as to compensate for the disturbance to the radiated field imposed by the close proximity of the personal computer. For example, the top hat plate on a top hat antenna can have an asymmetrical shape forming a capacitance with respect to the ground plane that is greater in the direction toward the personal computer housing than it is in the direction away from it. An elliptically shaped plate, for example, would have its major axis pointing in the direction of the housing. A polygon shaped plate, as another example, would have its longest dimension pointing in the direction of the housing.

Further in accordance with the invention, the adapter card housing includes internal RF shielding structures that shield the antenna from noise radiated by radio frequency signal circuits within the housing. A circuit card inside the housing has a first edge mounted to a mechanical connector assembly for mounting engagement with a mating connector on the personal computer housing. The card has logic circuits and radio frequency signal circuits mounted on a first surface thereof. The logic circuits are coupled to electrical terminals in the mechanical connector assembly for exchanging first digital signals with the personal computer. The logic circuits output second signals to the radio frequency signal circuits in response to the first signals. The radio frequency signal circuits are coupled to the antenna and output radio frequency signals as the radio frequency signal source to the antenna in response to the second signals. In accordance with the invention, a conductive grounding electrode is mounted along the periphery of the first surface of the card, connected to a system grounding potential, for shielding the antenna from the radio frequency signal circuits. The adapter housing includes a frame having a recessed portion on a first side thereof for mating with the periphery of the card. In accordance with the invention, the frame includes a plurality of electrically conductive springs for resiliently contacting the conductive grounding electrode to make electrical contact therewith for shielding the antenna from the radio frequency signal circuits. The springs also extend to a second side of the frame opposite to the first side thereof. A top conductive cover is included in the adapter card housing, having an edge portion on a first side thereof for mating with the springs on the second side of the frame. In accordance with the invention, the springs resiliently contact the top conductive cover to make electrical contact therewith for shielding the antenna from the radio frequency signal circuits. A bottom conductive cover is included in the adapter card housing, having an edge portion for mating engagement with an edge of the top conductive cover and having a recessed central portion. In accordance with the invention, a resilient pad is positioned between the recessed central portion of the bottom cover and a second surface of the circuit card opposite to the first surface thereof, for resiliently forcing the plurality of electrically conductive springs into contact with the conductive grounding electrode of the circuit card to make electrical contact therewith, and forcing the springs into contact with the top conductive cover to make electrical contact therewith. In this manner, the antenna is shielded from noise radiated from the radio frequency signal circuits.

Still further in accordance with the invention, the conductive adhesive coating provided on the conductive layer of the ground plane of the antenna, which mechanically and electrically connects the ground plane to the adapter card housing, enables the antenna to be assembled to the housing at a later time after testing of the internal circuits in the adapter card. A planar platform surface is provided on a second side of the top conductive cover opposite to the first side, for mechanically supporting and electrically contacting the conductive layer of the ground plane of the antenna. The platform includes an aperture. A first shielded coaxial connector is mounted on the first surface of the circuit card at a second end opposite from the mechanical connector assembly, the first coaxial connector being juxtaposed with the aperture in the planar platform. In this manner, the circuit card can be tested by connecting a test probe to the first shielded coaxial connector through the aperture prior to assembling the antenna to the adapter card housing. A second shielded coaxial connector is mounted on the conductive layer of the ground plane of the antenna, for mating engagement with the first coaxial connector through the aperture. A center electrode of the second connector is coupled to the antenna. A conductive adhesive coating is provided on the conductive layer of the ground plane of the antenna, for mechanically and electrically connecting the ground plane to the planar platform surface of the top conductive cover. In this manner, the antenna can be assembled to the adapter card housing at a time following testing of the circuit card through the aperture. Thereafter, the radome can be attached to the top conductive cover over the antenna.

DESCRIPTION OF THE FIGURES

These and other objects, features and advantages of the invention will be more fully appreciated with reference to the accompanying figures.

DISCUSSION OF THE PREFERRED EMBODIMENT

Figure 7A:
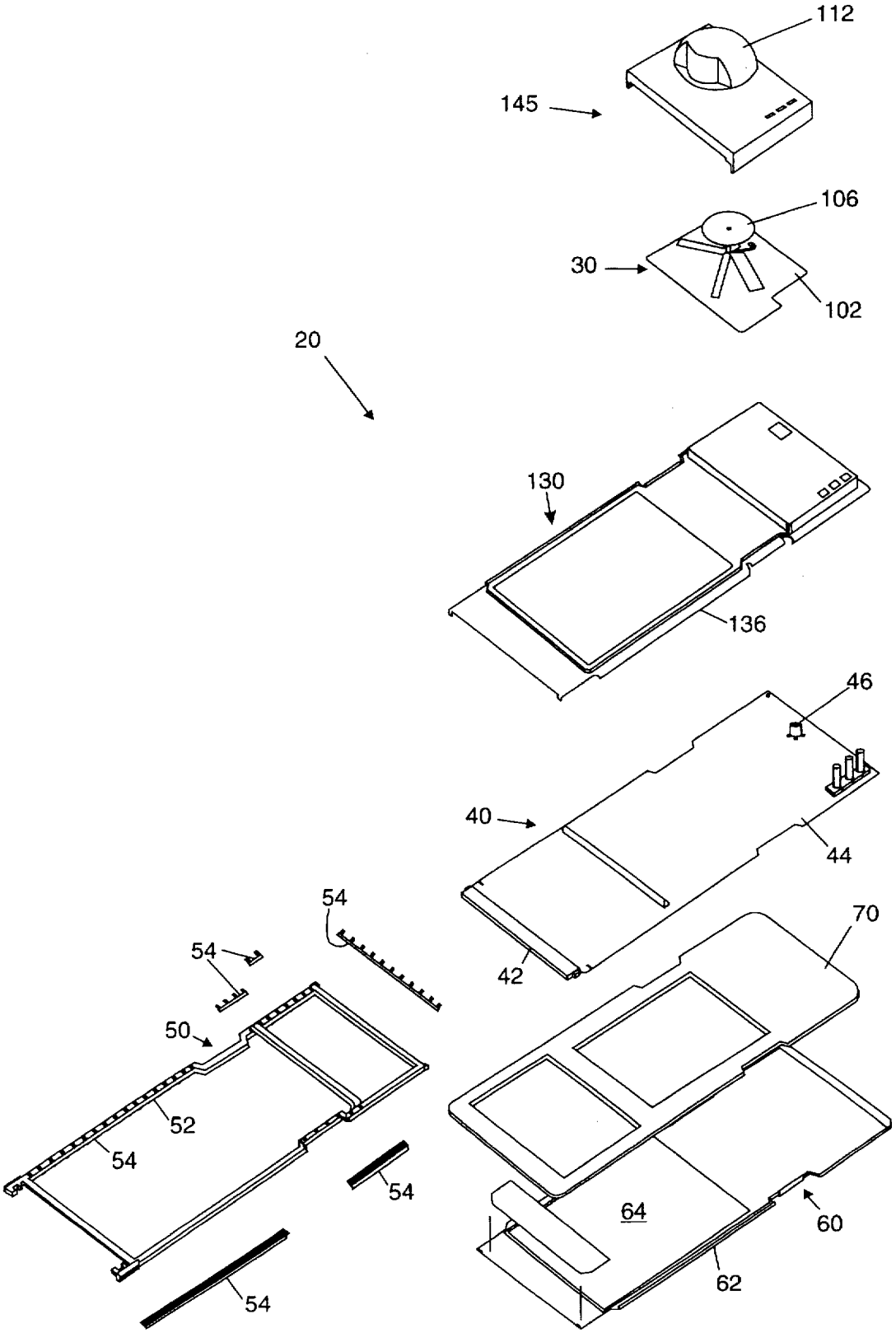
FIG. 7A is an exploded view of the components of the preferred embodiment of the adapter card 20.
Figure 7B:
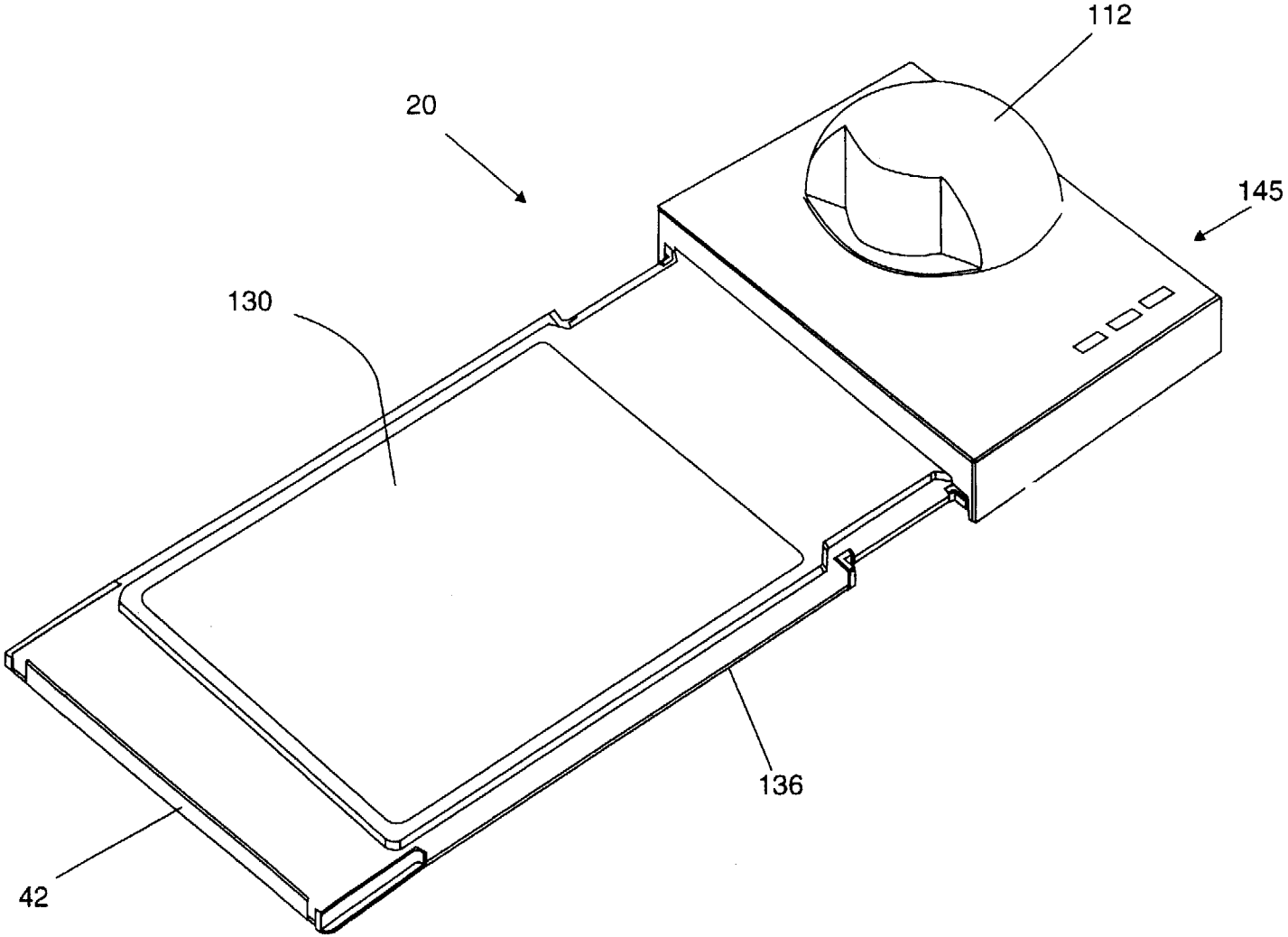
FIG. 7B is an isometric view of the preferred embodiment of the adapter card.

The radio frequency (RF) local area network (LAN) adapter card 20 shown in exploded view in FIG. 7A and in isometric view in FIG. 7B, provides a credit-card sized RF LAN communications terminal that plugs into the side of a personal computer, a laptop computer, a palmtop computer, or other information processing device. The RF LAN adapter card 20 includes a minimum height, broadband integrated antenna assembly 145 that provides a vertically polarized RF signal with good horizontal range. FIG. 5A is a side view of the preferred embodiment for the antenna assembly 145, including the asymmetric radome 112 and top hat antenna 106 with an asymmetric, reflecting ground plane and metal support structure 130 mounted to a personal computer 160. In order to understand the principle of operation of the invention, the component parts and functions of the antenna assembly 145 will be analyzed in association with FIGS. 1A to 1H, FIGS. 2A to 2H, FIGS. 3A to 3H, and FIGS. 4A to 4H.

Figure 1A:
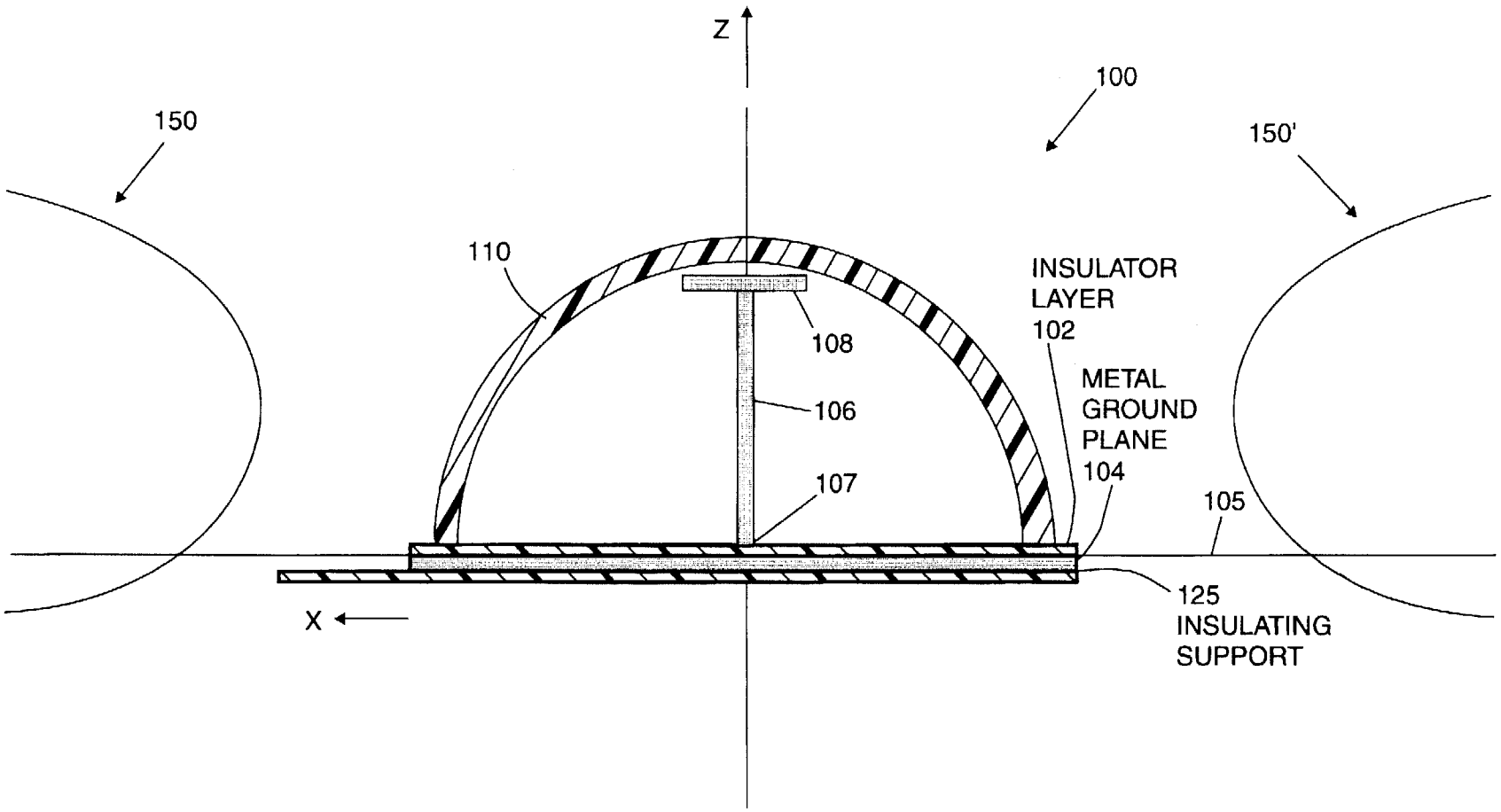
FIG. 1A is a side view of the antenna assembly 100, including the hemispherical radome 110 and top hat antenna 106 with an insulating support structure 125.

FIG. 1A is a side view of a simplified antenna assembly 100, including a hemispherical radome 110 and top hat antenna 106 with an insulating support structure 125. The top hat antenna 106 has a mast portion oriented perpendicularly to a geometric plane 105 with one end thereof mounted on an insulating substrate 102 at a base point 107 and electrically connected to a radio frequency signal source and the opposite end of the mast terminated at the center of a circular conductive plate 108 oriented parallel to the geometric plane 105. The circular conductive plate 108 has a radius of a first magnitude and the mast has a length of a second magnitude, the sum of the first and second magnitudes being substantially equal to a quarter wave length of electromagnetic radiation having a central resonant frequency value, radiated by the antenna 106 in response to the radio frequency signal source. For a 2.4 gigahertz signal source, the wavelength is 4.60 inches in free space. Thus, the sum of the magnitudes is 1.15 inches and the height of the antenna 106 is less than one inch.

Antennas have an electrical appearance very similar to a series resonant circuit. That is, if the antenna is resonant the current and voltage are in phase; the current travels to the end and back to the driving point in ½ cycle and is in phase with the driving current. This makes the antenna appear to the driving source as a pure resistance. This pure resistance is mainly the radiated energy of the antenna (if ohmic losses are neglected). In free space a quarter wave vertical antenna at microwave frequencies will have a radiation resistance of about 38 ohms. Horizontal antennas have the problem of ground effects since their fields are modified from free space conditions by ground proximity. Vertical antennas can use the ground if it is large enough to form a mirror image of itself. The length of this type of vertical antenna can therefore be ¼ wavelength long at resonance, with the mirror image being formed by the ground. This is one way to decrease the effective antenna height.

Another way to decrease the effective antenna height is to split the vertical tip into two horizontal sections such that the overall length is ¼ wavelength. In effect, the "flat top" supplies a capacitance into which a current can flow. These horizontal sections do not radiate since the currents in the two portions are flowing in opposite directions, but their effect is to make the antenna appear to be much taller. Split ends are not the best way to make the antenna appear to be omnidirectional and thus the invention uses a flat disc 108.

The antenna assembly 100 of FIG. 1A uses the radome 110 to protect the antenna 106 from damage and isolate the user from transmitted radiation (in order to meet the American National Standard C95.1-1992; "Human exposure to RF Electromagnetic Fields 3 kHz to 300 GHz"). The radome must have both a low loss at 2.4 GHz and an acceptable dielectric constant. The dielectric constant has a value of about 2.9 and makes possible a smaller top hat antenna 106 to achieve the desired capacitance. The losses are not measurable when placing the radome 110 over the antenna 106, but the tuning effect is rather dramatic, as will be discussed below.

Figure 9A:
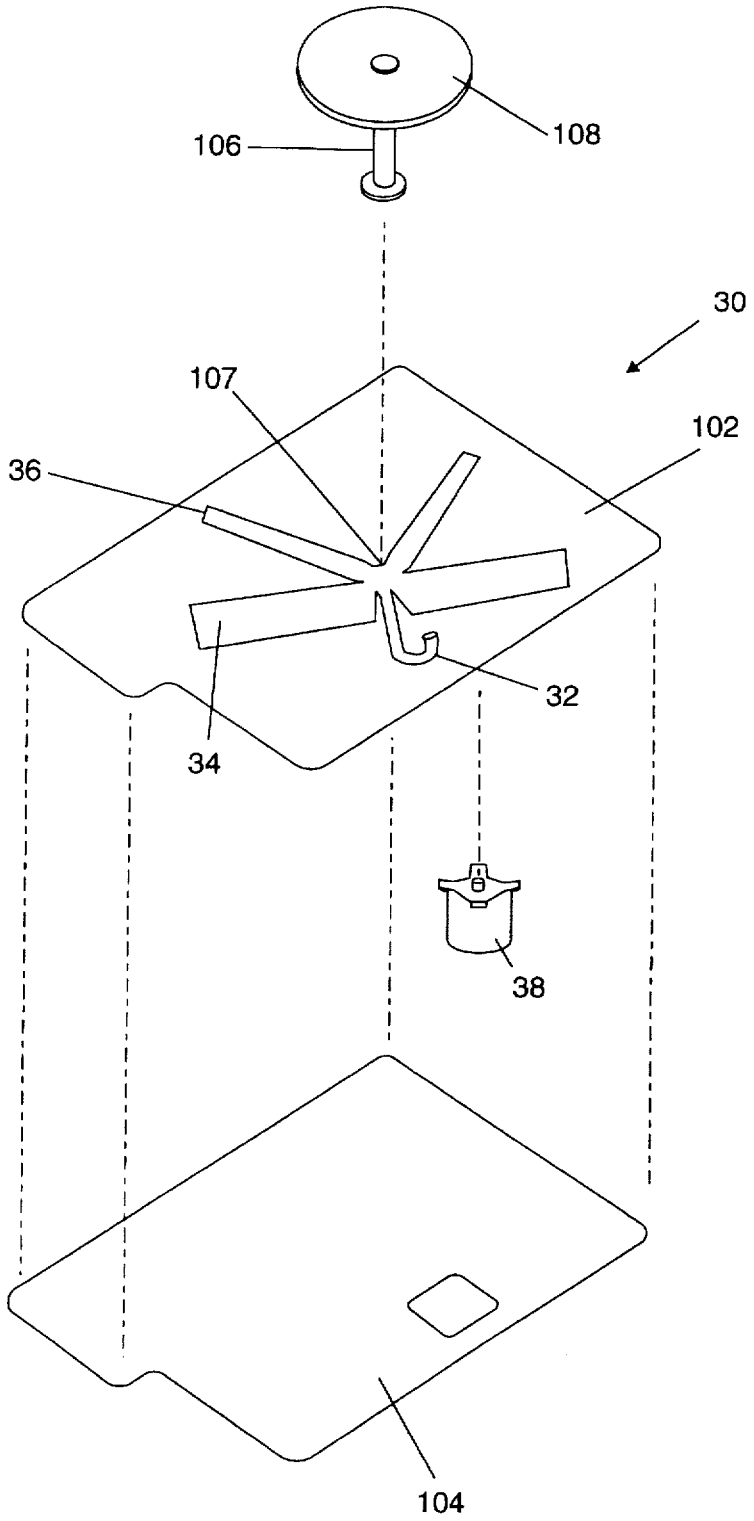
FIG. 9A is an exploded view of the components of the preferred embodiment of the antenna card 30.
Figure 9B:
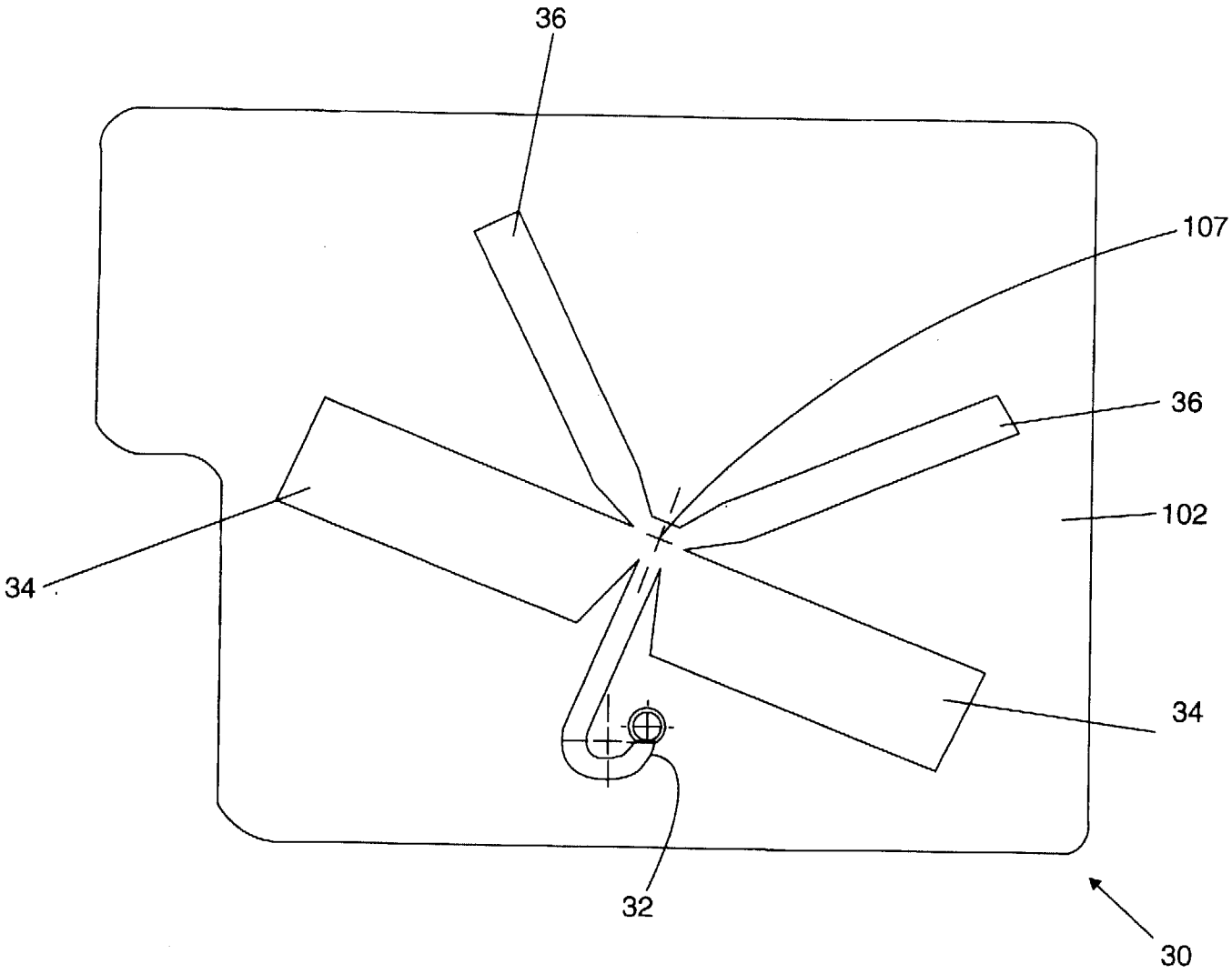
FIG. 9B is a top view of the preferred embodiment of the antenna card.

Reference can be made to FIG. 9B which shows a top view of the insulating substrate layer 102 forming the antenna card 30. A first transmission line 32 is mounted on the substrate 102 at the base 107 of the antenna and functions as a quarter wavelength matching transformer at the central frequency that couples the base point 107 to the radio frequency signal source. A second transmission line 34 is mounted on the substrate 102 and connected to the base point 107, forming an impedance match at frequencies lower than the central frequency. A third transmission line 36 is mounted on the substrate 102 and connected to the base point 107, forming an impedance match at frequencies higher than the central frequency. In this manner, a broadband radiation characteristic is achieved for the RF LAN adapter card 20.

Figure 11:
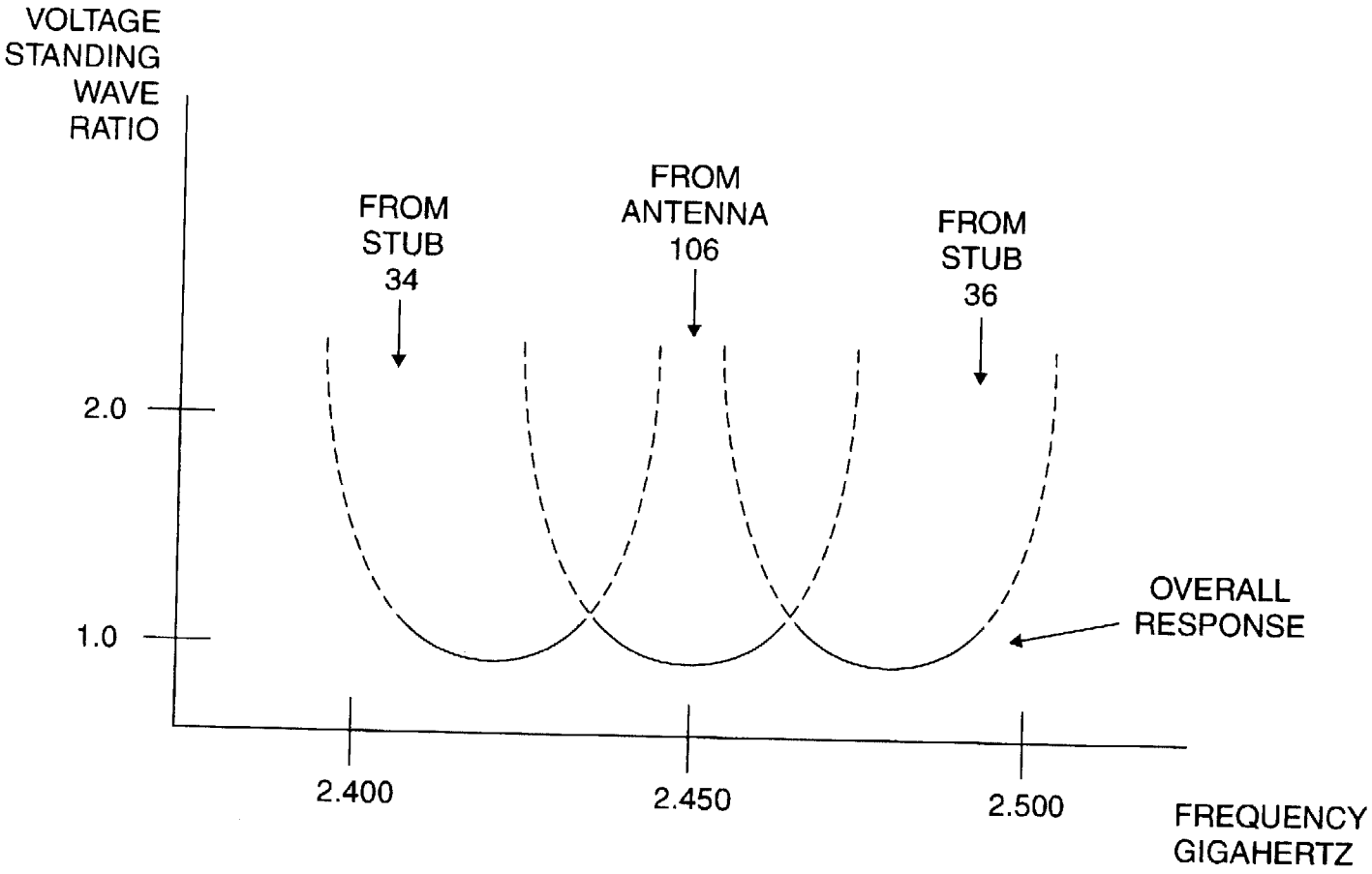
FIG. 11 shows the tuning effects of the matching stubs 34 and 36 on the voltage standing wave ratio (VSWR).
Figure 12A:
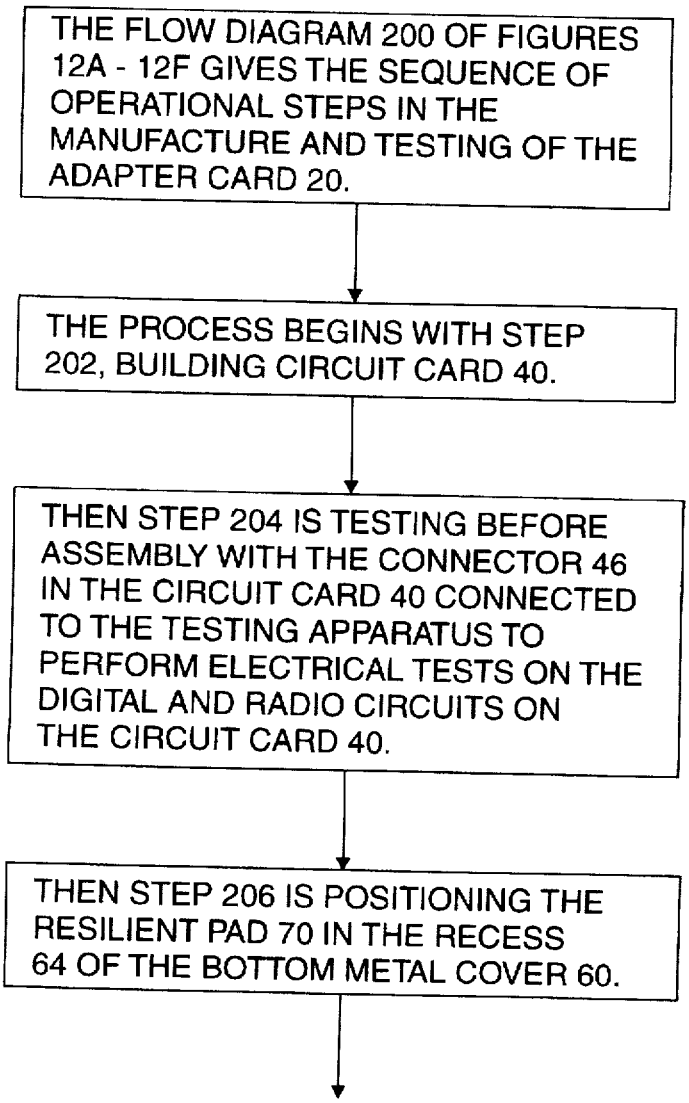
FIGS. 12A–12F show a flow diagram of the sequence of operational steps in the manufacture and testing of the adapter card 20.
Figure 12B:
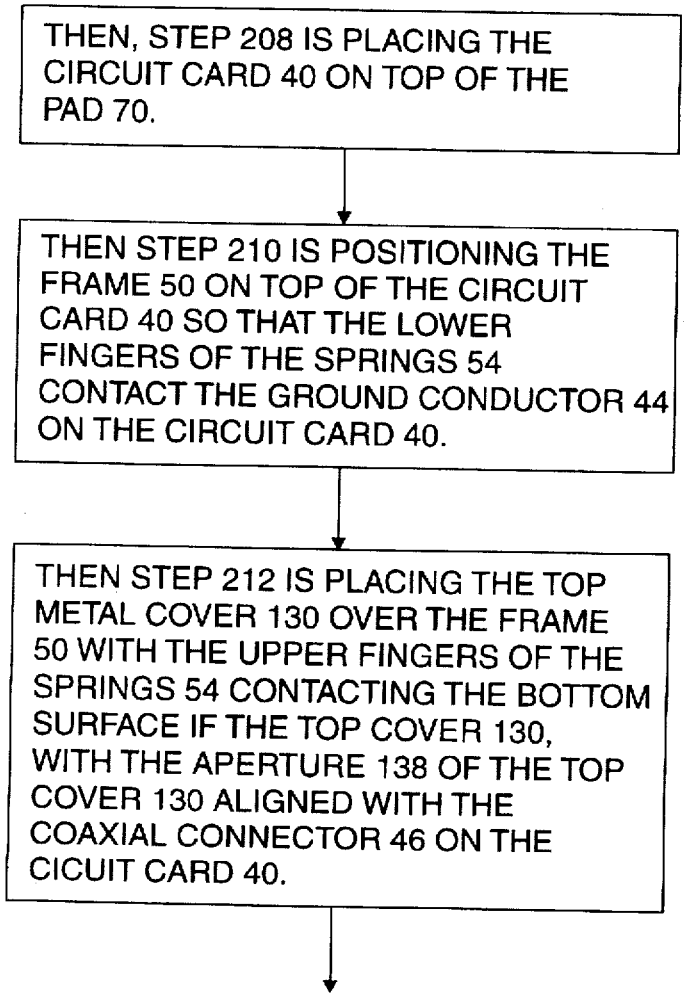
Figure 12C:
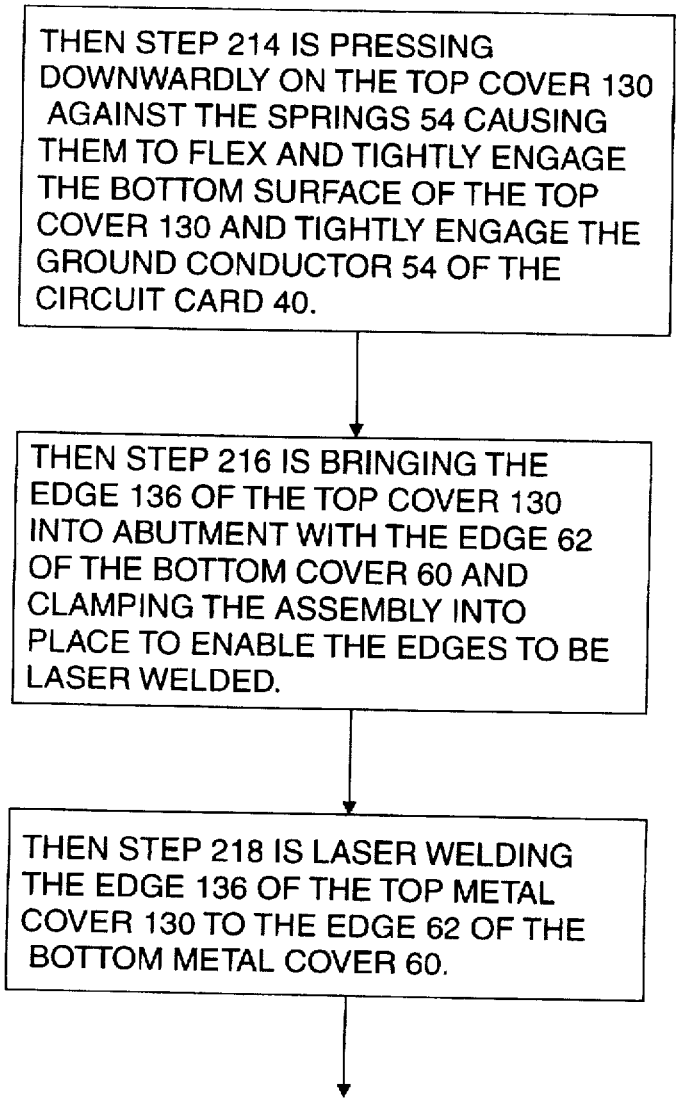
Figure 12D:
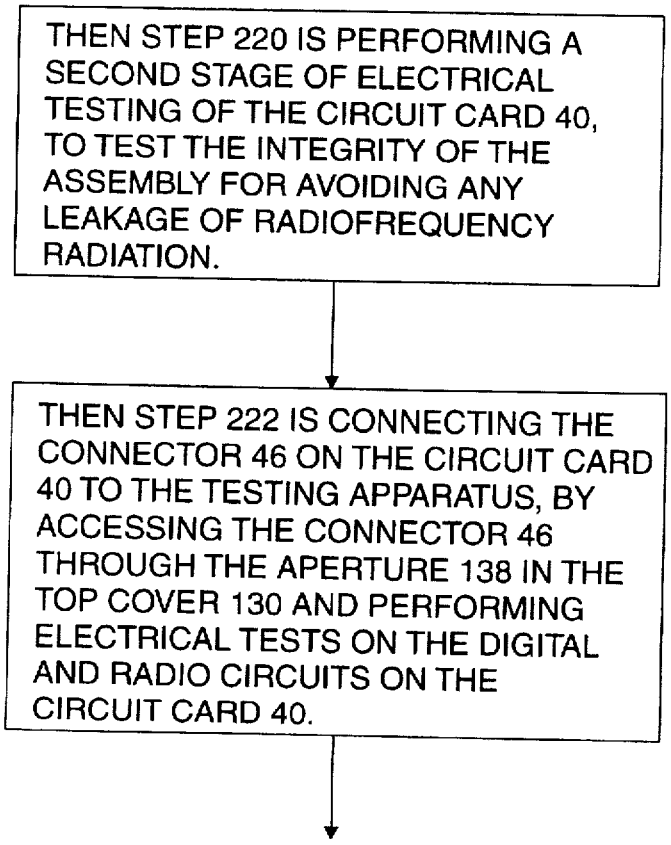
Figure 12E:
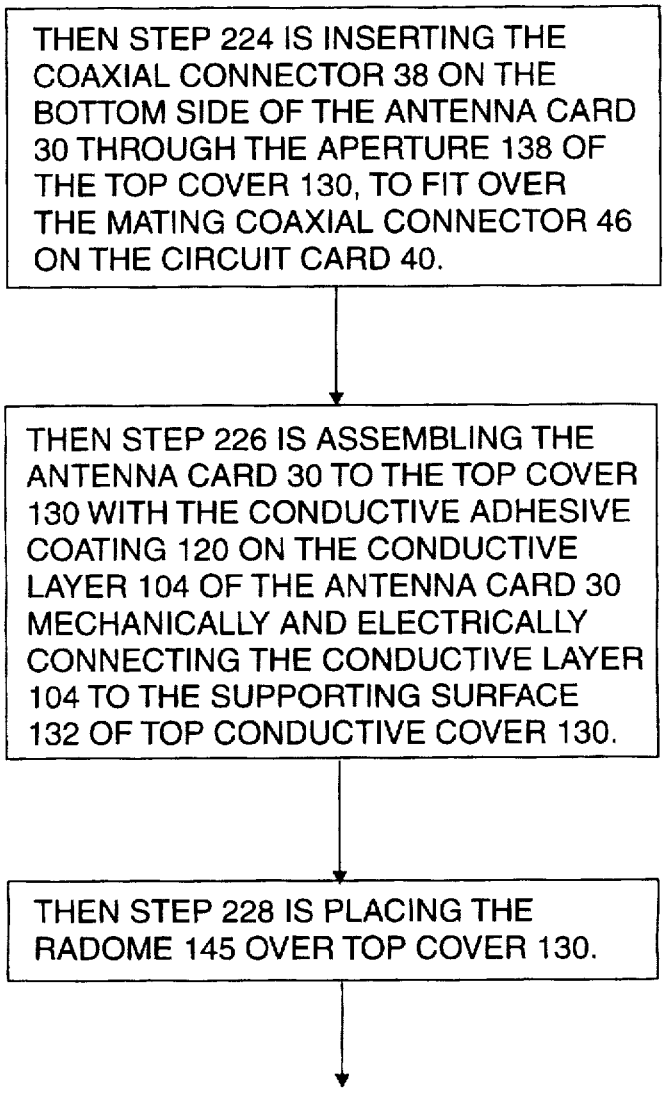
Figure 12F:
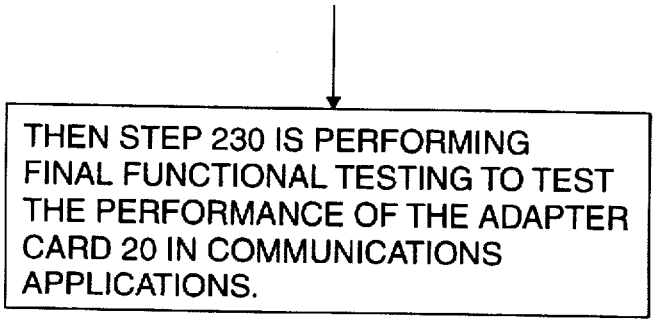

The preferred embodiment of the antenna 106 with its top hat 108 is designed to be resonant at 2.45 GHz. This means that the antenna will be too short at frequencies from 2.4 to 2.45 GHz and too long at frequencies from 2.45 to 2.5 GHz. When the antenna is too short the phase of the current leads the drive voltage and the antenna appears capacitive; when the antenna is too long it appears inductive. Adding the top hat 108 makes the drive point impedance capacitive over the whole band (very capacitive at the lower frequency and slightly capacitive at the higher frequency). Tuning out these reactances can be accomplished if an equal and opposite reactance value is introduced at the antenna feed point 107 in FIG. 9B. The patterns 36 and 34 on the top side of the insulator layer 102 of the antenna card 30 form shorted lengths of transmission lines that act as inductive reactances that make the antenna resistive at 2.475 and 2.425 GHz, respectively. These are referred to in the literature as matching stubs. The overall effect is to broaden the apparent resonance of the antenna 106 over the ISM band of 2.4 to 2.5 GHz. The goodness of an antenna is measured by VSWR (Voltage Standing Wave Ratio) which is a measure of the ratio of the load impedance of the antenna to the source impedance. In the case of an open or shorted load there is total reflection and the VSWR is infinite. The ideal VSWR is therefore one. FIG. 11 shows the tuning effects of the matching stubs 34 and 36 on the VSWR. The graph of VSWR vs. frequency shows that the antenna 106 contributes a VSWR characteristic that has a minimum value centered about the center frequency of 2.450 GHz. The stub 34 contributes a VSWR characteristic that has a minimum value centered about the lower frequency of 2.425 GHz. The stub 36 contributes a VSWR characteristic that has a minimum value centered about the higher frequency of 2.475 GHz. The overall response for the combination of the antenna 106, the stub 34, and the stub 36 has a broad minimum value VSWR over the desired frequency range from 2.4 GHz to 2.5 GHz. This becomes important for utilizing the entire 100 MHz wide band for communications. The band is divided into 100 channels, each 1 MHz wide. The invention provides a VSWR which is fairly flat over the entire 100 MHz band, thereby enabling all 100 channels to be effective for communication.

The antenna 106 represents a radiation resistance of about 38 ohms and the Power Amplifier driving the feed point 107 has a drive source impedance of 50 ohms. For maximum power transfer to the antenna these impedances must be matched. The invention accomplishes this with the quarter wave transformer 32 in FIG. 9B. The input impedance of a quarter wave line terminated in a resistive impedance of Zr is given by the equation 1:

$$Zs=[(Zo)^{**}2]/Zr \qquad 1)$$

Rearranging into the equation 2:

$$Zo=[Zr * Zs]^{**}(½) \qquad 2)$$

shows that any value of load (antenna) can be transformed into any value of drive (Power Amplifier) if one constructs the characteristic impedance of the ¼ wave line to equal the square root of the product of the two impedances. This is the section of line 32 that connects the feed point of the connector 38 in FIG. 9A to the base 107 of the top hat antenna 106.

Figure 1B:
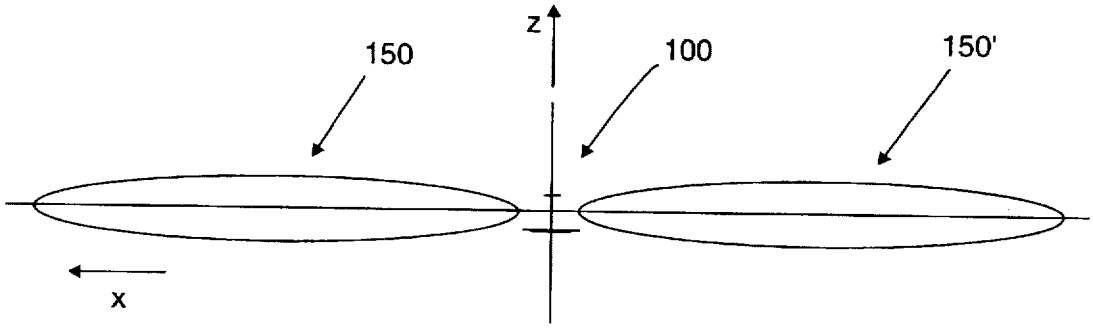
FIG. 1B is a side view of the radiation pattern of the antenna assembly 100 in free space.
Figure 1C:
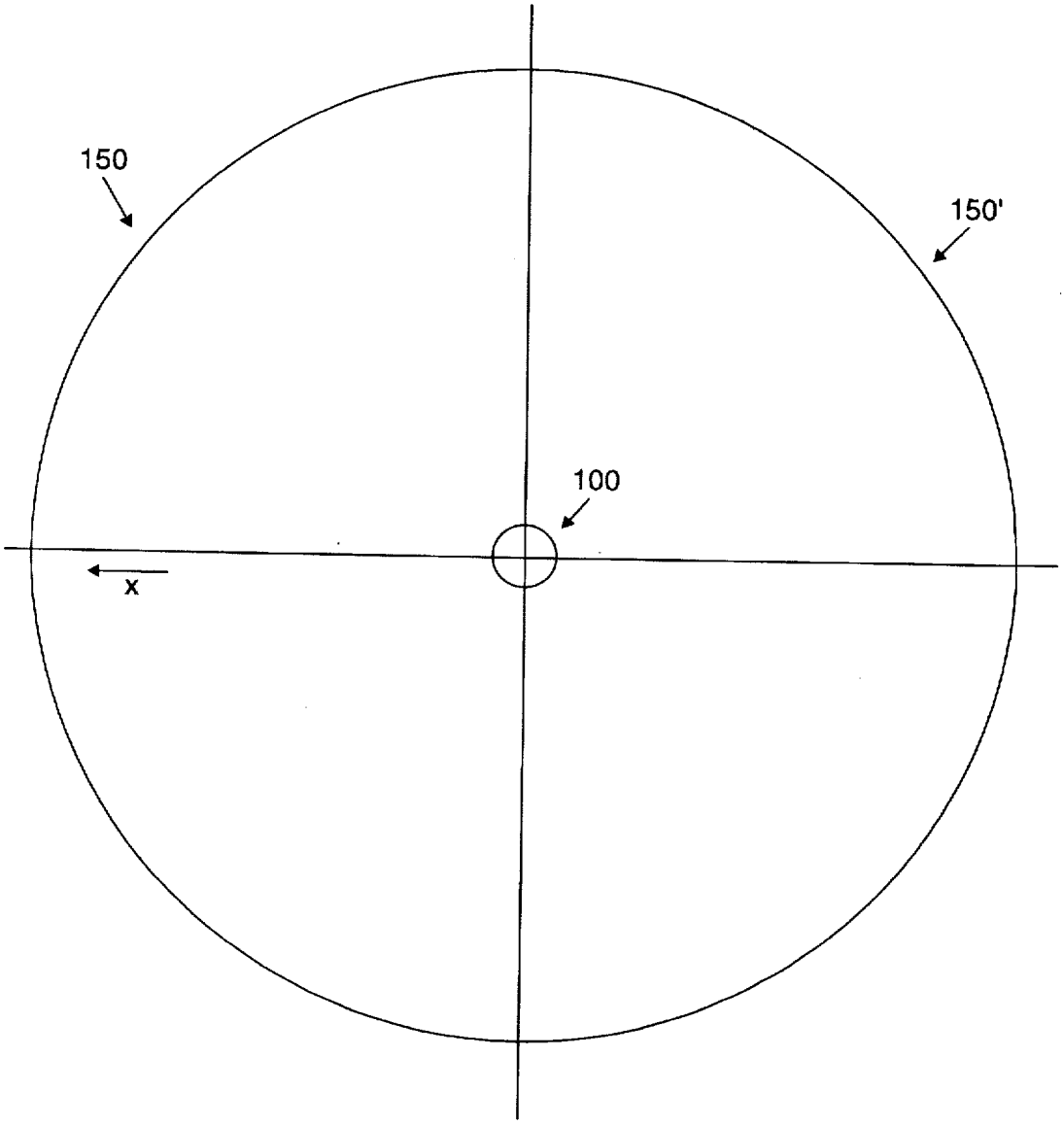
FIG. 1C is a top view of the radiation pattern shown in FIG. 1B.

FIG. 1B is a side view of the radiation pattern of the antenna assembly 100 in free space. FIG. 1C is a top view of the radiation pattern shown in FIG. 1B. In free space without any distortions imposed by objects, the radiation pattern 150 and 150' is omnidirectional in a plane parallel to the geometric plane 105. An isotropic radiator is a fictitious point radiator that radiates equally in all directions (spherical pattern). It is used as a standard of comparison. In the case of the vertical and the ½ dipole in free space the pattern is doughnut shaped as shown in FIG. 1C. Directivity is the property of radiating more strongly in some directions than in others. At the surface of an imaginary sphere around an isotropic radiator the field strength (power per unit area "power density") is the same everywhere. In the case of the top hat antenna 106 of FIG. 1A, the density is greatest in the horizontal plane. Directivity then is defined as the ratio of maximum power density to the average power density taken over the whole sphere as shown in equation 3:

$$D=(P\text{max})/(P\text{avg}) \qquad 3)$$

Gain is directivity multiplied by the antenna efficiency which takes into consideration losses, as shown in equation 4:

$$G=K * (P\text{max})/(P\text{avg}), \qquad 4)$$

where K is the efficiency.

Figure 1D:
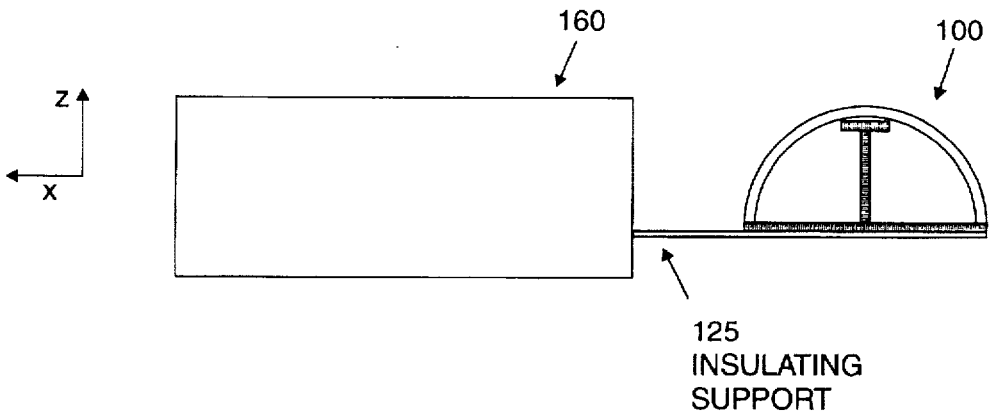
FIG. 1D is a side view of the antenna assembly 100 mounted by means of the insulating support structure 125 to the personal computer 160.
Figure 1E:
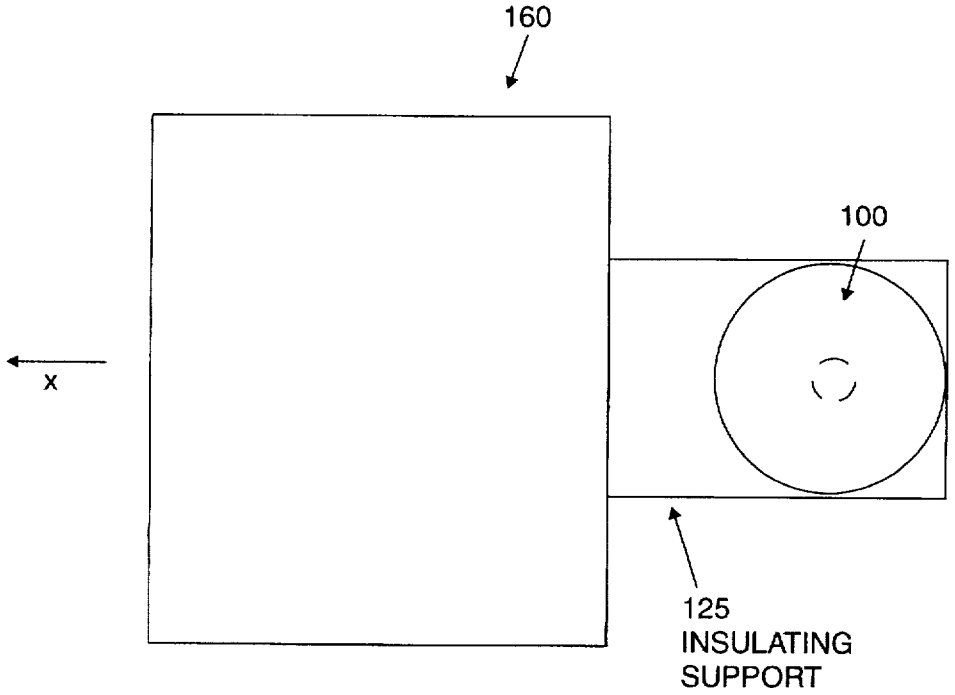
FIG. 1E is a top view of the antenna assembly 100 mounted by means of the insulating support structure 125 to the personal computer 160, of FIG. 1D.
Figure 1F:
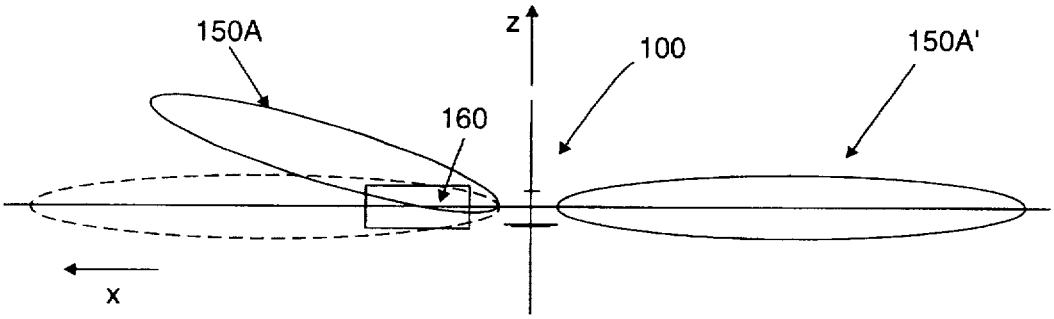
FIG. 1F is a side view of the radiation pattern of the antenna assembly 100 mounted by means of the insulating support structure 125 to the personal computer 160, as shown in FIG. 1D.
Figure 1G:
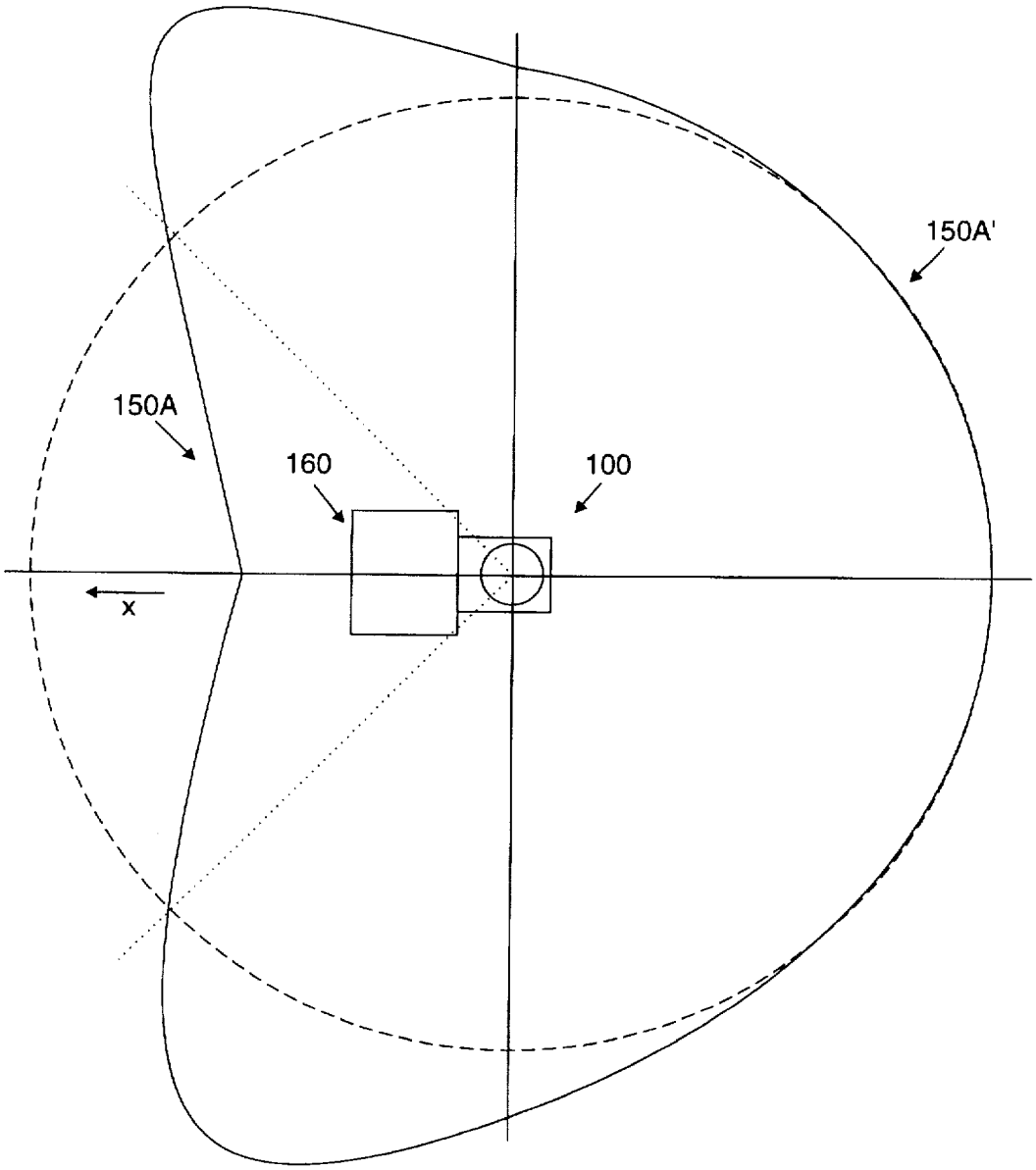
FIG. 1G is a top view of the radiation pattern shown in FIG. 1F.

FIG. 1D is a side view of the antenna assembly 100 mounted by means of the insulating support structure 125 to the personal computer 160. FIG. 1E is a top view of the antenna assembly 100 mounted by means of the insulating support structure 125 to the personal computer 160, of FIG. 1D. The presence of the personal computer 160 imposes a parasitic capacitance which is in close proximity to the antenna 106. This distorts the radiation field 150 in the x direction from the antenna 106 toward the personal computer 160, and in the z direction perpendicular to the geometric plane 105, to become the distorted radiation field 150 A shown in FIGS. 1F and 1G. FIG. 1F is a side view of the radiation pattern 150A and 150A' of the antenna assembly 100 mounted by means of the insulating support structure 125 to the personal computer 160, as shown in FIG. 1D. FIG. 1G is a top view of the radiation pattern shown in FIG. 1F. It is seen that the close proximity of the personal computer 160 to the antenna assembly 100 destroys the omnidirectional quality of the antenna in a plane parallel to the horizontal, geometric plane 105. The radiation pattern is influenced by the ground plane and in the case of the proximity of the personal computer 160, the ground plane is not ideally horizontal. The shape of the personal computer 160 tends to tilt the toroidal pattern 150 in FIGS. 1B and 1C, more towards the vertical z direction shown in FIGS. 1F and 1G on the side of the antenna closest to the personal computer. The personal computer 160 also tends to take on the characteristics of a dielectric with a high dielectric loss characteristic rather than a good conductor.

Figure 1H:
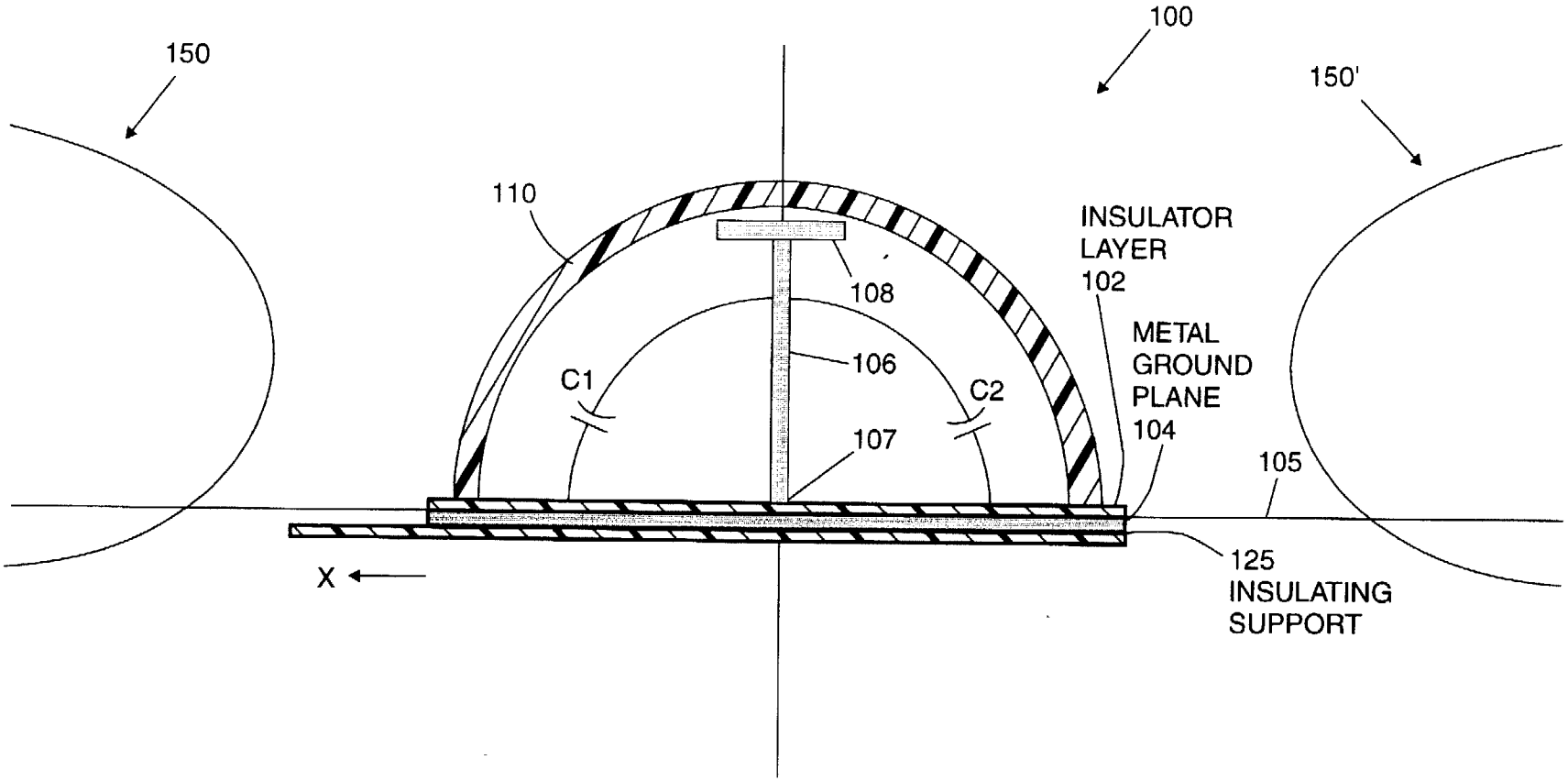
FIG. 1H shows the capacitance C1 and C2 of the antenna 106 with respect to the ground plane 104, for the antenna assembly 100.

FIG. 1H shows the capacitance C1 and C2 of the antenna 106 with respect to the ground plane 104, for the antenna assembly 100. In the symmetric configuration of FIG. 1A, the capacitance C1 of the antenna 106 with respect to the ground plane 104 on the side of the antenna 106 toward the x direction is the same and the capacitance C2 of the antenna 106 with respect to the ground plane 104 on the side of the antenna 106 away from the x direction. This results in the desired omnidirectional toroidal pattern of the radiation in FIGS. 1B and 1C. However, in the case of the close proximity of the personal computer 160 in the x direction of FIGS. 1D and 1E, the capacitance C1 of the antenna 106 with respect to the combination of the ground plane 104 and the personal computer 160 on the side of the antenna 106 toward the x direction is the different from the capacitance C2 of the antenna 106 with respect to the ground plane 104 on the side of the antenna 106 away from the x direction. The location of the capacitance represented by the personal computer 160 is raised in the z direction above the geometric plane 105; distorting the radiation field 150A to tilt upwards, as shown in FIG. 1F. And the increase in effective dielectric losses presented by the proximity of the personal computer in the x direction with respect to that presented by free space, reduces the magnitude of the radiation field 150A in the x direction, as shown in FIG. 1G. This destroys the desired omnidirectional toroidal pattern of the radiation shown in FIGS. 1B and 1C.

In accordance with the invention, the antenna assembly 145 is given several asymmetric radiation features in the combination of the antenna 106, its surrounding radome 112, and its ground plane, to provide a high gain, omnidirectional radiation pattern that overcomes the parasitic distortions imposed by the close proximity of the personal computer housing.

Figure 2A:
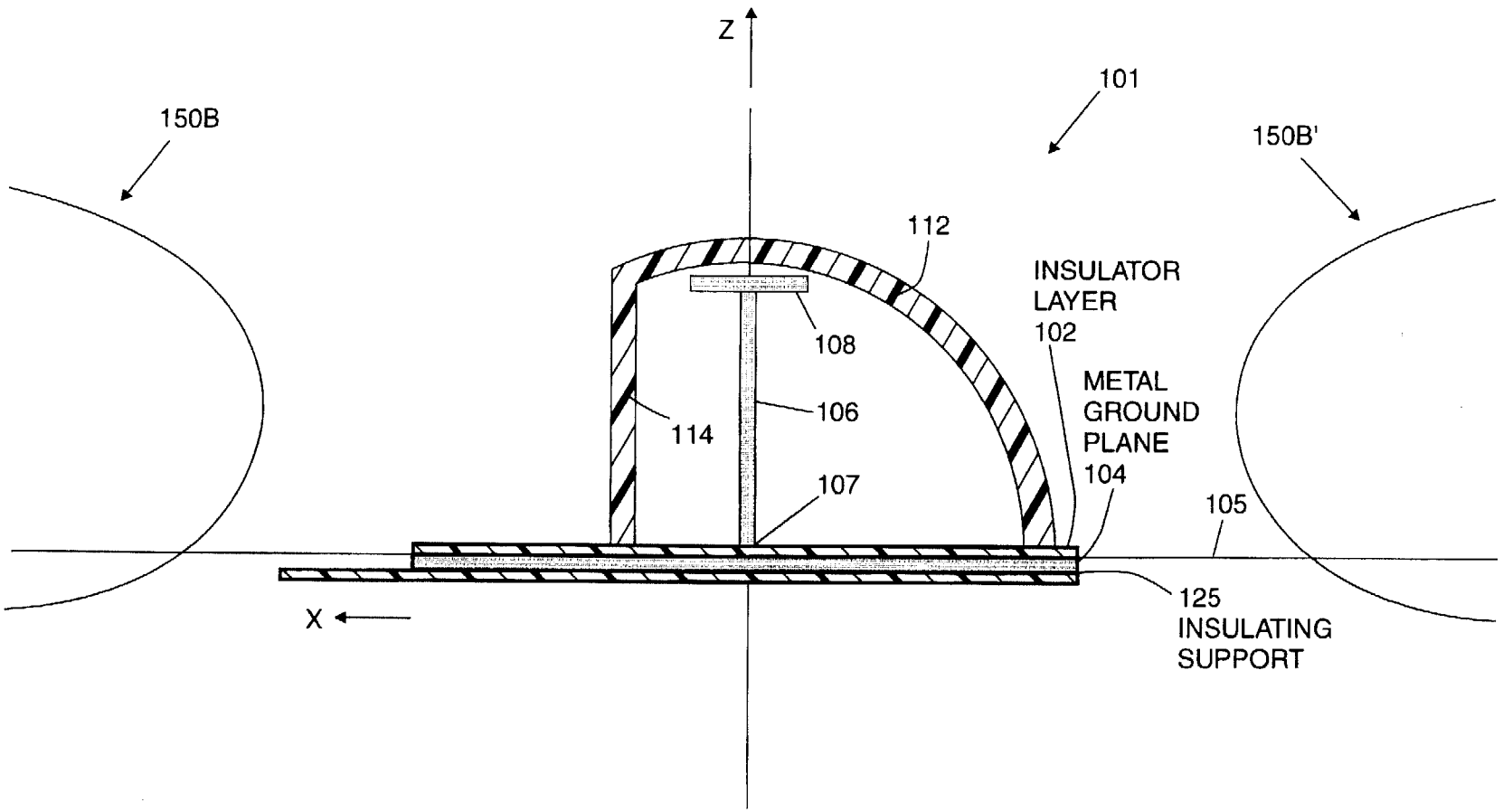
FIG. 2A is a side view of the antenna assembly 101, including the asymmetric radome 112 and top hat antenna 106 with an insulating support structure 125.
Figure 2B:
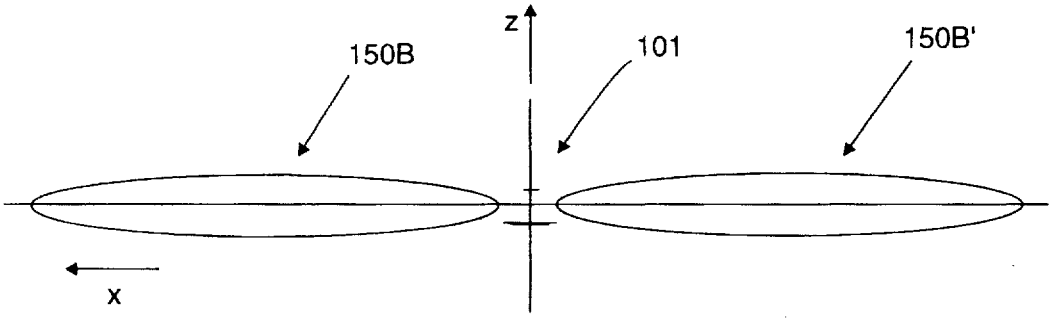
FIG. 2B is a side view of the radiation pattern of the antenna assembly 101 in free space.
Figure 2C:
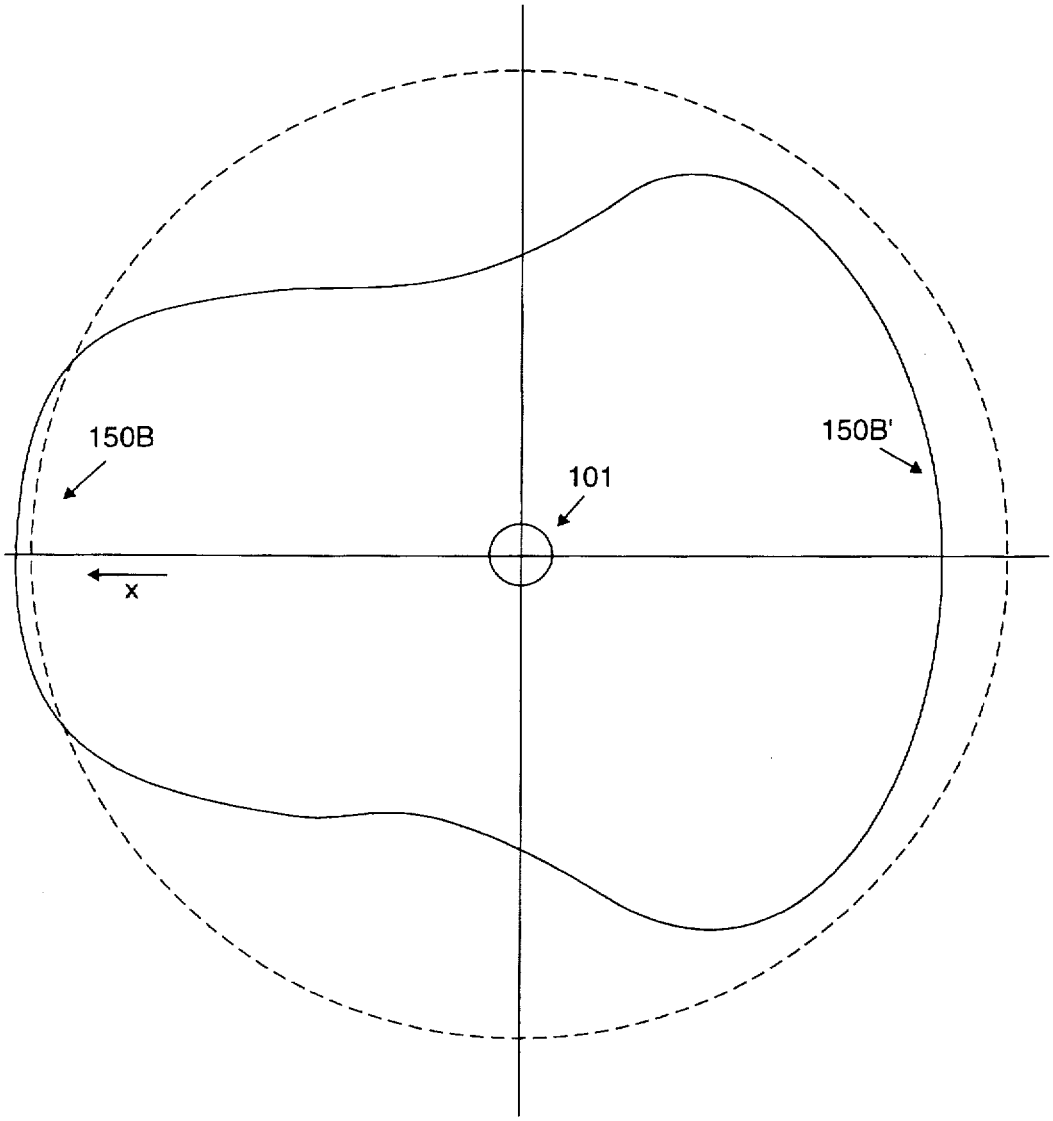
FIG. 2C is a top view of the radiation pattern shown in FIG. 2B.
Figure 2D:
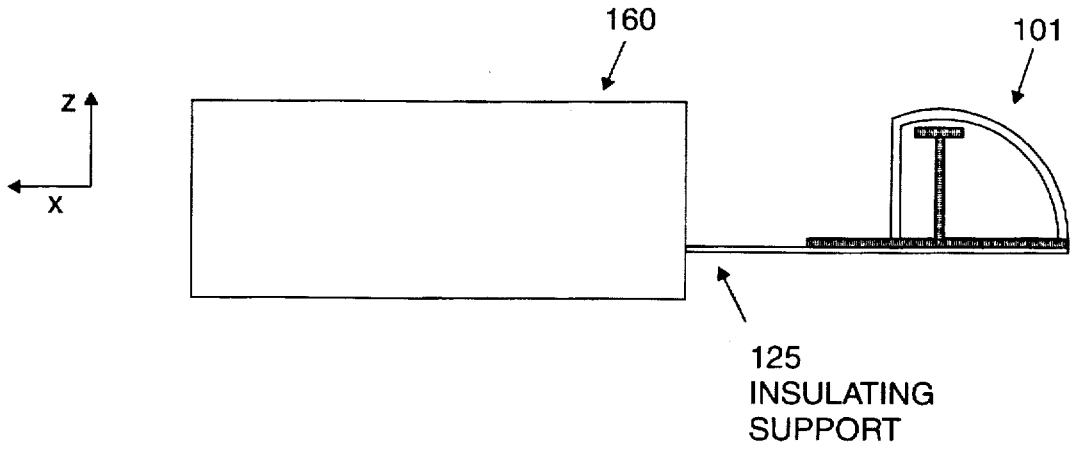
FIG. 2D is a side view of the antenna assembly 101 mounted by means of the insulating support structure 125 to the personal computer 160.
Figure 2E:
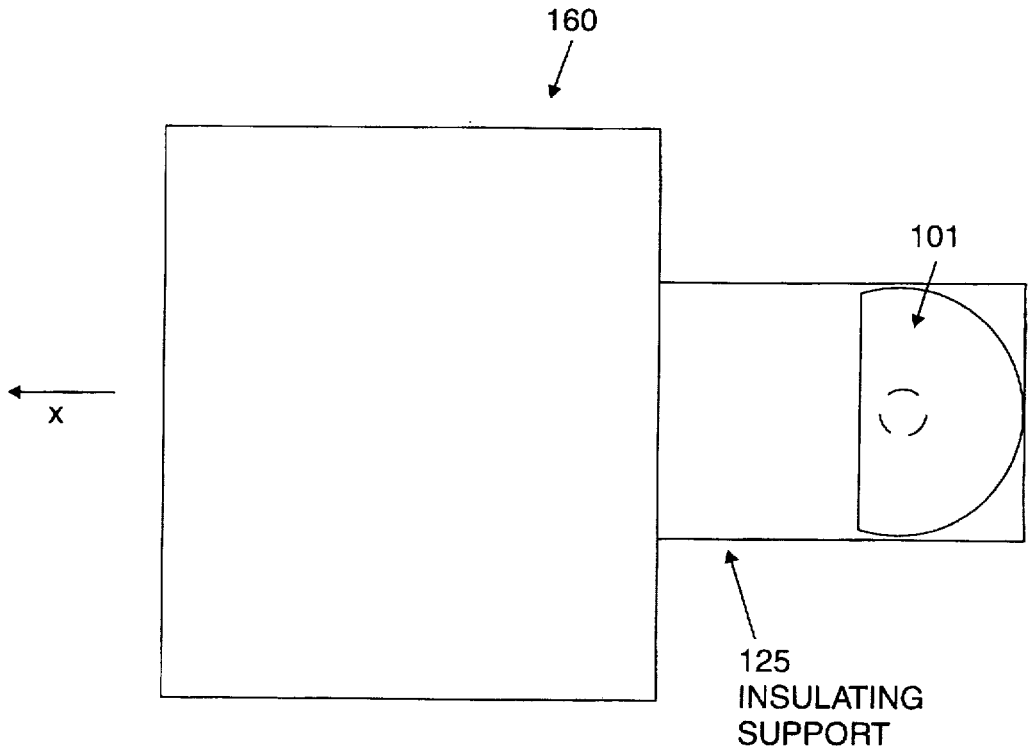
FIG. 2E is a top view of the antenna assembly 101 mounted by means of the insulating support structure 125 to the personal computer 160, of FIG. 2D.
Figure 2F:
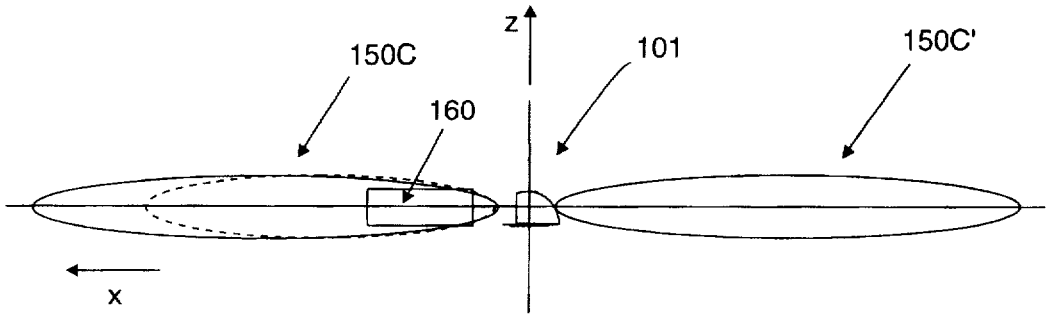
FIG. 2F is a side view of the radiation pattern of the antenna assembly 101 mounted by means of the insulating support structure 125 to the personal computer 160, as shown in FIG. 2D.
Figure 2G:
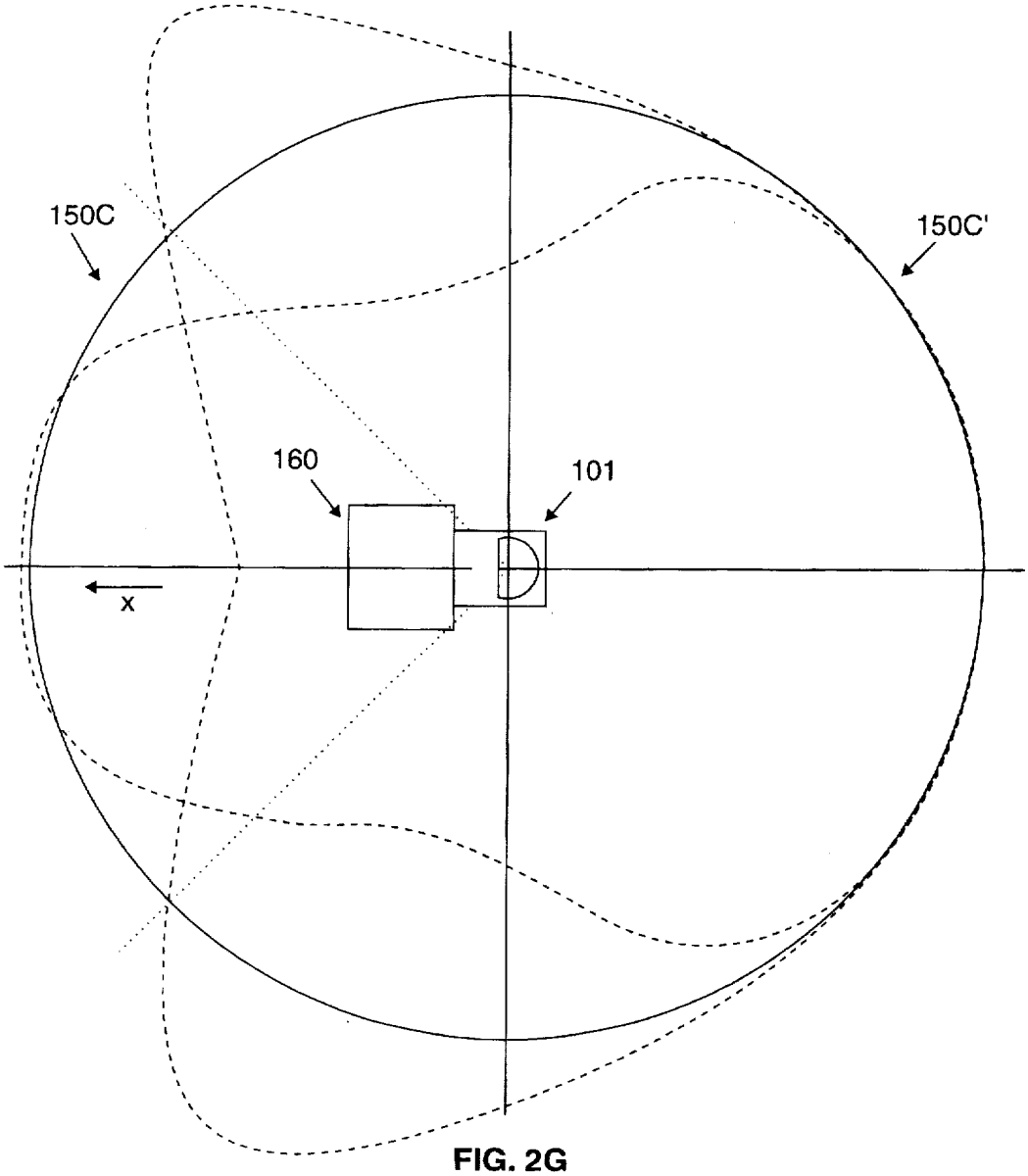
FIG. 2G is a top view of the radiation pattern shown in FIG. 2F.
Figure 2H:
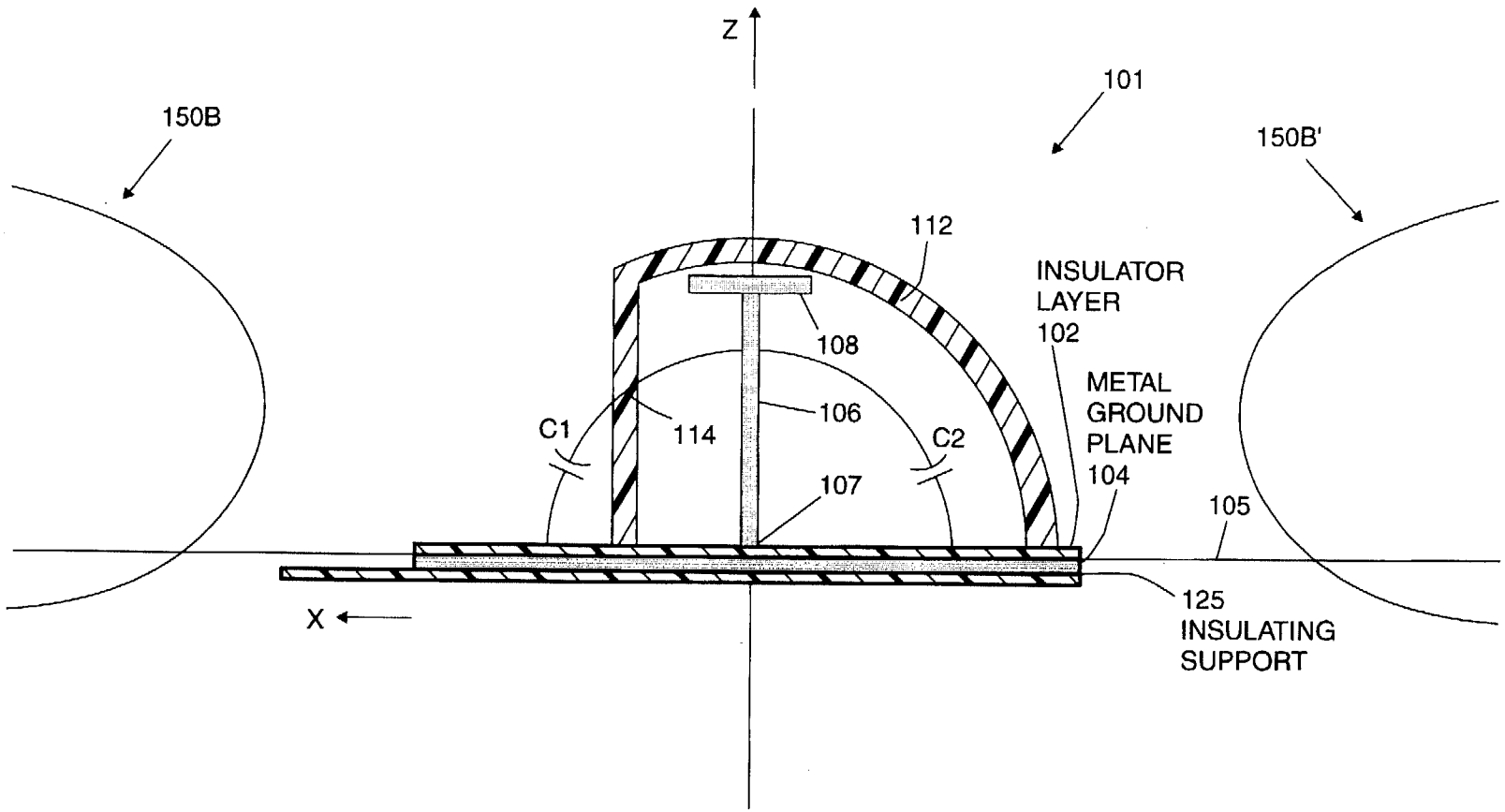
FIG. 2H shows the capacitance C1 and C2 of the antenna 106 with respect to the ground plane 104, for the antenna assembly 101.

The effect of giving an asymmetry to the radome 112 can be seen in the series of FIGS. 2A to 2H. FIG. 2A is a side view of the antenna assembly 101, including the asymmetric radome 112 and top hat antenna 106 with an insulating support structure 125. The radome 112 is mounted on the insulator layer 102 over the metal ground plane 104 of the antenna card 30. In the preferred embodiment, the antenna card 30 is fastened to the top cover 130 of the adapter card 20 in a manner that will be described below. For the purpose of explaining the effect of the asymmetric radome 112 on the radiation pattern 150B, the metal ground plane 104 is shown in FIG. 2A as being supported on the insulating support 125. The radome 112 surrounds the antenna 106 and has an enhanced directivity in the x direction oriented toward the personal computer 160 to compensate for the disturbance to the radiated field. The radome 112 is a substantially hemispherical shell having an open side on the bottom mounted on the insulator layer 102 of the adapter card housing, surrounding the antenna, with an edge forming a plane substantially parallel to the geometric plane 105. In accordance with the invention, one face 114 of the shell 112 proximate to the personal computer 160 has a substantially planar surface substantially perpendicular to the geometric plane 105. The asymmetric shape of the radome 112 is believed to increase the capacitance between the antenna 106 and the metal ground plane 104 on the side of the antenna 106 toward the personal computer 160, increasing the intensity of the radiation 150B from the antenna 106 in the x direction, thereby compensating for the distorting effects of the nearby computer. FIG. 2B is a side view of the radiation pattern of the antenna assembly 101 in free space. FIG. 2C is a top view of the radiation pattern shown in FIG. 2B. FIG. 2D is a side view of the antenna assembly 101 mounted by means of the insulating support structure 125 to the personal computer 160. FIG. 2E is a top view of the antenna assembly 101 mounted by means of the insulating support structure 125 to the personal computer 160, of FIG. 2D. FIG. 2F is a side view of the radiation pattern of the antenna assembly 101 mounted by means of the insulating support structure 125 to the personal computer 160, as shown in FIG. 2D. FIG. 2G is a top view of the radiation pattern shown in FIG. 2F. FIG. 2H shows the capacitance C1 and C2 of the antenna 106 with respect to the ground plane 104, for the antenna assembly 101. In the asymmetric configuration of FIG. 2A, the capacitance C1 of the antenna 106 with respect to the ground plane 104 on the side of the antenna 106 toward the x direction is the greater than the capacitance C2 of the antenna 106 with respect to the ground plane 104 on the side of the antenna 106 away from the x direction. This is due to the close proximity of the planar portion 114 of the radome 101 to the antenna 106 on the side in the x direction. The concentration of lines of electric force increases as the distance to the antenna 106 decreases. The higher concentration of lines of electric force passing through the relatively high dielectric constant medium of the planar portion 114 increases the value of the capacitance C1 with respect to the value C2 in FIG. 2H. This results in strengthening the radiation pattern 150B in the x direction of FIG. 2B and 2C. The location of the capacitance C1 in FIG. 2H is lower in the z direction, closer to the geometric plane 105 than is the effective capacitance presented by the personal computer 160. This brings the radiation pattern 150C down in the z direction in FIG. 2F, closer to the geometric plane 105. This corrects the distorted radiation pattern 150A of FIGS. 1F and 1G to become closer to the desired omnidirectional toroidal pattern 150C of FIGS. 2F and 2G.

In the preferred embodiment shown in FIG. 5A, the radome 112 includes a cylindrical surface 115 projecting from the face 114 of the shell of the radome 112 proximate to the personal computer 160. The projecting surface 115 has a cylindrical axis substantially perpendicular to the geometric plane 105.

Figure 3A:
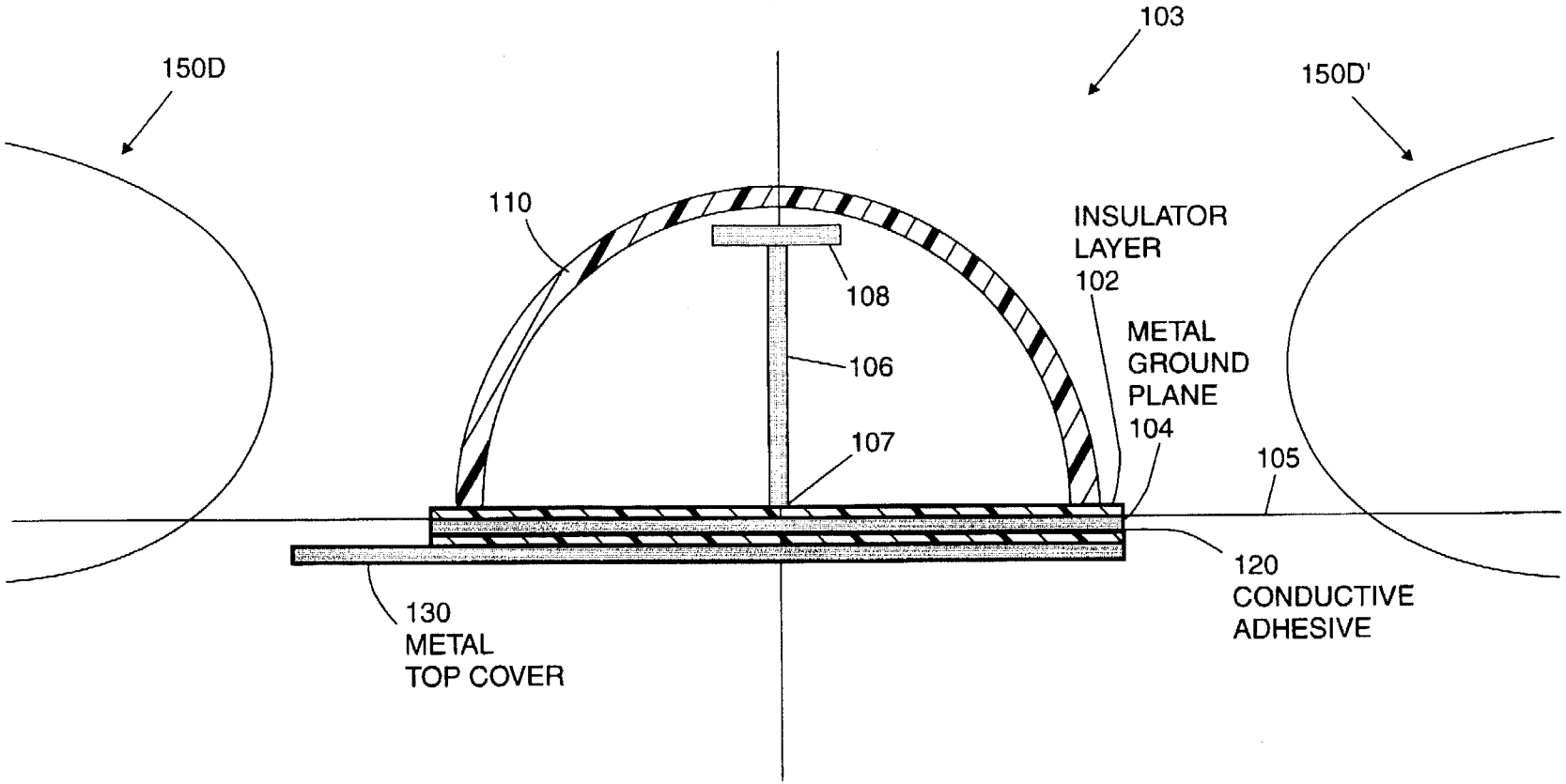
FIG. 3A is a side view of the antenna assembly 103, including the hemispherical radome 110 and top hat antenna 106 with an asymmetric, reflecting ground plane and metal support structure 130.
Figure 3B:
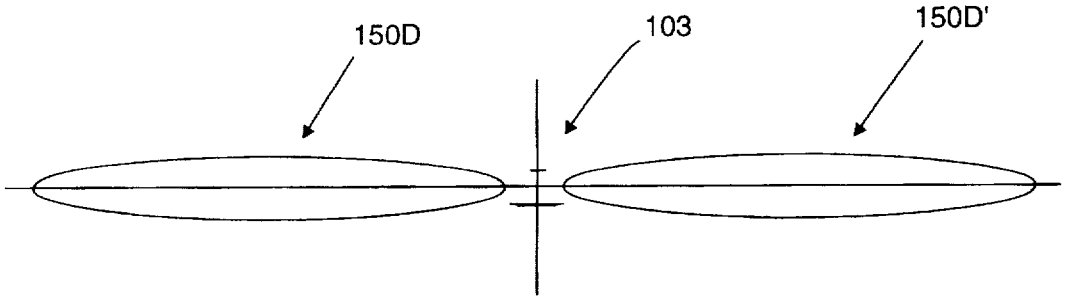
FIG. 3B is a side view of the radiation pattern of the antenna assembly 103 in free space.
Figure 3C:
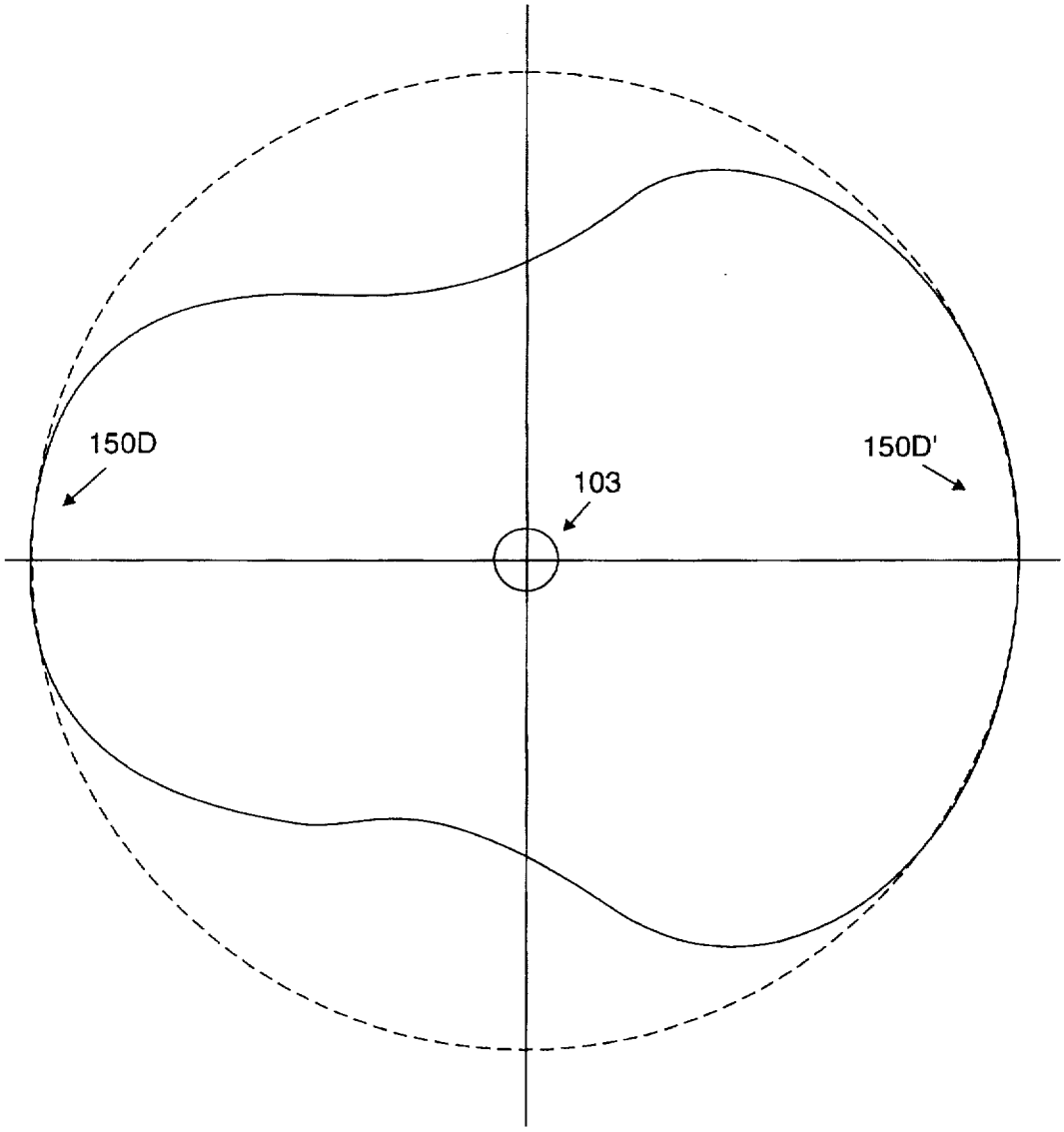
FIG. 3C is a top view of the radiation pattern shown in FIG. 3B.
Figure 3D:
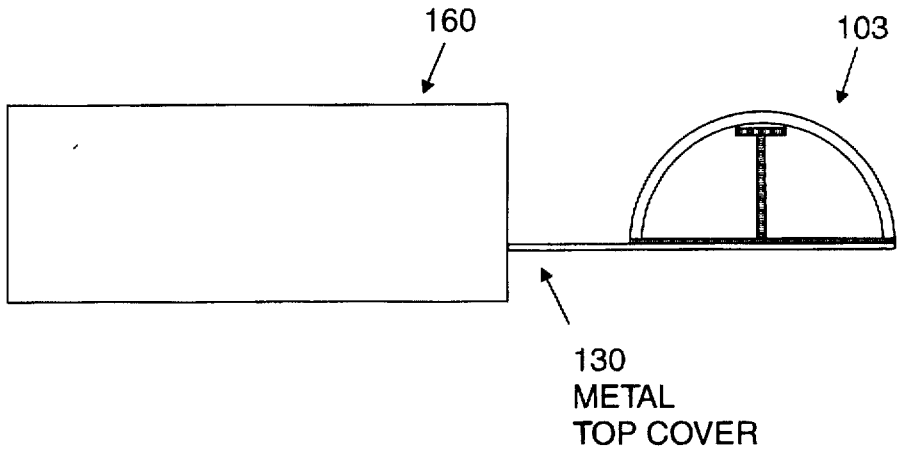
FIG. 3D is a side view of the antenna assembly 103 mounted by means of the asymmetric, reflecting ground plane and metal support structure 130 to the personal computer 160.
Figure 3E:
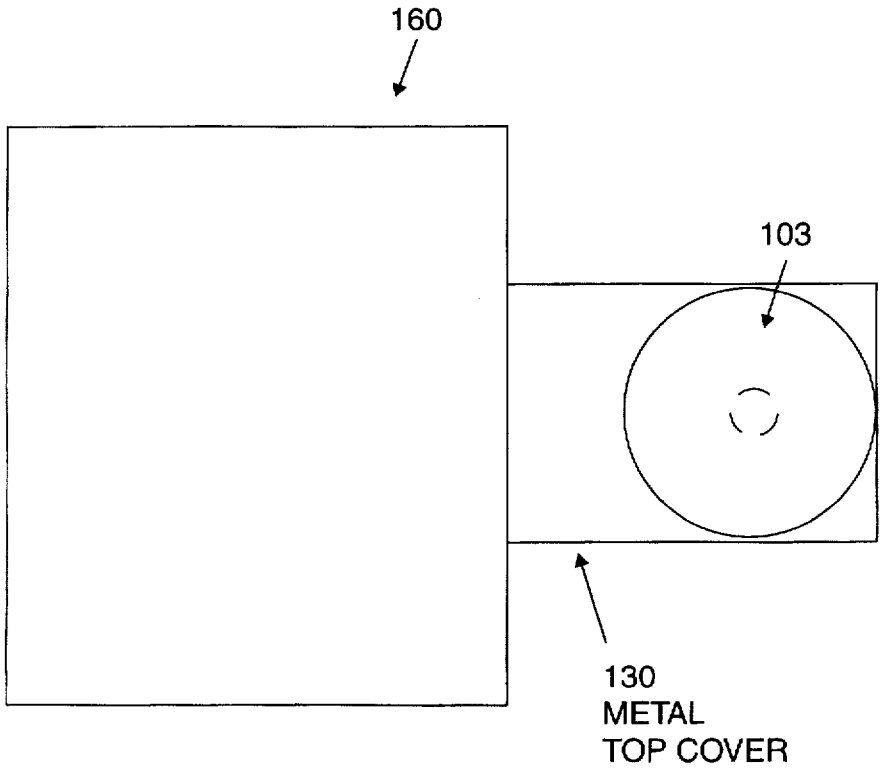
FIG. 3E is a top view of the antenna assembly 103 mounted by means of the asymmetric, reflecting ground plane and metal support structure 130 to the personal computer 160, of FIG. 3D.
Figure 3F:
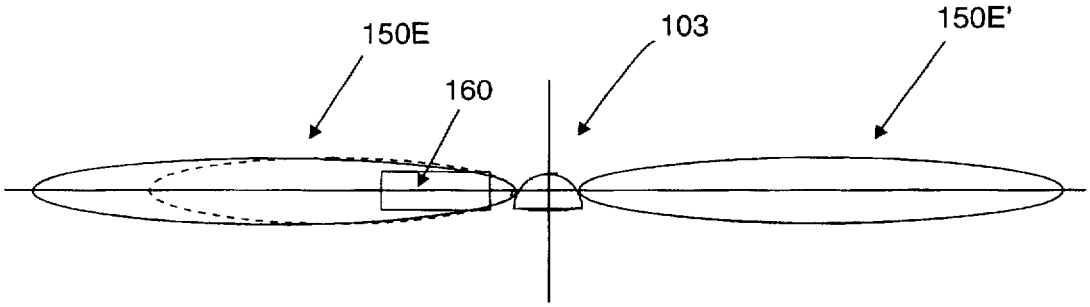
FIG. 3F is a side view of the radiation pattern of the antenna assembly 103 mounted by means of the asymmetric, reflecting ground plane and metal support structure 130 to the personal computer 160, as shown in FIG. 3D.
Figure 3G:
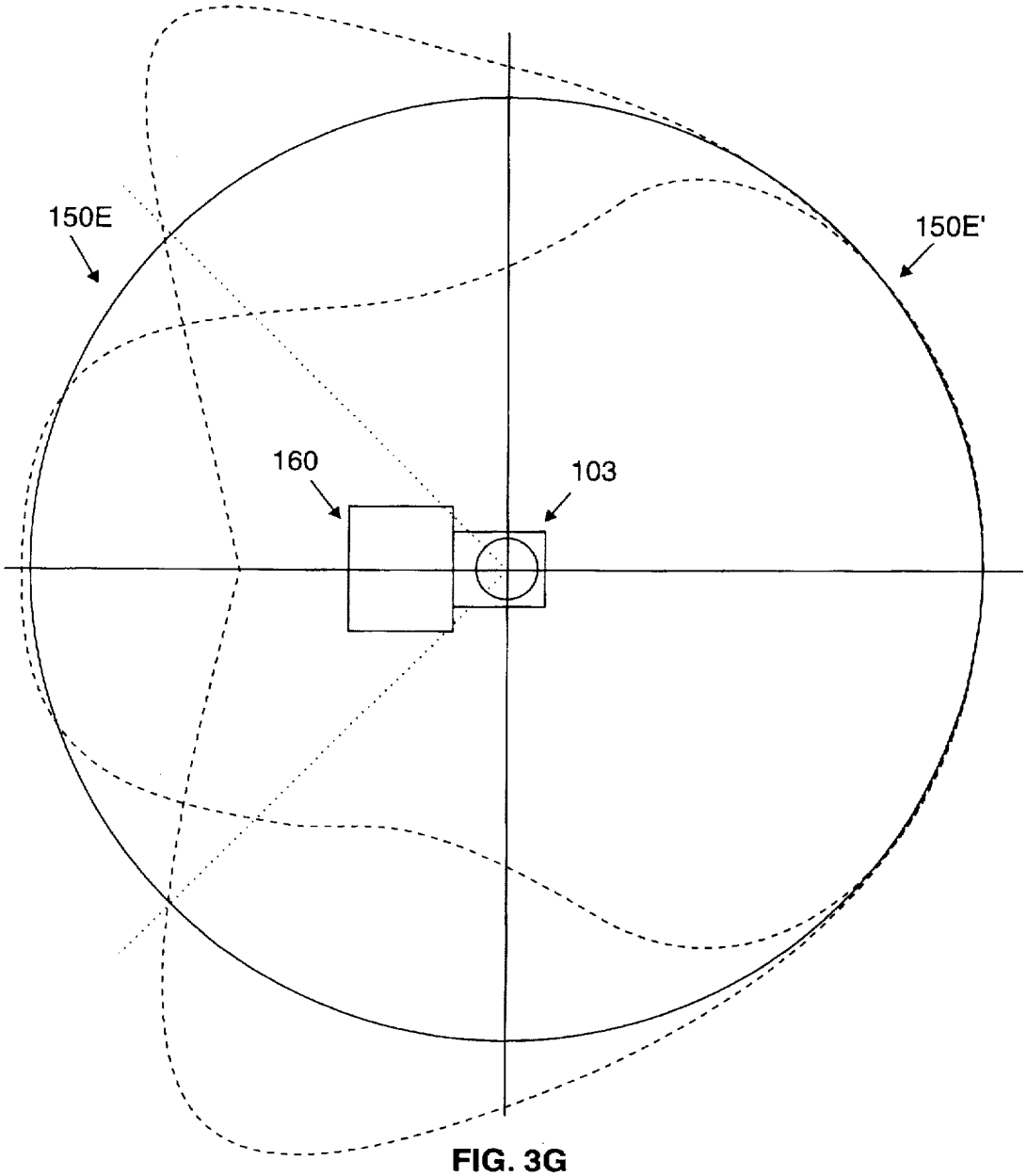
FIG. 3G is a top view of the radiation pattern shown in FIG. 3F.
Figure 3H:
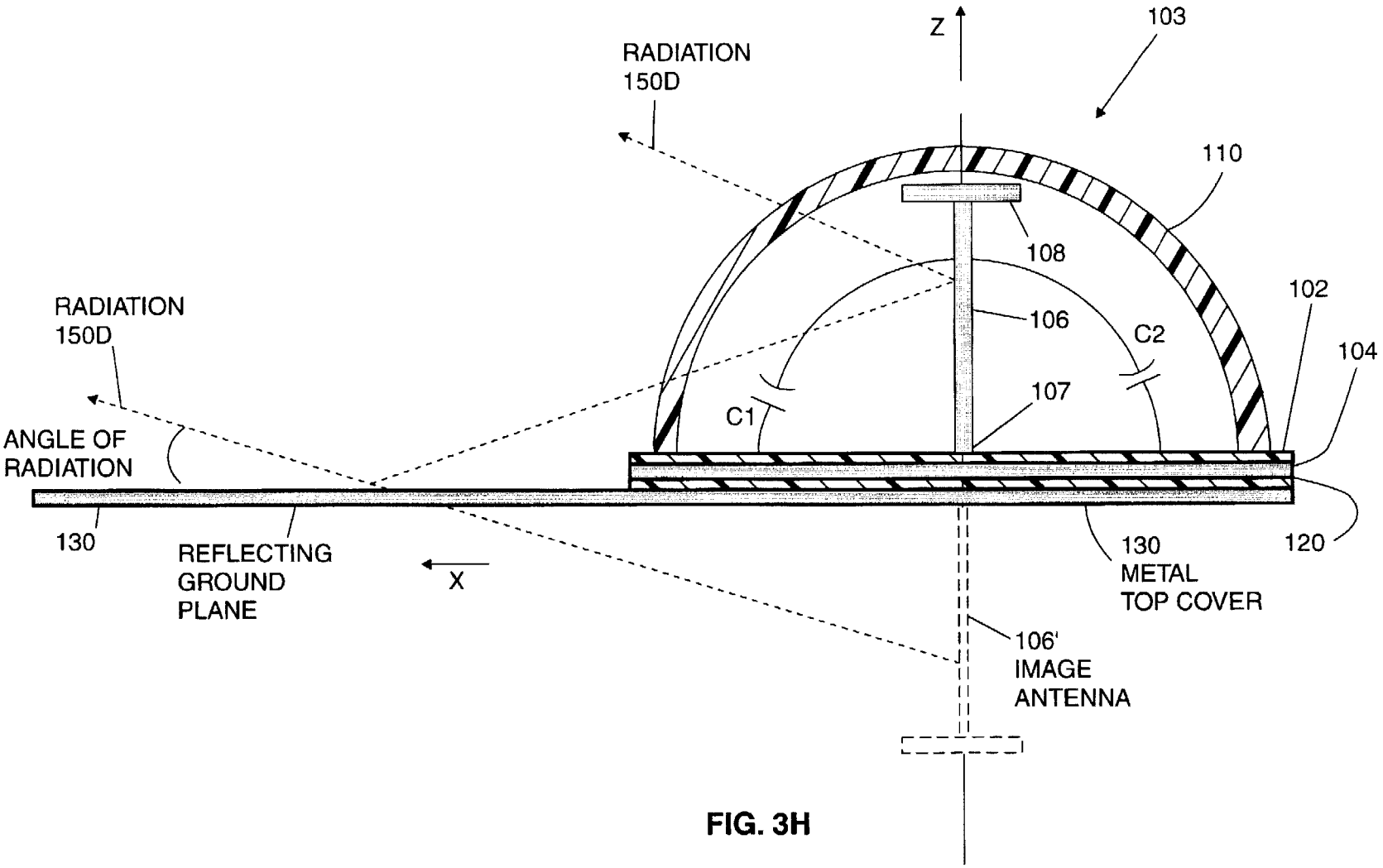
FIG. 3H is a side view of the antenna assembly 103, showing the image antenna 106' reflected in asymmetric, reflecting ground plane and metal support structure 130.

The effect of giving an asymmetry to the ground plane beneath the antenna can be seen in the series of FIGS. 3A to 3H. FIG. 3A is a side view of the antenna assembly 103, including the hemispherical radome 110 and top hat antenna 106 with an asymmetric, reflecting ground plane and metal support structure 130. In accordance with the invention, the directivity of the antenna 106 is enhanced by forming an asymmetric, reflecting ground plane 130 for the antenna 106 in the x direction toward the personal computer 160. This is accomplished by bonding the substrate ground plane layer 104 to the conductive cover 130 of the adapter card 20 with a layer of conductive adhesive 120. The conductive cover 130 of the adapter card 20 forms the supporting surface 132 for the antenna's substrate ground plane 104 and extends from a position proximate to the antenna 106 to a position proximate to the personal computer 160. This forms the asymmetric, reflecting ground plane 130 for the antenna 106 in the x direction toward the personal computer 160. The conductive adhesive coating 120 on the conductive layer 104 of the substrate ground plane of the antenna 106, mechanically and electrically connects the substrate ground plane 104 to the supporting surface 132 of the conductive cover 130. The resulting asymmetric, reflecting ground plane 130 helps to compensate for the disturbance to the radiated field 150D imposed by the close proximity of the vertical surfaces of the personal computer 160. FIG. 3B is a side view of the radiation pattern 150D of the antenna assembly 103 in free space. FIG. 3C is a top view of the radiation pattern shown in FIG. 3B. FIG. 3D is a side view of the antenna assembly 103 mounted by means of the asymmetric, reflecting ground plane and metal support structure 130 to the personal computer 160. FIG. 3E is a top view of the antenna assembly 103 mounted by means of the asymmetric, reflecting ground plane and metal support structure 130 to the personal computer 160, of FIG. 3D. FIG. 3F is a side view of the compensated radiation pattern 150E of the antenna assembly 103 mounted by means of the asymmetric, reflecting ground plane and metal support structure 130 to the personal computer 160, as shown in FIG. 3D. FIG. 3G is a top view of the radiation pattern shown in FIG. 3F. FIG. 3H is a side view of the antenna assembly 103, showing the image antenna 106' reflected in asymmetric, reflecting ground plane and metal support structure 130. The reflecting ground plane adds reflected radiation to the intensity of the radiation 150D transmitted directly from the antenna 106. Ideally, the top hat antenna of FIG. 1A would have the same radiation pattern as a full ¼ wavelength antenna, due to the symmetric ground plane 104. However, since the ground plane presented by the metal top cover 130 in FIG. 3A is not symmetrical, the capacitance C1 is greater than the capacitance C2, the currents in the two portions of the disk 108, toward and away from the x direction, are unequal and the antenna appears to be "bent" towards the direction x. In the asymmetric configuration of FIG. 3H, the capacitance C1 of the antenna 106 with respect to the ground plane 104 and 130 on the side of the antenna 106 toward the x direction is the greater than the capacitance C2 of the antenna 106 with respect to the ground plane 104 on the side of the antenna 106 away from the x direction. This is due to the larger area presented by the metal top cover 130 in the x direction. This results in strengthening the radiation pattern 150D in the x direction of FIGS. 3B and 3C. The location of the capacitance C1 in FIG. 3H is lower in the z direction, closer to the geometric plane 105 than is the effective capacitance presented by the personal computer 160. This brings the radiation pattern 150E down in the z direction in FIG. 3F, closer to the geometric plane 105. This corrects the distorted radiation pattern 150A of FIGS. 1F and 1G to become closer to the desired omnidirectional toroidal pattern 150E of FIGS. 3F and 3G.

Figure 4A:
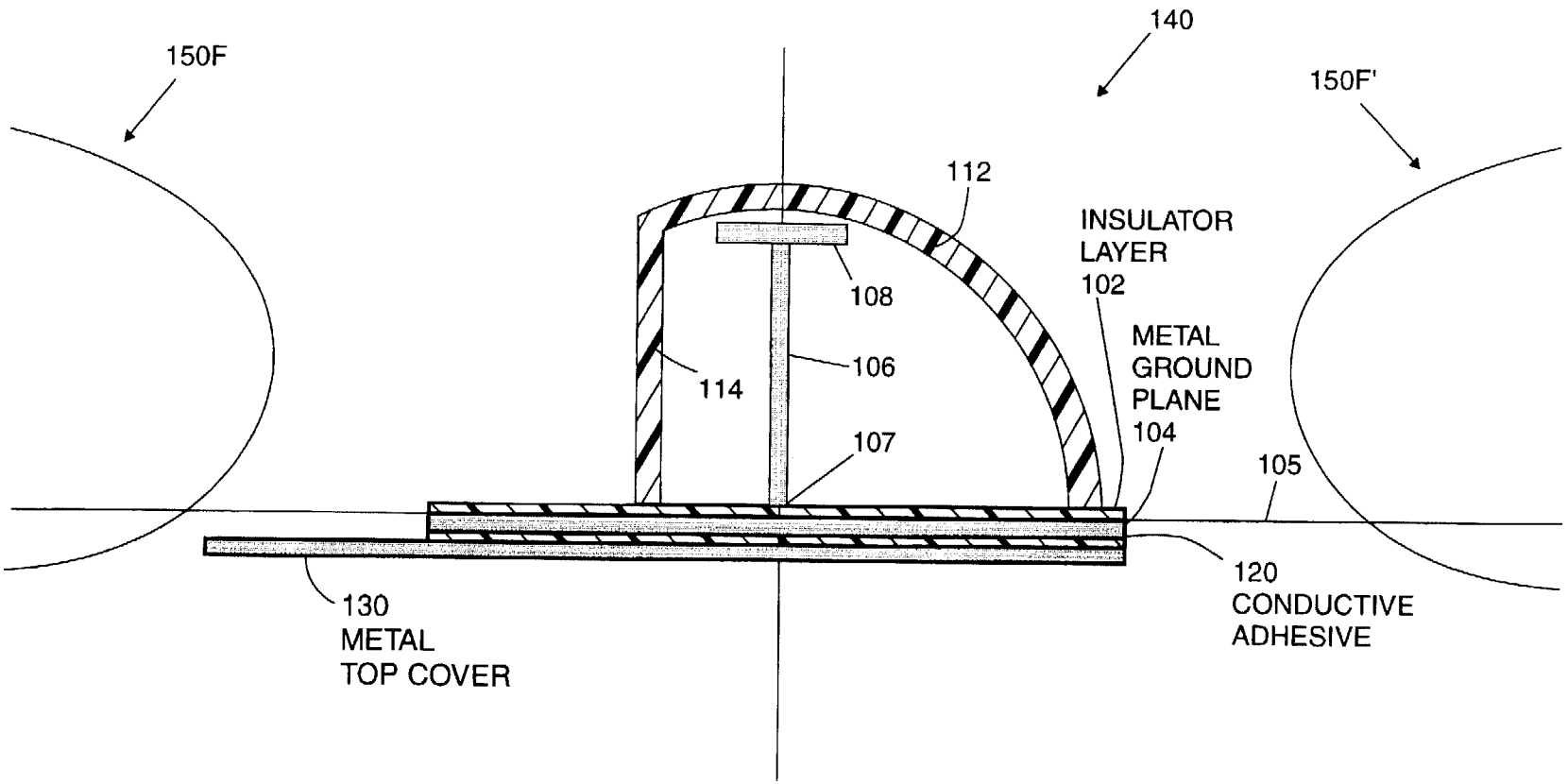
FIG. 4A is a side view of the antenna assembly 140, including the asymmetric radome 112 and top hat antenna 106 with an asymmetric, reflecting ground plane and metal support structure 130.

In accordance with the preferred embodiment of the invention, the effect of the combination of giving an asymmetry to both the radome 112 and to the ground plane 130 beneath the antenna 106 can be seen in the series of FIGS. 4A to 4H. FIG. 4A is a side view of the antenna assembly 140, including the asymmetric radome 112 and top hat antenna 106 with an asymmetric, reflecting ground plane and metal support structure 130.

In the preferred embodiment, the radome 112 is made of an injection molded, unfilled polycarbonate plastic, such as General Electric's Lexan (R) 943. The material has a dielectric constant of approximately 2.9 in the 2.5 GHz range. The outside radius of the hemisphere 112 is 15 mm, the inside radius of the hemisphere 112 is 13.5 mm, and the wall thickness is 1.5 mm. The wall thickness of the planar portion 114 is also 1.5 mm. The wall thickness of portion 114 in FIG. 4A can be increased to increase the capacitance contribution C1 of the radome which will further increase the radiation pattern 150F in the x direction of FIG. 4C. The external surface of the planar portion 114 of the radome 112 is 7.8 mm from the center of the hemisphere. The bottom edge of the full hemisphere 110 of FIG. 3A is separated from the proximate side of the personal computer 160 by 19 mm in the x direction. The external surface of the planar portion 114 of the asymmetric radome 112 of FIG. 4A is separated from the proximate side of the personal computer 160 by 24 mm in the x direction. The insulator layer 102 is a radiofrequency insulating composite suitable for use as printed circuit boards in radiofrequency applications, such as Getek (R) RF laminate made by General Electric. The insulator layer 102 has a thickness of 0.2 mm. The metal ground plane 104 is a copper foil of 0.35 mm thickness. The conductive adhesive 120 is a conductive particle filled, acrylic, pressure sensitive adhesive. The copper foil and conductive adhesive are supplied together as an EMI (electromagnetic interference) shielding material, such as Cho-Foil (R) made by Chomerics. The adhesive layer 120 has a thickness of 0.038 mm. The metal top cover 130 is made from a sheet of annealed stainless steel having good electrical conductivity. The antenna 106 has a mast height from the base point 107 to the underside of the top hat portion 108 of 10 mm. The top hat portion 108 has a diameter of 15 mm.

Figure 4B:
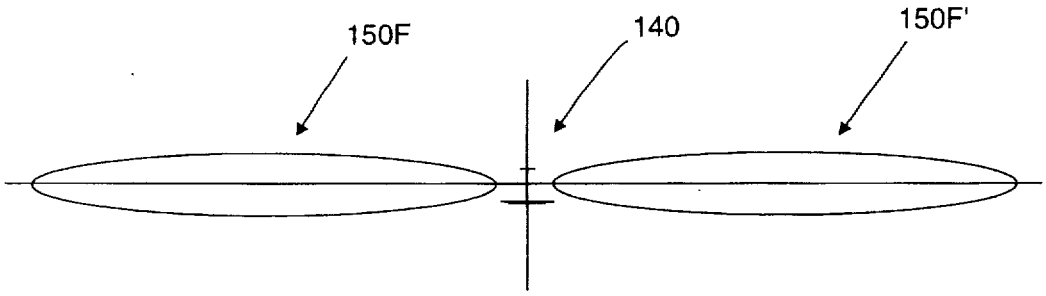
FIG. 4B is a side view of the radiation pattern of the antenna assembly 140 in free space.
Figure 4C:
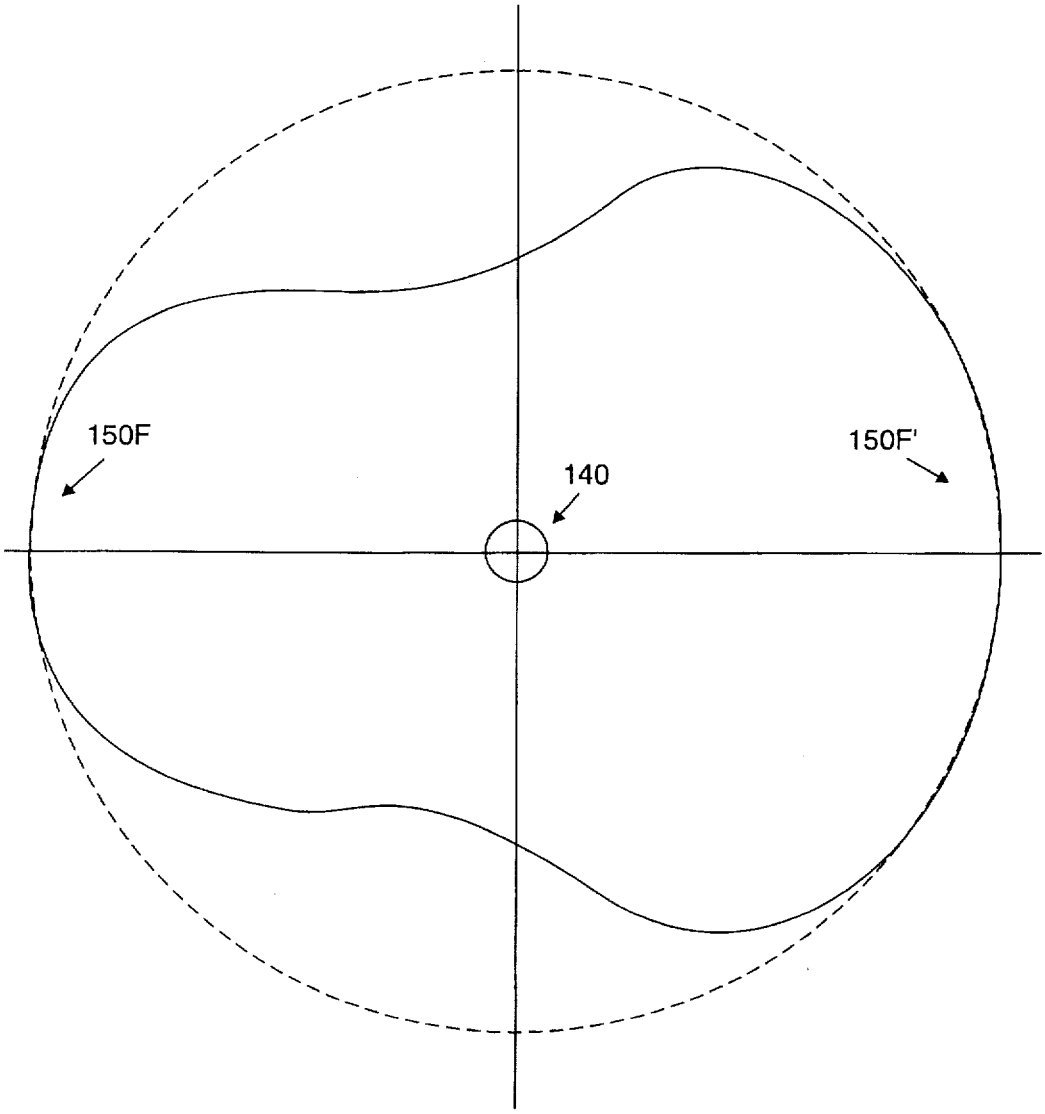
FIG. 4C is a top view of the radiation pattern shown in FIG. 4B.
Figure 4D:
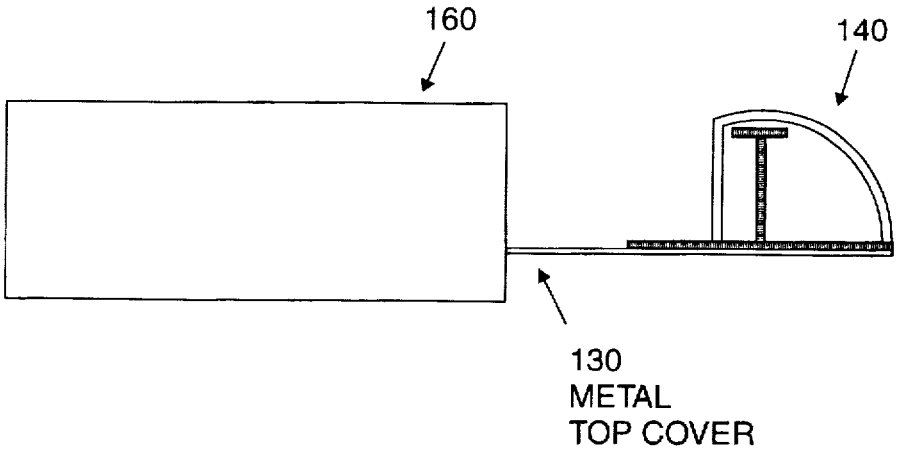
FIG. 4D is a side view of the antenna assembly 140 mounted by means of the asymmetric, reflecting ground plane and metal support structure 130 to the personal computer 160.
Figure 4E:
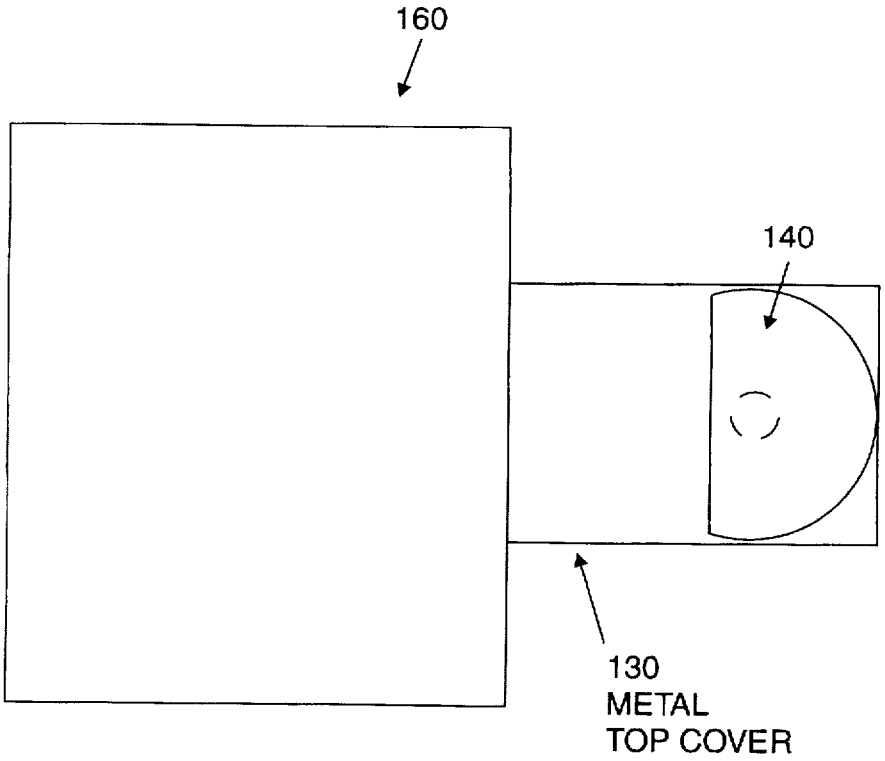
FIG. 4E is a top view of the antenna assembly 140 mounted by means of the asymmetric, reflecting ground plane and metal support structure 130 to the personal computer 160, of FIG. 4D.
Figure 4F:
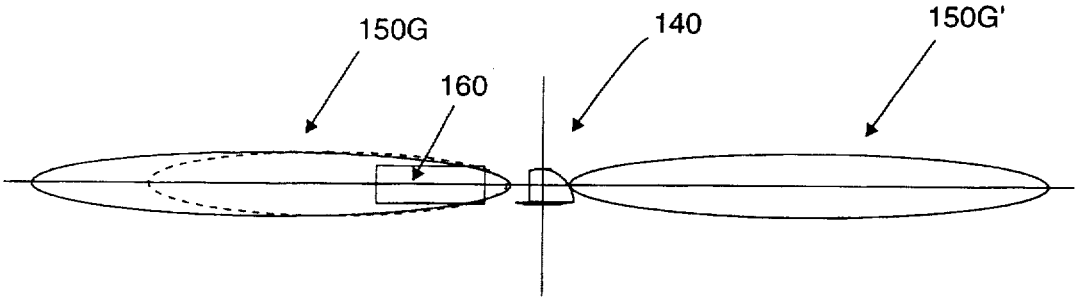
FIG. 4F is a side view of the radiation pattern of the antenna assembly 140 mounted by means of the asymmetric, reflecting ground plane and metal support structure 130 to the personal computer 160, as shown in FIG. 4D.
Figure 4G:
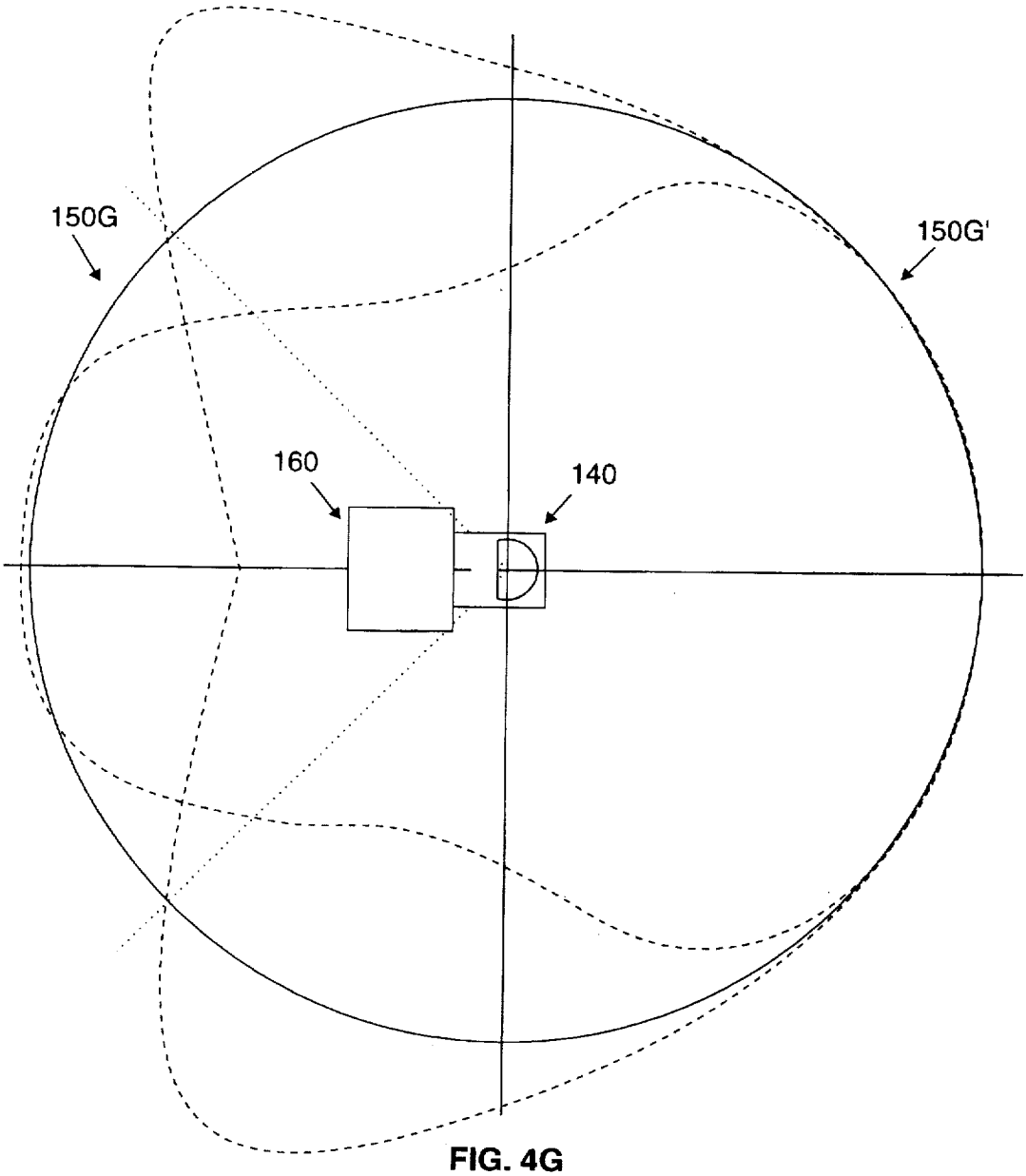
FIG. 4G is a top view of the radiation pattern shown in FIG. 4F.
Figure 4H:
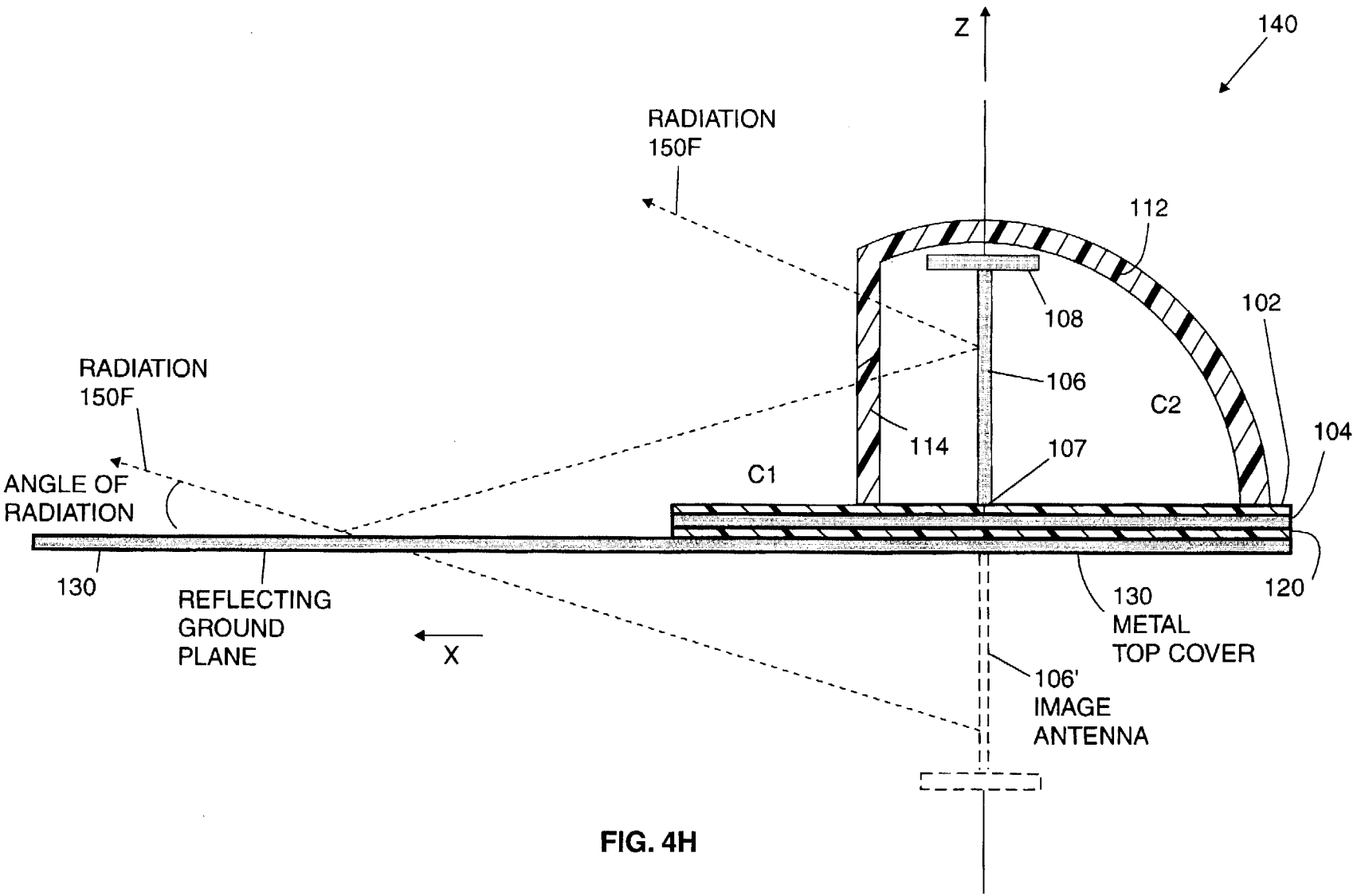
FIG. 4H shows the capacitance C1 and C2 of the antenna 106 with respect to the ground plane 104, for the antenna assembly 140.
Figure 5A:
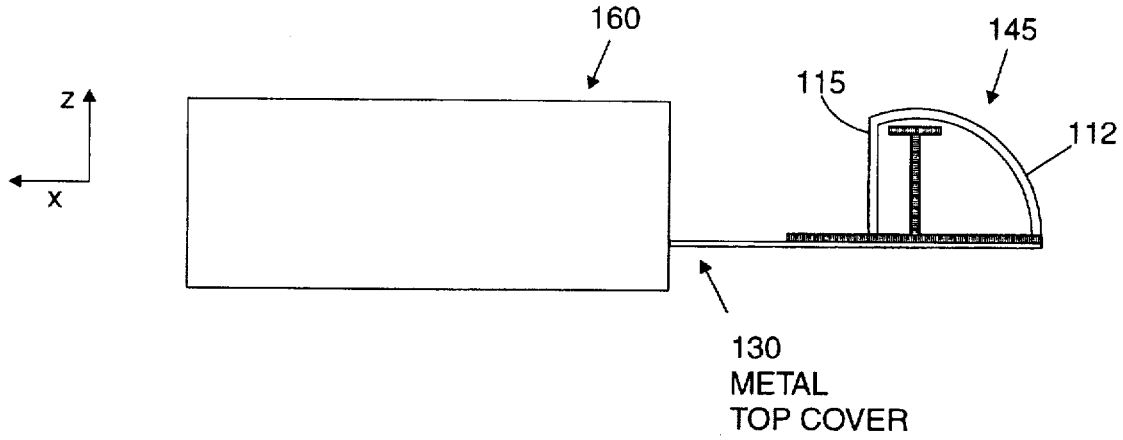
FIG. 5A is a side view of the antenna assembly 145, including the asymmetric radome 112 that includes a cylindrical surface 115 projecting from the face of the shell 114 proximate to the personal computer 160, mounted by means of the asymmetric, reflecting ground plane and metal support structure 130 to the personal computer 160.

FIG. 4B is a side view of the radiation pattern 150F of the antenna assembly 140 in free space. FIG. 4C is a top view of the radiation pattern shown in FIG. 4B. FIG. 4D is a side view of the antenna assembly 140 mounted by means of the asymmetric, reflecting ground plane and metal support structure 130 to the personal computer 160. FIG. 4E is a top view of the antenna assembly 140 mounted by means of the asymmetric, reflecting ground plane and metal support structure 130 to the personal computer 160, of FIG. 4D. FIG. 4F is a side view of the compensated radiation pattern 150G of the antenna assembly 140 mounted by means of the asymmetric, reflecting ground plane and metal support structure 130 to the personal computer 160, as shown in FIG. 4D. FIG. 4G is a top view of the radiation pattern shown in FIG. 4F. FIG. 4H shows the capacitance C1 and C2 of the antenna 106 with respect to the ground plane 104, for the antenna assembly 140.

Figure 5B:
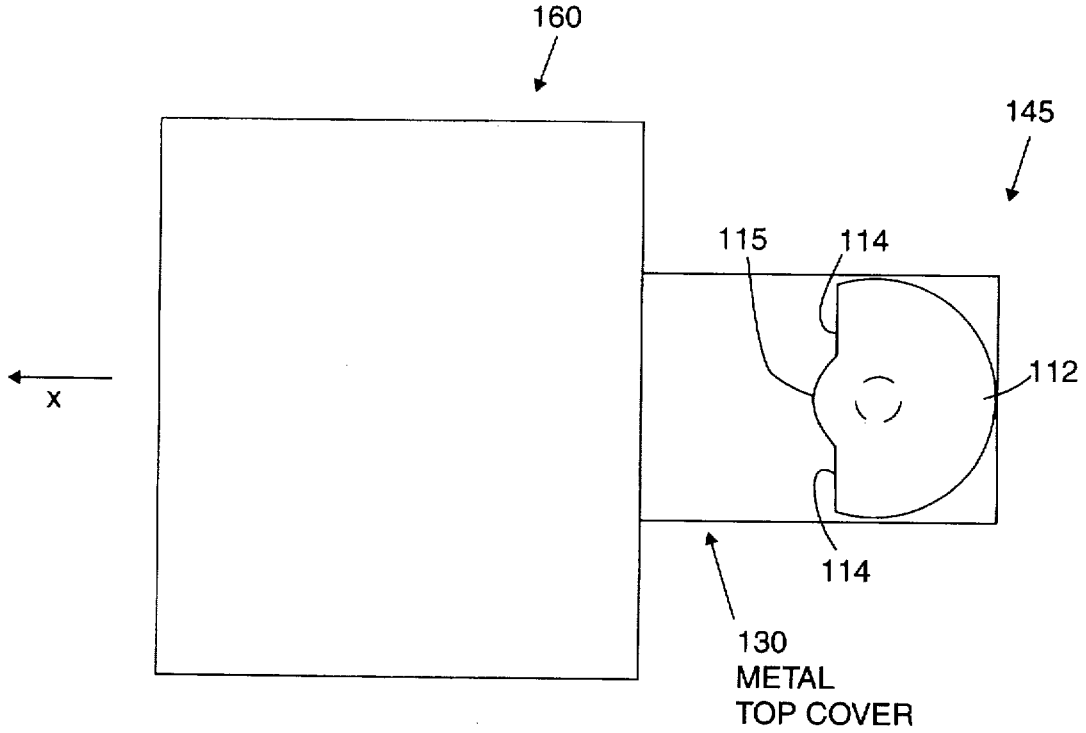
FIG. 5B is a top view of the antenna assembly 145 mounted by means of the asymmetric, reflecting ground plane and metal support structure 130 to the personal computer 160, of FIG. 5A.

The preferred embodiment of the invention is shown in FIG. 5A, which is a side view of the antenna assembly 145, including the asymmetric radome 112 that includes a cylindrical surface 115 projecting from the face of the shell 114 proximate to the personal computer 160, mounted by means of the asymmetric, reflecting ground plane and metal support structure 130 to the personal computer 160. The projecting surface 115 has a cylindrical axis substantially perpendicular to the geometric plane 105. FIG. 5B is a top view of the antenna assembly 145 mounted by means of the asymmetric, reflecting ground plane and metal support structure 130 to the personal computer 160, of FIG. 5A. The inner surface of the cylindrical projecting surface 115 facing inward to the antenna 106 has a radius of 8.98 mm from the center of the hemisphere 112. The plane of the inner surface of the planar portion 114 facing inward to the antenna 106 has a perpendicular distance of 6.34 mm from the center of the hemisphere 112. The wall thickness of the cylindrical projecting surface 115 is 1.5 mm.

Figure 6A:
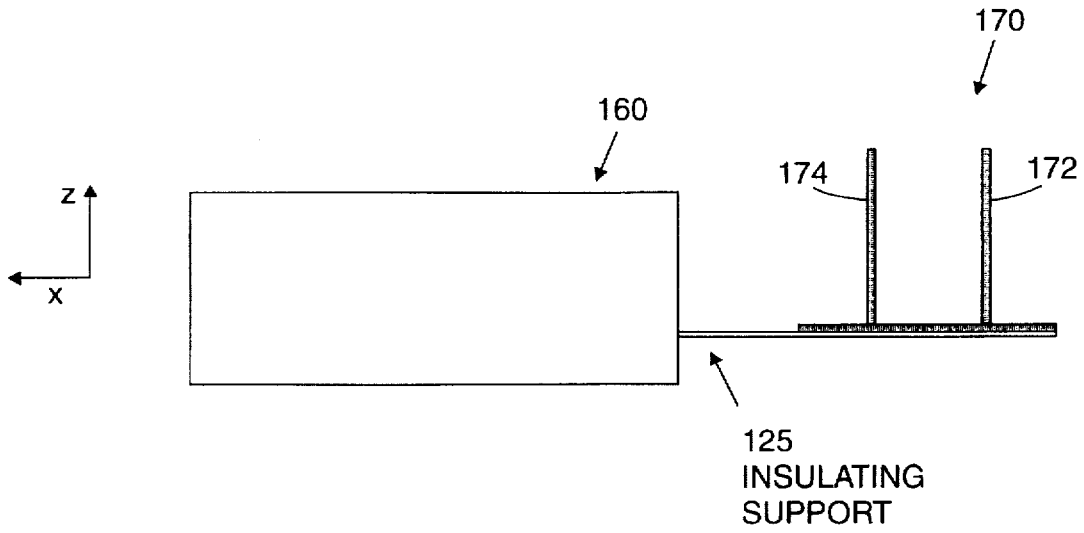
FIG. 6A is a side view of an alternate embodiment of the invention, with an antenna assembly 170 including a directional antenna having a driven dipole element 172 and a parasitic director element 174 positioned between the personal computer 160 and the driven element 172, mounted by means of the insulating support structure 125 to the personal computer 160.
Figure 6B:
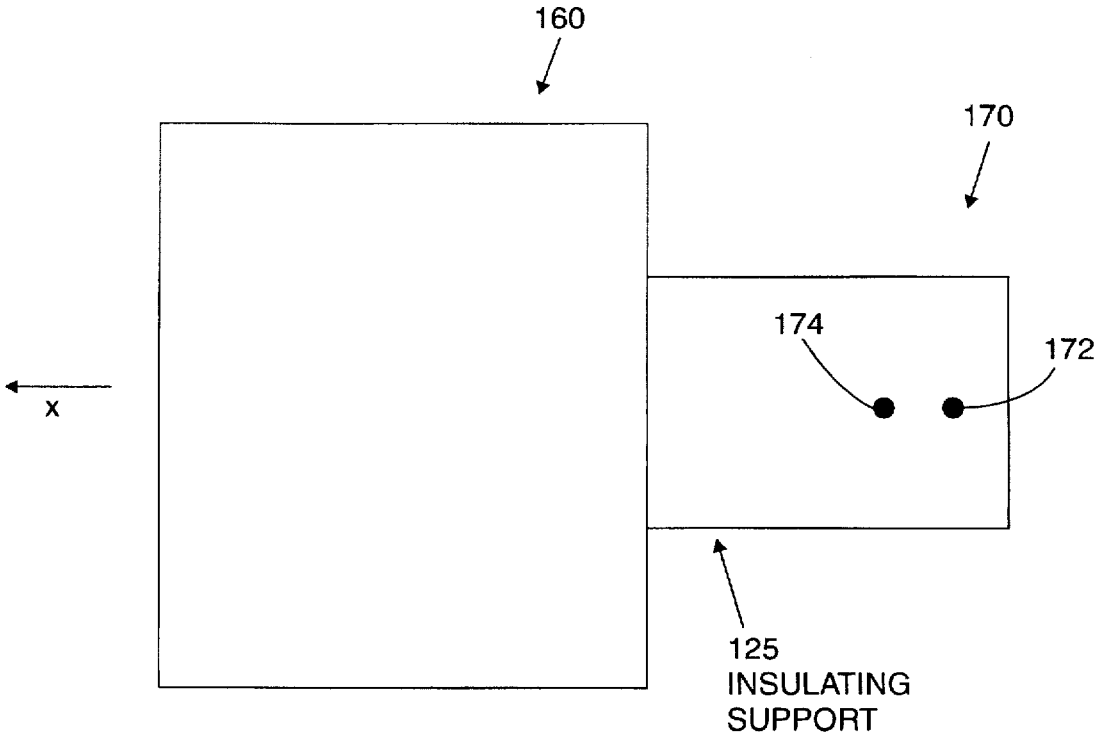
FIG. 6B is a top view of the antenna assembly 170 mounted by means of the insulating support structure 125 to the personal computer 160, of FIG. 6A.
Figure 6C:
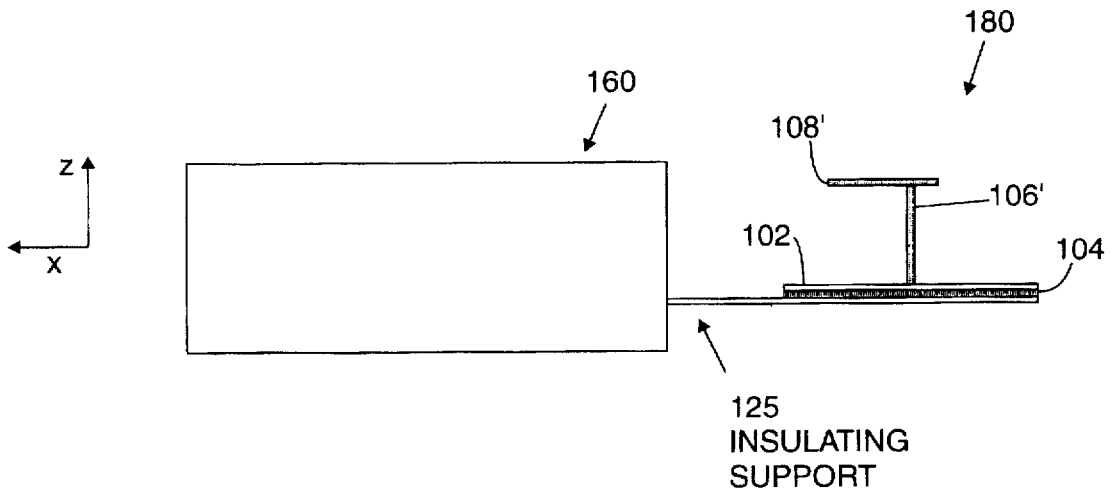
FIG. 6C is a side view of another alternate embodiment of the invention, with an antenna assembly 180 including a directional antenna with the top hat plate 108' on a top hat antenna 106' having an asymmetrical shape forming a capacitance with respect to the ground plane 104 that is greater in the direction toward the personal computer 160 than it is in the direction away from it.
Figure 6D:
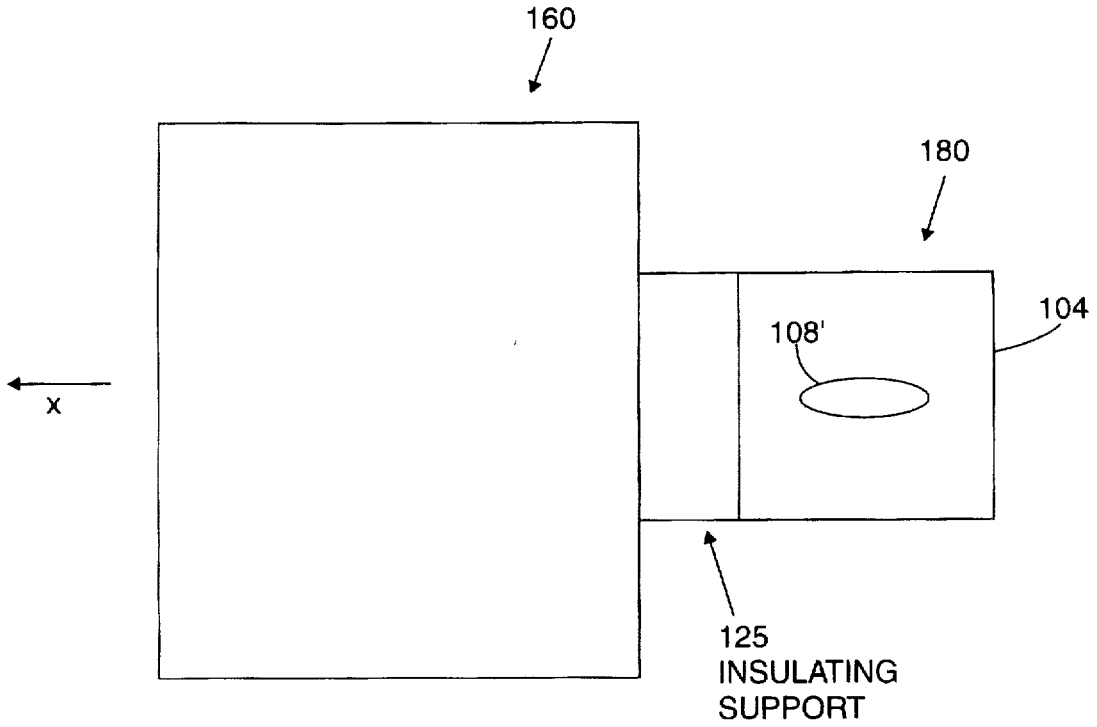
FIG. 6D is a top view of the antenna assembly 180 mounted by means of the insulating support structure 125 to the personal computer 160, of FIG. 6C.

In an alternate embodiment of the invention shown in FIGS. 6A and 6B, the antenna, itself, has an enhanced directivity oriented in the x direction toward the personal computer 160, to compensate for the disturbance to the radiated field. One type of alternate antenna 170 includes a driven dipole element 172 having a mast portion oriented perpendicularly to the geometric plane 105, with one end thereof mounted on the substrate 125 at a base point and electrically connected to a radio frequency signal source. A parasitic director element 174 of the antenna 170 has a mast portion oriented perpendicularly to the geometric plane 105 with one end thereof mounted on the substrate. The director element 174 is positioned between the personal computer 160 and the driven element 172 and is spaced from the driven element 172 to form a plane therewith that passes through the personal computer 160. In this manner, the gain of the antenna 170 is greater in the x direction toward the personal computer 160 than it is in the opposite direction away from the personal computer 160. Other types of directed antennas can also be used in accordance with the invention, to provide an antenna gain which is greater in the x direction toward the personal computer 160 than it is in the opposite direction away from the personal computer 160, so as to compensate for the disturbance to the radiated field imposed by the close proximity of the personal computer. For example, FIG. 6C is a side view of another alternate embodiment of the invention, with an antenna assembly 180 including a directional antenna with the top hat plate 108' on a top hat antenna 106' having an asymmetrical shape forming a capacitance with respect to the ground plane 104 that is greater in the direction toward the personal computer 160 than it is in the direction away from it. FIG. 6D is a top view of the antenna assembly 180 mounted by means of the insulating support structure 125 to the personal computer 160, of FIG. 6C. The elliptically shaped plate 108' of FIG. 6D, for example, has its major axis pointing in the direction of the personal computer housing 160. Alternately, a polygon shaped plate 108', as another example, would have its longest dimension pointing in the direction of the 160 housing. As a further alternative to achieve an asymmetry in the capacitance of the top hat plate 108 with respect to the direction toward and away from the housing 160, the plate 108 can be tilted slightly closer to the ground plane 104 on the side toward the housing 160, to increase the effective capacitance in the direction toward the housing 160. Such tilting of the top hat plate 108 can also be achieved by tilting the mast portion of the antenna 106 toward the personal computer housing 160, thus slightly deviating the mast axis from being perpendicular to the ground plane 104. In this manner, the gain of the antenna 180 is greater in the x direction toward the personal computer housing 160 than it is in the opposite direction away from it.

Figure 7C:
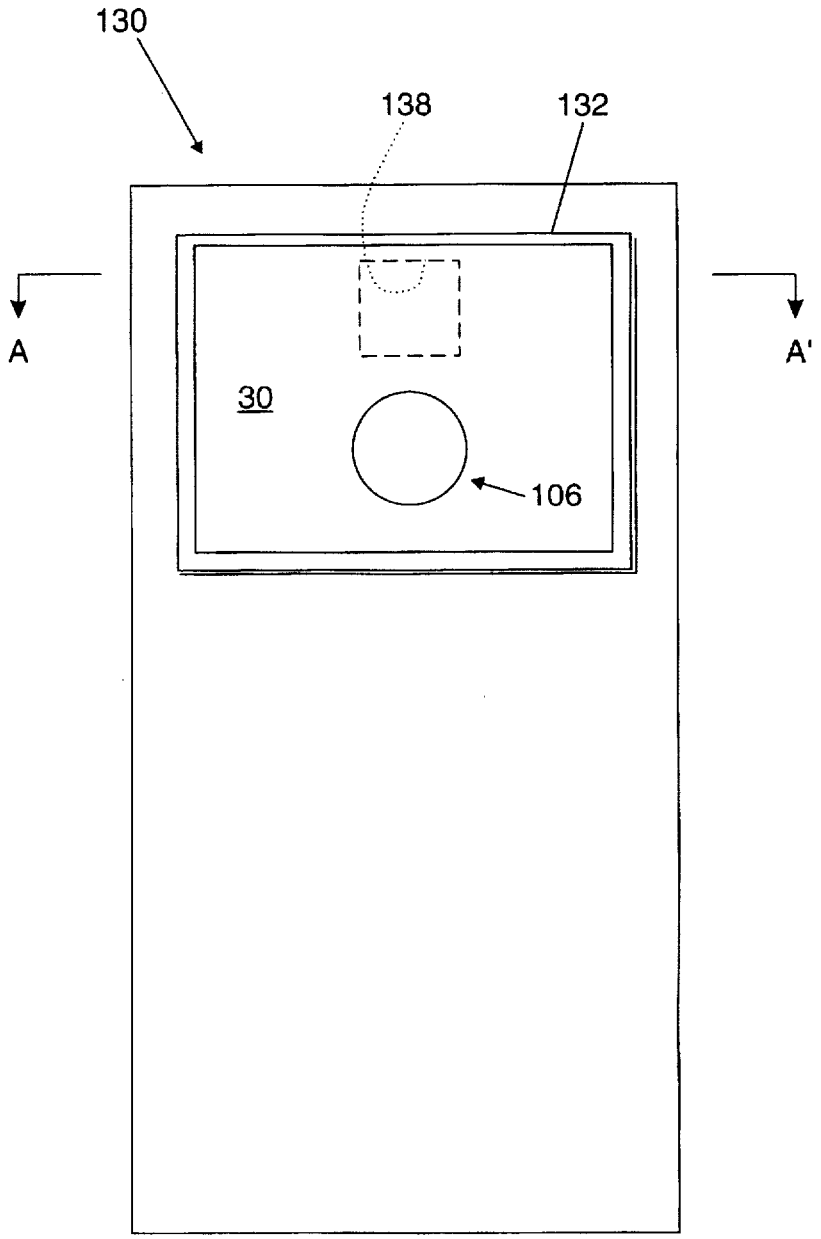
FIG. 7C is a top view of the adapter card 20, showing the relative position of the antenna 106 on the antenna card 30, with respect to the platform 132 and aperture 138 of the top conductive cover 130.
Figure 7D:
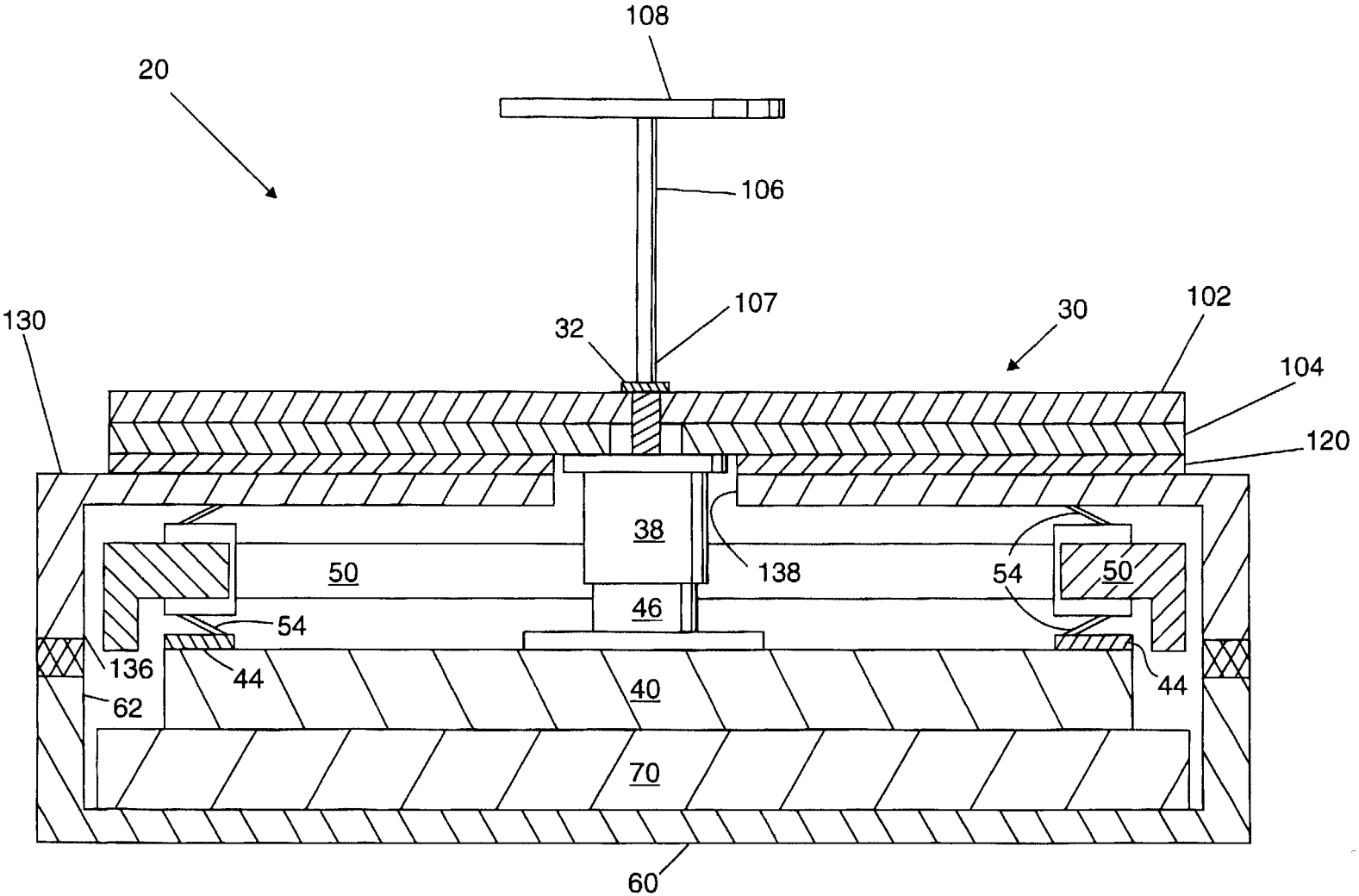
FIG. 7D is a cross-sectional view along the section line A-A' of FIG. 7C, showing the relative position of the antenna card 30, the top conductive cover 130, the frame 50, the springs 54, the circuit card 40, the resilient pad 70, and the bottom conductive cover 60.

Further in accordance with the invention, the preferred embodiment of the adapter card 20 shown in FIG. 7A includes internal RF shielding structures that shield the antenna 106 from noise radiated by radio frequency signal circuits within the card housing. A circuit card 40 inside the adapter card 20 housing has a first edge mounted to a mechanical connector assembly 42 for mounting engagement with a mating connector on the personal computer 160. The circuit card 40 has logic circuits and radio frequency signal circuits mounted on both the upper and lower surfaces. The logic circuits are coupled to electrical terminals in the mechanical connector assembly 42 for exchanging first digital signals with the personal computer 160. The logic circuits output second signals to the radio frequency signal circuits in response to the first signals. The radio frequency signal circuits are coupled to the antenna 106 and output radio frequency signals as the radio frequency signal source to the antenna 106 in response to the second signals. In accordance with the invention, a conductive grounding electrode 44 is formed by a relatively wide printed circuit line that runs around the outer edge of the upper surface of the circuit card 40, as is shown in the cross-sectional view of FIG. 7D. The electrode 44 is connected to a system grounding potential, for shielding the antenna 106 from the radio frequency signal circuits. The card adapter 20 housing includes a frame 50 having a recessed portion 52 on the lower side thereof for mating with the periphery of the upper side of the circuit card 40, as is shown in the cross-sectional view of FIG. 7D. In accordance with the invention, the frame 50 includes a plurality of electrically conductive springs 54 on the lower side thereof, as is shown in the cross-sectional view of FIG. 7D, for resiliently contacting the conductive grounding electrode 44 to make electrical contact therewith for shielding the antenna 106 from the radio frequency signal circuits. The springs 54 also extend to the upper side of the frame 50 opposite to the lower side thereof. The springs 54 in FIG. 7D are shown as pointing horizontally inwardly from the frame 50 to the conductor 44 and also are shown as pointing horizontally inwardly from the frame 50 to the top cover 130. This is the preferred orientation since it tends to force the spring 54 horizontally against the body of the frame 50 to keep the spring in place. The top conductive cover 130 is included in the adapter card 20 housing, having an edge portion 134 on the lower side thereof for mating with the springs 54 on the upper side of the frame, as is shown in the cross-sectional view of FIG. 7D. In accordance with the invention, the springs 54 resiliently contact lower side of the top conductive cover 130 to make electrical contact therewith for shielding the antenna 106 from the radio frequency signal circuits. A bottom conductive cover 60 is included in the adapter card 20 housing, having an edge portion 62 which is laser welded to the edge 136 of the top conductive cover 130, as is shown in the cross-sectional view of FIG. 7D. The bottom conductive cover 60 has a recessed central portion 64. In accordance with the invention, a resilient pad 70 is positioned between the upper surface of the recessed central portion 64 of the bottom cover 60 and the lower surface of the circuit card 40 opposite to the upper surface thereof, for resiliently forcing the plurality of electrically conductive springs 54 into contact with the upper surface of the conductive grounding electrode 44 of the circuit card 40 to make electrical contact therewith, and forcing the springs 54 into contact with lower surface of the top conductive cover 130 to make electrical contact therewith. In this manner, the antenna 106 is shielded from noise radiated from the radio frequency signal circuits.

In accordance with the invention, the conductive adhesive coating 120 provided on the conductive layer 104 of the ground plane of the antenna 106, which mechanically and electrically connects the ground plane 104 to the top cover 130 of the adapter card housing, enables the antenna 106 to be assembled to the top cover 130 of the adapter card housing at a later time after testing of the internal circuits on the circuit card 40 in the adapter card 20. A planar platform surface 132 is provided on the upper side of the top conductive cover 130 opposite to the lower side, for mechanically supporting and electrically contacting the conductive layer 104 of the ground plane of the antenna 106. The platform 132 includes an aperture 138. A first shielded coaxial connector 46 is mounted on the upper surface of the circuit card 40 at a second end opposite from the mechanical connector assembly 42, the first coaxial connector 46 being juxtaposed with the aperture 138 in the planar platform 132, as is shown in the cross-sectional view of FIG. 7D. In this manner, the circuit card 40 can be tested by connecting a test probe to the first shielded coaxial connector 46 through the aperture 138 prior to assembling the antenna 106 and its antenna card 30 to the adapter card 20 housing. A second shielded coaxial connector 38 has its outer, ground electrode mounted on the conductive layer 104 of the ground plane of the antenna 106 of the antenna card 30, as is shown in the cross-sectional view of FIG. 7D, for mating engagement with the first coaxial connector 46 through the aperture 138. A center electrode of the second connector 38, which is insulated from the ground conductive layer 104, is coupled to the antenna 106. The conductive adhesive coating 120 is provided on the conductive layer 104 of the ground plane of the antenna 106, for mechanically and electrically connecting the ground plane 104 to the planar platform surface 132 of the top conductive cover 130. In this manner, the antenna 106 and its antenna card 30 can be assembled to the adapter card 20 housing at a time following testing of the circuit card 40 through the aperture 138. Thereafter, the radome 112 can be attached to the top conductive cover 130 over the antenna 106. FIG. 7A is an exploded view of the components of the preferred embodiment of the adapter card 20. FIG. 7B is an isometric view of the preferred embodiment of the adapter card. FIG. 7C is a top view of the adapter card 20, showing the relative position of the antenna 106 on the antenna card 30, with respect to the platform 132 and aperture 138 of the top conductive cover 130. FIG. 7D is a cross-sectional view along the section line A-A' of FIG. 7C, showing the relative position of the antenna card 30, the top conductive cover 130, the frame 50, the springs 54, the circuit card 40, the resilient pad 70, and the bottom conductive cover 60.

Figure 8A:
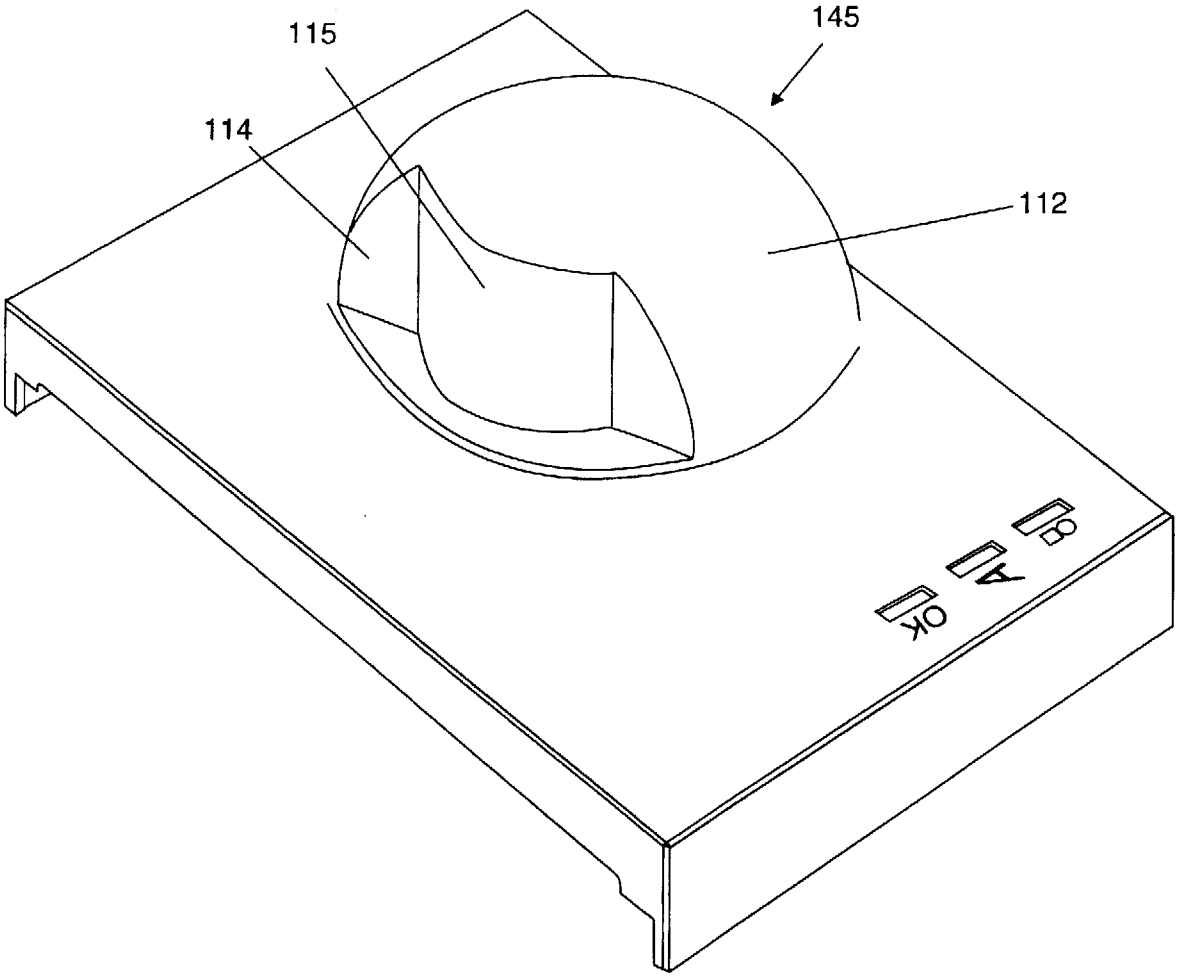
FIG. 8A is an isometric view of the preferred embodiment of the asymmetric radome 112.
Figure 8B:
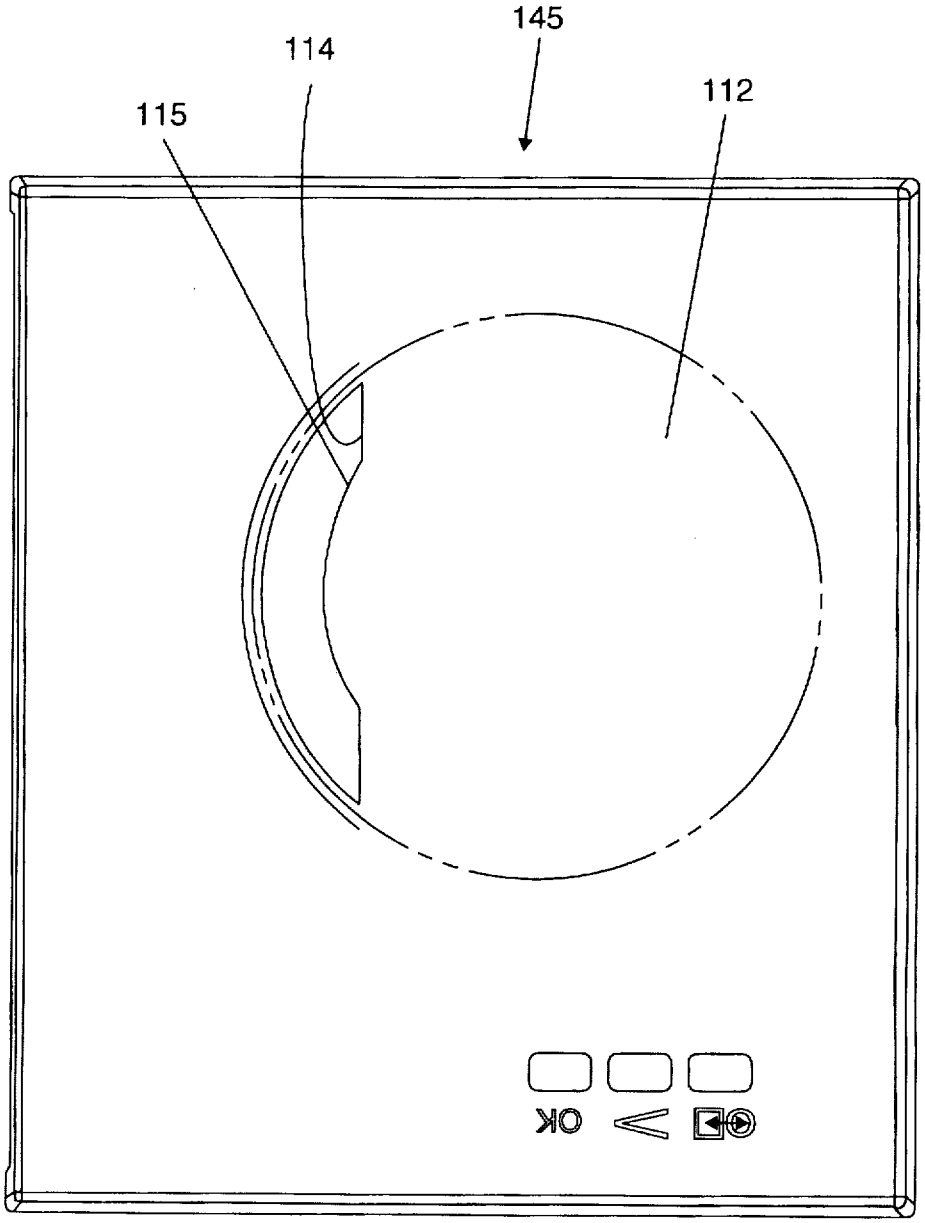
FIG. 8B is a top view of the preferred embodiment of the asymmetric radome 112.
Figure 10A:
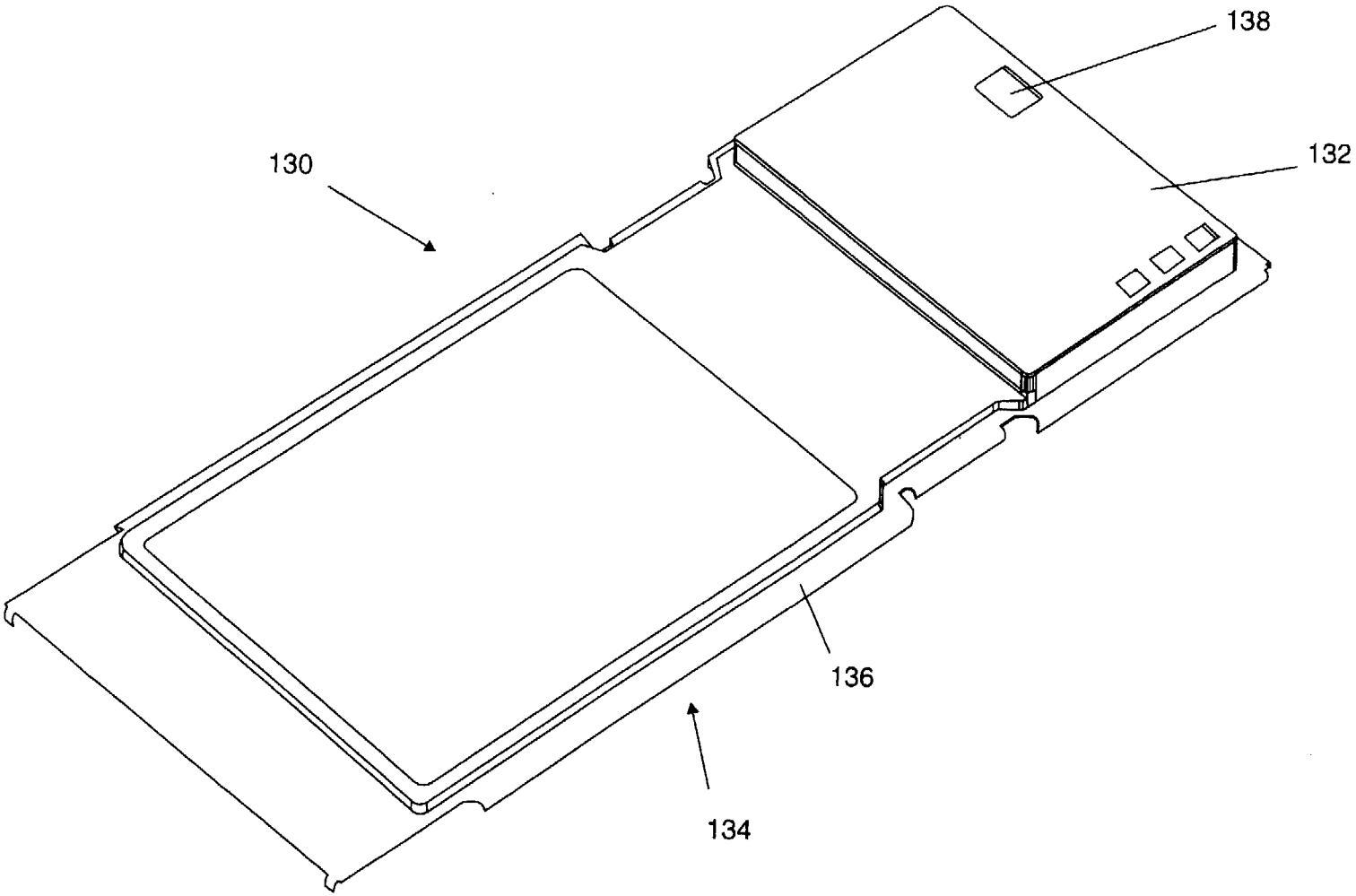
FIG. 10A is an isometric view of preferred embodiment of the top conductive cover 130.
Figure 10B:
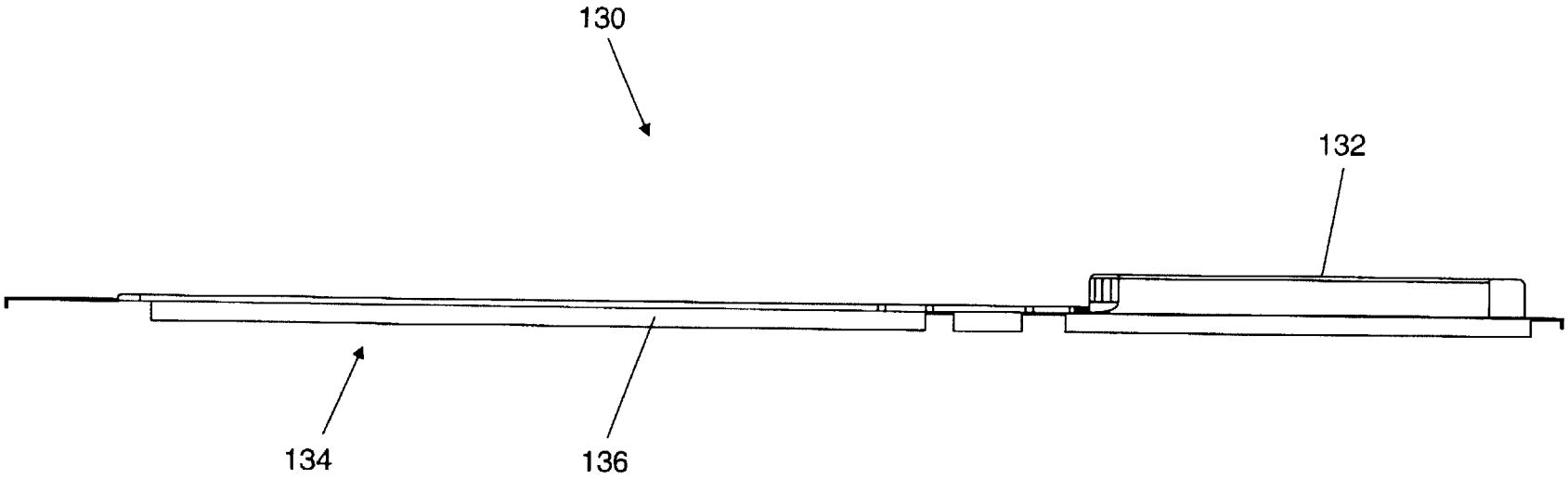
FIG. 10B is a side view of the preferred embodiment of the top conductive cover 130.

FIG. 8A is an isometric view of the preferred embodiment of the asymmetric radome 112. FIG. 8B is a top view of the preferred embodiment of the asymmetric radome 112. FIG. 9A is an exploded view of the components of the preferred embodiment of the antenna card 30. FIG. 9B is a top view of the preferred embodiment of the antenna card. FIG. 10A is an isometric view of the preferred embodiment of the top conductive cover 130. FIG. 10B is a side view of the preferred embodiment of the top conductive cover 130.

The structure of the improved radio frequency local area network adapter card 20 facilitates testing during all phases of its manufacturing. The conductive adhesive coating 120 provided on the conductive layer 104 of the ground plane of the antenna card 30 of FIG. 7D, which mechanically and electrically connects the ground plane 104 to the metal top cover 130, enables the antenna card 30 to be assembled to the cover 130 at a later time after testing of the internal circuits on the circuit card 40. After the circuit card 40 has been built, it is tested before assembly with the covers 130 and 60, the pad 70, and the frame 50. The connector 46 on the circuit card 40 is connected to the testing apparatus to perform electrical tests on the digital and radio circuits on the circuit card 40. If the circuits on the circuit card fail the electrical tests, there is no need to scrap the covers 130 and 60, the pad 70, and the frame 50.

After the circuit card 40 has been successfully tested, it is assembled with the covers 130 and 60, the pad 70, and the frame 50, to form the assembly shown in FIG. 7D, but without the antenna card 30. First, the resilient pad 70 is laid in the recess 64 of the bottom metal cover 60. Then the circuit card 40 is placed on top of the pad 70, as is shown in FIG. 7D. Next, the frame 50 is positioned on top of the circuit card 40 so that the lower fingers of the springs 54 contact the ground conductor 44 on the circuit card 40. Then the top metal cover 130 is placed over the frame 50 with the upper fingers of the springs 54 contacting the bottom surface of the top cover 130. The aperture 138 of the top cover 130 is aligned with the coaxial connector 46 on the circuit card 40. Then, the top cover 130 is pressed downwardly against the springs 54 causing them to flex and tightly engage the bottom surface of the top cover 130 and tightly engage the ground conductor 54 of the circuit card 40. The edge 136 of the top cover 130 then abuts the edge 62 of the bottom cover 60 and the assembly is clamped into place, to enable the edges to be laser welded. The edge 136 of the top metal cover 130 is laser welded to the edge 62 of the bottom metal cover 60.

Since there is a possibility that the assembly process can damage the circuits on the circuit card 40, a second stage of electrical testing must be performed. This is also the stage where the integrity of the assembly can be tested for avoiding any leakage of radiofrequency radiation. The connector 46 on the circuit card 40 is again connected to the testing apparatus, but this time access to the connector 46 is had through the aperture 138 in the top cover 130. In the second testing stage, electrical tests are performed on the digital and radio circuits on the circuit card 40. If the circuits on the circuit card fail the electrical tests, there is no need to scrap the antenna card 30, since it has not yet been assembled to the top cover 130. After the circuit card 40 has been successfully tested through the aperture 138 of the top cover 130, the assembly can be shipped without having the antenna card 30 and the radome 145 assembled to the top cover 130. This is necessary for shipments to some countries that have import inspection laws requiring a retesting of the circuit card 40 without the antenna card 30 in place.

Final assembly of the adapter card 20 takes place by assembling the antenna card 30 and the radome 145 to the top cover 130. This is achieved with the conductive adhesive coating 120 on the conductive layer 104 of the antenna card 30, that mechanically and electrically connects the conductive layer 104 to the supporting surface 132 of the top conductive cover 130. The coaxial connector 38 on the bottom side of the antenna card 30 in FIG. 7D, is inserted through the aperture 138 of the top cover 130, to fit over the mating coaxial connector 46 on the circuit card 40. The conductive adhesive layer 120 has a mechanical compliance that enables it to maintain an effective radiofrequency leakage seal over relative displacements of the antenna card 30 with the top cover 130 that are encountered when differential thermal expansion occurs. Finally, the radome 145 of FIG. 7B is snapped over the top cover 130, completing the assembly of the adapter card 20. Final functional testing can now be performed to test the performance of the adapter card 20 in communications applications. The structure of the adapter card is designed to maintain the antenna and other components in their designed positions after assembly, so that no tuning adjustments are necessary and testing is easily accommodated. This contributes to the relatively low cost of manufacture for the adapter card.

The flow diagram 200 of FIGS. 12A–12F gives the sequence of operational steps in the manufacture and testing of the adapter card 20. The process begins with step 202, building the circuit card 40. Then step 204 is testing before assembly with the connector 46 on the circuit card 40 connected to the testing apparatus to perform electrical tests on the digital and radio circuits on the circuit card 40. Then step 206 is positioning the resilient pad 70 in the recess 64 of the bottom metal cover 60. Then, step 208 is placing the circuit card 40 on top of the pad 70. Then step 210 is positioning the frame 50 on top of the circuit card 40 so that the lower fingers of the springs 54 contact the ground conductor 44 on the circuit card 40. Then step 212 is placing the top metal cover 130 over the frame 50 with the upper fingers of the springs 54 contacting the bottom surface of the top cover 130, with the aperture 138 of the top cover 130 aligned with the coaxial connector 46 on the circuit card 40. Then step 214 is pressing downwardly on the top cover 130 against the springs 54 causing them to flex and tightly engage the bottom surface of the top cover 130 and tightly engage the ground conductor 54 of the circuit card 40. Then step 216 is bringing the edge 136 of the top cover 130 into abutment with the edge 62 of the bottom cover 60 and clamping the assembly into place, to enable the edges to be laser welded. Then step 218 is laser welding the edge 136 of the top metal cover 130 to the edge 62 of the bottom metal cover 60. Then step 220 is performing a second stage of electrical testing of the circuit card 40, to test the integrity of the assembly for avoiding any leakage of radiofrequency radiation. Then step 222 is connecting the connector 46 on the circuit card 40 to the testing apparatus, by accessing the connector 46 is through the aperture 138 in the top cover 130 and performing electrical tests on the digital and radio circuits on the circuit card 40. Then step 224 is inserting the coaxial connector 38 on the bottom side of the antenna card 30 through the aperture 138 of the top cover 130, to fit over the mating coaxial connector 46 on the circuit card 40. Then step 226 is assembling the antenna card 30 to the top cover 130 with the conductive adhesive coating 120 on the conductive layer 104 of the antenna card 30 mechanically and electrically connecting the conductive layer 104 to the supporting surface 132 of the top conductive cover 130. Then step 228 is placing the radome 145 over the top cover 130. Then step 230 is performing final functional testing to test the performance of the adapter card 20 in communications applications.

The resulting radio frequency local area network adapter card invention has a broad radiofrequency communications band, with an omnidirectional, high gain radiation pattern in the horizontal direction with a good distance range, in a minimum height package. The invention facilitates testing during all phases of manufacturing the adapter card.

Although a specific embodiment of the invention has been disclosed, it will be understood by those having skill in the art that changes can be made to that specific embodiment without departing from the spirit and the scope of the invention.

What is claimed is:

1. A radio frequency communications input/output subsystem for a personal computer, comprising:

an electrically insulating substrate having a surface lying in a geometric plane with a conductive layer thereon forming a ground plane;

a subsystem housing having a support for maintaining the substrate in a fixed position therewith, and including a mechanical connector assembly for mounting engagement with a mating connector on a personal computer housing;

an antenna mounted on said substrate and electrically insulated from said ground plane, with a principal axis of said antenna oriented substantially perpendicularly to said ground plane;

said personal computer housing imposing a disturbance to a radiated field from said antenna;

a radome mounted on said subsystem housing and surrounding said antenna, having an enhanced directivity oriented toward said personal computer housing, to compensate for said disturbance to said radiated field;

wherein said radome further comprises:

a substantially hemispherical shell having an open side mounted on said subsystem housing surrounding said antenna, with an edge forming a plane substantially parallel to said geometric plane, with one face of said shell proximate to said personal computer housing having a substantially planar surface substantially perpendicular to said geometric plane;

wherein said radome further comprises:

said one face of said shell proximate to said personal computer housing further including a cylindrical surface projecting therefrom having a cylindrical axis substantially perpendicular to said geometric plane;

wherein said antenna further comprises:

a top hat antenna having a mast portion oriented substantially perpendicularly to said geometric plane with one end thereof mounted on said substrate at a base point and electrically connected to a radio frequency signal source and the opposite end of said mast terminated at a conductive plate oriented substantially parallel to said geometric plane;

wherein said antenna further comprises:

said circular conductive plate having a radius of a first magnitude and said mast having a length of a second magnitude, the sum of said first and second magnitudes being substantially equal to a quarter wave length of electromagnetic radiation having a central resonant frequency value radiated by said antenna in response to said radio frequency signal source;

wherein said antenna further comprises:

a first transmission line mounted on said substrate and coupling said base point to said radio frequency signal source, forming a quarter wavelength matching transformer;

a second transmission line mounted on said substrate and connected to said base point, forming an impedance match at frequencies lower than said central frequency; and a third transmission line mounted on said substrate and connected to said base point, forming an impedance match at frequencies higher than the central frequency.

2. A radio frequency communications input/output subsystem for a personal computer, comprising:

an electrically insulating substrate having a surface lying in a geometric plane with a conductive layer thereon forming a ground plane;

a subsystem housing having a support for maintaining the substrate in a fixed position therewith, and including a mechanical connector assembly for mounting engagement with a mating connector on a personal computer housing;

an antenna mounted on said substrate and electrically insulated from said ground plane, with a principal axis of said antenna oriented substantially perpendicularly to said ground plane;

said personal computer housing imposing a disturbance to a radiated field from said antenna;

a radome mounted on said subsystem housing and surrounding said antenna, having an enhanced directivity oriented toward said personal computer housing, to compensate for said disturbance to said radiated field;

wherein said subsystem housing further comprises:

a circuit card having a first edge mounted to said mechanical connector assembly, said card having logic circuits and radio frequency signal circuits mounted on a first surface thereof;

said logic circuits coupled to electrical terminals in said mechanical connector assembly for exchanging first digital signals with said personal computer, said logic circuits outputting second signals to said radio frequency signal circuits in response to said first signals;

said radio frequency signal circuits coupled to said antenna and outputting radio frequency signals as said radio frequency signal source to said antenna in response to said second signals; and a conductive grounding electrode mounted along the periphery of said first surface of said card, connected to a system grounding potential, for shielding said antenna from said radio frequency signal circuits.

3. The radio frequency communications input/output subsystem for a personal computer of claim 2, wherein said subsystem housing further comprises:

a frame having a recessed portion on a first side thereof for mating with said periphery of said card, including a plurality of electrically conductive springs for resiliently contacting said conductive grounding electrode to make electrical contact therewith for shielding said antenna from said radio frequency signal circuits, said springs extending to a second side of said frame opposite to said first side thereof;

a top conductive cover having an edge portion on a first side thereof for mating with said springs on said second side of said frame, said springs resiliently contacting said top conductive cover to make electrical contact therewith for shielding said antenna from said radio frequency signal circuits and forming a reflecting ground plane for said antenna;

a planar platform surface on a second side of said top conductive cover opposite to said first side, for mechanically supporting and electrically contacting said conductive layer of said ground plane of said antenna, said platform including an aperture therein; and a first shielded coaxial connector mounted on said first surface of said circuit card at a second end opposite from said mechanical connector assembly, said first coaxial connector juxtaposed with said aperture in said planar platform;

whereby said circuit card can be tested by connecting a test probe to said first shielded coaxial connector through said aperture prior to assembling said antenna to said subsystem housing.

4. The radio frequency communications input/output subsystem for a personal computer of claim 3, wherein said subsystem housing further comprises:

a second shielded coaxial connector mounted on said conductive layer of said ground plane of said antenna, for mating engagement with said first coaxial connector through said aperture, a center electrode of said second connector coupled to said antenna.

5. The radio frequency communications input/output subsystem for a personal computer of claim 4, wherein said subsystem housing further comprises:

a bottom conductive cover having an edge portion for mating engagement with an edge of said top conductive cover and having a recessed central portion;

a resilient pad positioned between said recessed central portion of said bottom cover and a second surface of said circuit card opposite to said first surface thereof, for resiliently forcing said plurality of electrically conductive springs into contact with said conductive grounding electrode of said circuit card to make electrical contact therewith, and forcing said springs into contact with said top conductive cover to make electrical contact therewith.

6. The radio frequency communications input/output subsystem for a personal computer of claim 4, wherein said subsystem housing further comprises:

a conductive adhesive coating on said conductive layer of said ground plane of said antenna, for mechanically and electrically connecting said ground plane to said planar platform surface of said top conductive cover;

whereby said antenna can be assembled to said subsystem housing at a time following testing of said circuit card through said aperture and said top conductive cover forms a reflecting ground plane for said antenna.

7. The radio frequency communications input/output subsystem for a personal computer of claim 6, wherein said subsystem housing further comprises:

said radome mounted on said top conductive cover over said planar platform surface.

8. A radio frequency communications input/output subsystem for a personal computer, comprising:

an electrically insulating substrate having a surface lying in a geometric plane with a conductive layer thereon forming a ground plane;

a subsystem housing having a support for maintaining the substrate in a fixed position therewith, and including a mechanical connector assembly for mounting engagement with a mating connector on a personal computer housing;

an antenna mounted on said substrate and electrically insulated from said ground plane, with a principal axis of said antenna oriented substantially perpendicularly to said ground plane;

said personal computer housing imposing a disturbance to a radiated field from said antenna:

said antenna having an enhanced directivity oriented toward said personal computer housing, to compensate for said disturbance to said radiated field;

wherein said antenna further comprises:

a driven element having a mast portion oriented substantially perpendicularly to said geometric plane with one end thereof mounted on said substrate at a base point and electrically connected to a radio frequency signal source; and a parasitic director element having a mast portion oriented substantially perpendicularly to said geometric plane with one end thereof mounted on said substrate;

said director element positioned between said personal computer housing and said driven element and spaced from said driven element to form a plane therewith that is oriented toward said personal computer housing;

whereby the gain of said antenna is greater in a direction toward said personal computer housing than it is in a direction away from said personal computer housing.

9. A radio frequency communications input/output subsystem for a personal computer, comprising:

an electrically insulating substrate having a first surface lying in a geometric plane with a conductive layer thereon forming a ground plane;

a antenna mounted on a second surface of said substrate opposite to said first surface and electrically insulated from said ground plane, with a principal axis of said antenna oriented substantially perpendicularly to said ground plane;

a subsystem housing having a supporting surface for maintaining the substrate in a fixed position therewith, and including a mechanical connector assembly for mounting engagement with a mating connector on a personal computer housing;

a circuit card in said subsystem housing having a first edge mounted to said mechanical connector assembly, said card having logic circuits and radio frequency signal circuits mounted on a first surface thereof;

said logic circuits coupled to electrical terminals in said mechanical connector assembly for exchanging first digital signals with said personal computer, said logic circuits outputting second signals to said radio frequency signal circuits in response to said first signals;

said radio frequency signal circuits coupled to said antenna and outputting radio frequency signals as said radio frequency signal source to said antenna in response to said second signals;

a conductive grounding electrode mounted along the periphery of said first surface of said card for shielding said antenna from said radio frequency signal circuits;

a frame in said subsystem housing having a recessed portion on a first side thereof for mating with said periphery of said card, including a plurality of electrically conductive springs for resiliently contacting said conductive grounding electrode to make electrical contact therewith for shielding said antenna from said radio frequency signal circuits, said springs extending to a second side of said frame opposite to said first side thereof;

a top conductive cover having an edge portion on a first side thereof for mating with said springs on said second side of said frame, said springs resiliently contacting said top conductive cover to make electrical contact therewith for shielding said antenna from said radio frequency signal circuits and for forming a reflecting ground plane for said antenna;

a planar platform surface on a second side of said top conductive cover opposite to said first side, for mechanically supporting and electrically contacting said conductive layer of said ground plane of said antenna, said platform including an aperture therein;

a first shielded coaxial connector mounted on said first surface of said circuit card at a second end opposite from said mechanical connector assembly, said first coaxial connector juxtaposed with said aperture in said planar platform;

a second shielded coaxial connector mounted on said conductive layer of said ground plane of said antenna, for mating engagement with said first coaxial connector through said aperture, a center electrode of said second connector coupled to said antenna;

a bottom conductive cover having an edge portion for mating engagement with an edge of said top conductive cover and having a recessed central portion;

a resilient pad positioned between said recessed central portion of said bottom cover and a second surface of said circuit card opposite to said first surface thereof, for resiliently forcing said plurality of electrically conductive springs into contact with said conductive grounding electrode of said circuit card to make electrical contact therewith, and forcing said springs into contact with said top conductive cover to make electrical contact therewith; and a conductive adhesive coating on said conductive layer of said ground plane of said antenna, for mechanically and electrically connecting said ground plane to said planar platform surface of said top conductive cover to enable said top conductive cover to form a reflecting ground plane for said antenna;

whereby said antenna is shielded from noise radiated from said radio frequency signal circuits and said top conductive cover forms a reflecting ground plane for said antenna.

10. A radio frequency communications input/output subsystem for a personal computer, comprising:

an electrically insulating substrate having a first surface lying in a geometric plane with a conductive layer thereon forming a ground plane;

a antenna mounted on a second surface of said substrate opposite to said first surface and electrically insulated from said ground plane, with a principal axis of said antenna oriented substantially perpendicularly to said ground plane;

a subsystem housing having a supporting surface for maintaining the substrate in a fixed position therewith, and including a mechanical connector assembly for mounting engagement with a mating connector on a personal computer housing;

a circuit card in said subsystem housing having a first edge mounted to said mechanical connector assembly, said card having logic circuits and radio frequency signal circuits mounted on a first surface thereof;

said logic circuits coupled to electrical terminals in said mechanical connector assembly for exchanging first digital signals with said personal computer, said logic circuits outputting second signals to said radio frequency signal circuits in response to said first signals;

said radio frequency signal circuits coupled to said antenna and outputting radio frequency signals as said radio frequency signal source to said antenna in response to said second signals;

a conductive cover mounted to said circuit card for shielding said antenna from said radio frequency signal circuits, said cover having a planar platform surface on a second side thereof, said platform including an aperture therein;

a first shielded coaxial connector mounted on said first surface of said circuit card at a second end opposite from said mechanical connector assembly, said first coaxial connector juxtaposed with said aperture in said planar platform to enable said circuit card to be tested by connecting a test probe to said first shielded coaxial connector through said aperture prior to assembling said antenna to said subsystem housing;

a second shielded coaxial connector mounted on said conductive layer of said ground plane of said antenna, for mating engagement with said first coaxial connector through said aperture, a center electrode of said second connector coupled to said antenna; and a conductive adhesive coating on said conductive layer of said ground plane of said antenna, for mechanically and electrically connecting said ground plane to said planar platform surface of said conductive cover and enabling said top conductive cover to form a reflecting ground plane for said antenna;

whereby said antenna can be assembled to said subsystem housing at a time following testing of said circuit card through said aperture and said top conductive cover forms a reflecting ground plane for said antenna.

11. A radio frequency communications input/output subsystem for a personal computer, comprising:

an electrically insulating substrate having a first surface lying in a geometric plane with a conductive layer thereon forming a substrate ground plane;

an antenna mounted on a second surface of said substrate opposite to said first surface and electrically insulated from said substrate ground plane, with a principal axis of said antenna oriented substantially perpendicularly to said substrate ground plane;

a first transmission line mounted on said second surface of said substrate and coupling said base point to said radio frequency signal source, forming a quarter wavelength matching transformer;

a second transmission line mounted on said second surface of said substrate and connected to said base point, forming an impedance match at frequencies lower than said central frequency; and a third transmission line mounted on said second surface of said substrate and connected to said base point, forming an impedance match at frequencies higher than the central frequency, a subsystem housing having a supporting surface for maintaining the substrate in a fixed position therewith, and including a mechanical connector assembly for mounting engagement with a mating connector on a personal computer, said antenna positioned at a remote end of said housing from said personal computer;

whereby the antenna has a broad band radiation characteristic.

12. A process for manufacturing a radiofrequency local area network adapter card, comprising the steps of:

building a circuit card;

testing the circuit card by connecting a first coaxial connector thereon to a testing apparatus to perform electrical tests on circuits on the circuit card;

positioning a resilient pad in a recess of a bottom metal cover;

placing the circuit card on top of the resilient pad;

positioning a frame on top of the circuit card, the frame having lower fingers of springs which contact a ground conductor on the circuit card;

placing a top metal cover over the frame with upper fingers of said springs contacting a bottom surface of the top cover and aligning an aperture of the top cover with the first coaxial connector on the circuit card;

pressing downwardly on the top cover against the springs causing them to flex and tightly engage the bottom surface of the top cover and tightly engage the ground conductor of the circuit card;

bringing an edge of the top cover into abutment with an edge of the bottom cover and clamping them into place, to enable the edges to be joined together;

joining the edge of the top metal cover to the edge of the bottom metal cover;

performing a second stage of electrical testing of the circuit card, to test the integrity of the covers for avoiding leakage of radiofrequency radiation;

connecting the first connector on the circuit card to a testing apparatus, by accessing the first connector through the aperture in the top cover and performing electrical tests on the circuits on the circuit card;

inserting a second coaxial connector on a bottom side of the antenna card through the aperture of the top cover, to engage the first coaxial connector on the circuit card;

assembling the antenna card to the top cover with a conductive adhesive coating on a conductive layer of the antenna card, thereby mechanically and electrically connecting the conductive layer to the top conductive cover;

placing a radome over the top cover; and performing final functional testing to test the performance of the adapter card in communications applications.

13. A process for manufacturing a radiofrequency local area network adapter card, comprising the steps of:

positioning a resilient pad on a bottom metal cover;

placing a circuit card on top of the resilient pad;

positioning a frame on top of the circuit card, the frame having lower fingers of springs which contact a ground conductor on the circuit card;

placing a top metal cover over the frame with upper fingers of said springs contacting a bottom surface of the top cover and aligning an aperture of the top cover with the first coaxial connector on the circuit card;

pressing downwardly on the top cover against the springs causing them to flex and tightly engage the bottom surface of the top cover and tightly engage the ground conductor of the circuit card, said pressing thereby bringing an edge of the top cover into abutment with an edge of the bottom cover to enable the edges to be joined together;

joining the edge of the top metal cover to the edge of the bottom metal cover;

connecting the first connector on the circuit card to a testing apparatus, by accessing the first connector through the aperture in the top cover and performing electrical tests on the circuits on the circuit card;

inserting a second coaxial connector on a bottom side of an antenna card through the aperture of the top cover, to engage the first coaxial connector on the circuit card; and assembling the antenna card to the top cover with a conductive adhesive coating on a conductive layer of the antenna card, thereby mechanically and electrically connecting the conductive layer to the top conductive cover.

* * * * *